US008114560B2

(12) United States Patent
Nakayama et al.

(10) Patent No.: US 8,114,560 B2
(45) Date of Patent: Feb. 14, 2012

(54) TONER, IMAGE FORMING APPARATUS, IMAGE FORMING METHOD, AND PROCESS CARTRIDGE USING THE TONER

(75) Inventors: Shinya Nakayama, Numazu (JP); Akihiro Kotsugai, Numazu (JP); Akiyoshi Sabu, Numazu (JP); Hiroshi Yamashita, Numazu (JP); Hiroshi Yamada, Numazu (JP); Junichi Awamura, Numazu (JP); Tsuyoshi Sugimoto, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 876 days.

(21) Appl. No.: 12/118,006

(22) Filed: May 9, 2008

(65) Prior Publication Data

US 2008/0280219 A1 Nov. 13, 2008

(30) Foreign Application Priority Data

May 11, 2007 (JP) ..... 2007-127419
Oct. 31, 2007 (JP) ..... 2007-283082

(51) Int. Cl.
*G03G 9/087* (2006.01)

(52) U.S. Cl. ..... 430/108.3; 430/109.4

(58) Field of Classification Search ..... 430/108.3, 430/109.4
See application file for complete search history.

(56) References Cited

U.S. PATENT DOCUMENTS 4,863,824 A * 9/1989 Uchida et al. ..... 430/109.4
5,342,724 A * 8/1994 Wilson ..... 430/114
7,232,636 B2 * 6/2007 Semura et al. ..... 430/137.18
2003/0108808 A1 6/2003 Inoue et al.
2003/0165760 A1 9/2003 Higuchi et al.
2007/0248380 A1 10/2007 Iwamoto et al.
2007/0281236 A1 12/2007 Watanabe et al.
2007/0281237 A1 12/2007 Iwamoto et al.

FOREIGN PATENT DOCUMENTS

EP 1 862 859 A2 12/2007
JP 2000-305319 11/2000
JP 2002-287427 10/2002
JP 2003-98726 4/2003
JP 3597525 9/2004
JP 3801487 5/2006
WO WO 2007/123273 A1 11/2007

OTHER PUBLICATIONS

U.S. Appl. No. 11/943,972, filed Nov. 21, 2007, Shinya Nakayama, et al.
U.S. Appl. No. 11/943,929, filed Nov. 21, 2007, Shinya Nakayama, et al.
U.S. Appl. No. 12/203,278, filed Sep. 3, 2008, Yamada, et al.
U.S. Appl. No. 12/253,558, filed Oct. 17, 2008, Nakayama, et al.

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

The present invention provides a toner containing at least a binder resin, a releasing agent, and a colorant, wherein the binder resin contains at least a polyester resin (A) having a softening point Tm (A) of 120° C. to 160° C., a polyester resin (B) having a softening point Tm (B) of 80° C. or more and less than 120° C. and a composite resin (C) containing a condensation polymerization monomer and an addition polymerization monomer, at least any one of the polyester resins (A) and (B) is a polyester resin prepared by condensation-polymerizing an alcohol component substantially composed of only aliphatic alcohol with a carboxylic acid component, and 65% or more of the alcohol component is 1,2-propanediol.

18 Claims, 14 Drawing Sheets

TONER, IMAGE FORMING APPARATUS, IMAGE FORMING METHOD, AND PROCESS CARTRIDGE USING THE TONER

BACKGROUND OF THE INVENTION

1. Field of the Invention

The present invention relates to a toner to be used in image formation based on electrophotography such as copiers, printers, facsimiles, and electrostatic recording devices. The present invention also relates to an image forming apparatus, an image forming method and a process cartridge each of which uses the toner.

2. Description of the Related Art

For image forming apparatuses such as printers, copiers and facsimiles, in recent years, market demands for energy saving and increases in speed have increased. In order to achieve the performance of these demands, it is important to achieve improvements in thermal efficiency of a fixing unit used in an image forming apparatus.

Generally, in an image forming apparatus, an unfixed toner image is formed on a recording medium such as recording sheet, printing paper, photosensitive paper and electrostatic recording paper by using a direct transfer method or an indirect transfer method through an image formation process such as electrophotographic recording, electrostatic recording and magnetic recording. As a fixing unit used for fixing such an unfixed toner image, for example, contact heating methods, such as heating roller method, film heating method and electromagnetic induction heating method, are widely employed.

Further, for an electrophotographic toner (hereinafter, may be simply referred to as "toner"), with higher speed performance and energy saving of an image forming apparatus, a toner which is excellent in low-temperature fixing property is requested. In the meanwhile, there is a need for a toner having properties of anti-offset property and storage stability (blocking resistance) which are contradictory to the low-temperature fixing property.

To meet the needs, a variety of toners using aromatic polyester resins are proposed, but they have a disadvantage in that they are poor in pulverizability in their production process. Then, to address the problem, a method is proposed in which a low-molecular weight polyester resin prepared using an aliphatic alcohol that is excellent in pulverizability as a monomer is blended with a highly polymeric polyester (see Japanese Patent Application Laid-Open (JP-A) No. 2002-287427). However, when the low-molecular weight polyester resin prepared using an aliphatic alcohol is used, the storage stability of the toner is degraded because the polyester resin has a low glass transition temperature due to its structure and it is difficult to satisfy low-temperature fixing property, anti-offset property and storage stability at a high level. In addition, since the low-molecular weight polyester resin prepared using an aliphatic alcohol has low mechanical strength, it may cause a problem with occurrence of toner fine particles and contamination inside the used developing device and developing sleeves when the toner is agitated and sheared in the developing device.

Further, in a fixing unit used in an electrophotographic image forming apparatus, the used toner is requested to have releasing property (may be referred to as "anti-offset property") to heating members is required. The anti-offset property can be improved by containing a releasing agent in a toner, and how the releasing agent is present inside the toner greatly affect the releasing property. It is desired that the releasing agent be uniformly dispersed in the toner in terms of stability of the quality, however, when the releasing agent is excessively finely dispersed in the toner, the releasing agent hardly exudes out of the toner surface at the time of heating. Thus, it is preferable that the releasing agent be dispersed so as to have a moderate dispersion diameter. However, for a polyester resin prepared using an aliphatic alcohol, there is a problem that it is highly soluble in generally used releasing agents and is poor in releasing property.

Further, methods are proposed in which a resin grafted with a vinyl resin is used as a dispersing agent in a releasing agent such as polyolefin, and the releasing agent is moderately dispersed in a toner (for example, see Japanese Patent Application Laid-Open (JP-A) Nos. 2000-305319, 2003-98726, Japanese Patent (JP-B) Nos. 3597525 and 3801487). However, dispersing agents prepared in accordance with these proposals are not suitable for polyester resins prepared using aliphatic alcohol, and these proposals are incapable of improving the releasing property of toner.

Therefore, as for a toner that is excellent in all of the low-temperature fixing property, anti-offset property, storage stability, mechanical strength, anti-fouling property to developing devices, toner filming resistance to latent electrostatic image bearing members and carrier particles, and pulverizability and is capable of forming high-quality images over a long period of time, and as for an image forming apparatus and related technologies which are capable of forming extremely high-quality images using a toner with no change in color tone being recognized and with no abnormal images such as a reduction in image density and background smear being observed for a long period of time, those having satisfactory performance have not yet been provided so far. Currently, further improvements and developments are desired.

BRIEF SUMMARY OF THE INVENTION

The present invention aims to provide a toner that is excellent in all of the low-temperature fixing property, anti-offset property, storage stability, mechanical strength, anti-fouling property to developing devices, toner filming resistance to latent electrostatic image bearing members and carrier particles, and pulverizability and is capable of forming high-quality images over a long period of time. The present invention also aims to provide an image forming apparatus, an image forming method and a process cartridge each of which uses the toner of the present invention and is capable of forming extremely high-quality images with no change in color tone being recognized and with no abnormal images such as a reduction in image density and background smear being observed for a long period of time.

Means for solving the above-mentioned problems are as follows.

<1> A toner containing at least a binder resin, a releasing agent, and a colorant, wherein the binder resin contains at least a polyester resin (A) having a softening point Tm (A) of 120° C. to 160° C., a polyester resin (B) having a softening point Tm (B) of 80° C. or more and less than 120° C. and a composite resin (C) containing a condensation polymerization monomer and an addition polymerization monomer, at least any one of the polyester resins (A) and (B) is a polyester resin prepared by condensation-polymerizing an alcohol component substantially composed of only aliphatic alcohol with a carboxylic acid component, and 65 mole % or more of the alcohol component is 1,2-propanediol.

<2> The toner according to the item <1>, wherein 90 mole % or more of the alcohol component is the aliphatic alcohol.

<3> The toner according to any one of the items <1> to <2>, wherein the alcohol component of at least any one of the polyester resins (A) and (B) further contains glycerin.

<4> The toner according to any one of the items <1> to <3>, wherein the alcohol component of the polyester resin (A) further contains 1,3-propanediol.

<5> The toner according to any one of the items <1> to <4>, wherein the carboxylic acid component of at least any one of the polyester resins (A) and (B) contains an aliphatic dicarboxylic acid compound having 2 to 4 carbon atoms.

<6> The toner according to any one of the items <1> to <5>, wherein the carboxylic acid component of at least any one of the polyester resins (A) and (B) contains a purified rosin.

<7> The toner according to any one of the items <1> to <6>, wherein the mass ratio [(A)/(B)] of the polyester resin (A) to the polyester resin (B) is 10/90 to 90/10.

<8> The toner according to any one of the items <1> to <7>, wherein the difference [Tm (A)−Tm (B)] of the softening point Tm (A) minus the softening point Tm (B) is 10° C. or more.

<9> The toner according to any one of the items <1> to <8>, wherein the softening point Tm (C) of the composite resin (C) is 90° C. to 130° C.

<10> The toner according to any one of the items <1> to <9>, wherein the condensation polymerization monomer contained in the composite resin (C) contains an alcohol component and a carboxylic acid component.

<11> The toner according to the item <10>, wherein the alcohol component contained in the condensation polymerization monomer in the composite resin (C) contains an aromatic polyhydric alcohol compound.

<12> The toner according to any one of the items <10> to <11>, wherein the carboxylic acid component contained in the condensation polymerization monomer in the composite resin (C) contains an aromatic polyhydric carboxylic acid compound.

<13> The toner according to any one of the items <1> to <12>, wherein the addition polymerization monomer contained in the composite resin (C) contains a vinyl compound containing at least a styrene monomer and an acrylate monomer.

<14> The toner according to any one of the items <1> to <13>, wherein the molar ratio of the condensation polymerization monomer in the composite resin (C) is 5 mole % to 40 mole %.

<15> The toner according to any one of the items <1> to <14>, wherein the mass ratio [(C)/((A)+(B))] of the composite resin (C) to the polyester resins (A) and (B) is 3/97 to 20/80.

<16> The toner according to any one of the items <1> to <15>, wherein the mass ratio [(releasing agent)/(binder resin)×100] of the releasing agent to the binder resin is 1% by mass to 20% by mass.

<17> The toner according to any one of the items <1> to <16>, wherein the releasing agent contains carnauba wax.

<18> A developer containing at least a toner, wherein the toner is a toner according to any one of claims <1> to <17>.

<19> A toner container filled with a toner according to any one of the items <1> to <17>.

<20> An image forming apparatus having at least a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner is a toner according to any one of the items <1> to <17>.

<21> The image forming apparatus according to the item <20>, wherein the charging unit is a charging unit configured to charge the surface of the latent electrostatic image bearing member in a non-contact manner.

<22> The image forming apparatus according to the item <20>, wherein the charging unit is a charging unit configured to charge the surface of the latent electrostatic image bearing member in a contact manner.

<23> The image forming apparatus according to any one of the items <20> to <22>, wherein the developing unit has a developer bearing member that has a magnetic field generating unit fixedly mounted inside thereof and rotatably carries on its surface a two-component developer containing a magnetic carrier and the toner.

<24> The image forming apparatus according to any one of the items <20> to <23>, wherein the developing unit has a developer bearing member to which the toner is supplied, and a layer thickness controlling member for forming a thin layer of the toner on the surface of the developer bearing member.

<25> The image forming apparatus according to any one of the items <20> to <24>, wherein the transfer unit is a transfer unit configured to transfer a visible image formed on the latent electrostatic image bearing member onto a recording medium.

<26> The image forming apparatus according to any one of the items <20> to <25>, wherein a plurality of image forming elements each of which include at least a latent electrostatic image bearing member, a charging unit, a developing unit and a transfer unit are arranged; and the transfer unit is a transfer unit configured to sequentially transfer each visible image formed on each surface of the latent electrostatic image bearing members onto a recording medium whose surface is shifted so as to pass through a transfer position opposed to each of the latent electrostatic image bearing members constituting the plurality of image forming elements.

<27> The image forming apparatus according to any one of the items <20> to <24>, wherein the transfer unit has an intermediate transfer member onto which a visible image formed on the surface of the latent electrostatic image bearing member is primarily transferred, and a secondary transfer unit configured to secondarily transfer the visible image carried on the intermediate transfer member onto a recording medium.

<28> The image forming apparatus according to any one of the items <20> to <27>, further having a cleaning unit, wherein the cleaning unit has a cleaning blade that makes contact with the surface of the latent electrostatic image bearing member.

<29> The image forming apparatus according to any one of the items <20> to <27>, wherein the developing unit has a developer bearing member that makes contact with the surface of the latent electrostatic image bearing member and is configured to develop a latent electrostatic image formed on the surface of the latent electrostatic image bearing member and collect a residual toner remaining on the surface of the latent electrostatic image bearing member.

<30> The image forming apparatus according to any one of the items <20> to <29>, wherein the fixing unit has at least any one of a roller and a belt, and the transferred image on the recording medium is heated and pressurized by heating the recording medium from a surface of which is not in contact with the toner to thereby fix the transferred image on the recording medium.

<31> The image forming apparatus according to any one of the items <20> to <29>, wherein the fixing unit has at least any one of a roller and a belt, and the transferred image on the recording medium is heated and pressurized by heating the recording medium from a surface of which is in contact with the toner to thereby fix the transferred image on the recording medium.

<32> The image forming apparatus according to any one of the items <20> to <29>, wherein the fixing unit has a heating roller that is composed of a magnetic metal and is heated by electromagnetic induction, a fixing roller placed in parallel with the heating roller, a toner heating medium formed in an endless belt which is spanned over the heating roller and the fixing roller and is heated by the heating roller and rotated by these rollers, and a pressurizing roller that is pressed contact with the fixing roller via the toner heating medium and rotates in the forward direction relative to the toner heating medium to form a fixing nip, wherein an unfixed image formed on a recording medium is passed through between the toner heating medium and the pressurizing roller to thereby thermally fix the unfixed image.

20<33> An image forming method including at least charging the surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner is a toner according to any one of the items <1> to <17>.

<34> The image forming method according to the item <33>, wherein in the charging step, the surface of the latent electrostatic image bearing member is charged in a non-contact manner.

<35> The image forming method according to the item <33>, wherein in the charging step, the surface of the latent electrostatic image bearing member is charged in a contact manner.

<36> The image forming method according to any one of the items <33> to <35>, wherein in the developing step, the latent electrostatic image is developed by using a developer bearing member that has a magnetic field generating unit fixedly mounted inside thereof and rotatably carries on its surface a two-component developer containing a magnetic carrier and the toner.

<37> The image forming method according to any one of the items <33> to <35>, wherein in the developing step, the latent electrostatic image is developed by using the developer bearing member to which the toner is supplied, and a layer thickness controlling member for forming a thin layer of the toner on the surface of the developer bearing member.

<38> The image forming method according to any one of the items <33> to <37>, wherein the transferring step is a transferring step in which a visible image formed on the latent electrostatic image is transferred onto a recording medium.

<39> The image forming method according to any one of the items <33> to <38>, wherein an image is formed using an image forming apparatus in which a plurality of image forming elements are arranged, each of which includes at least a latent electrostatic image bearing member, a charging unit, a developing unit and a transfer uni; and the transfer unit is a transfer unit configured to sequentially transfer each visible image formed on each surface of the latent electrostatic image bearing members onto a recording medium whose surface is shifted so as to pass through a transfer position opposed to each of the latent electrostatic image bearing members constituting the plurality of image forming elements.

<40> The image forming method according to any one of the items <33> to <37>, wherein the transferring step uses an intermediate transfer member to which a visible image formed on the surface of the latent electrostatic image bearing member is primarily transferred, and a secondary transfer unit configured to secondarily transfer the visible image carried on the intermediate transfer member onto a recording medium.

<41> The image forming method according to any one of the items <33> to <40>, further including a cleaning step, wherein the cleaning step uses a cleaning blade that makes contact with the surface of the latent electrostatic image bearing member.

<42> The image forming method according to any one of the items <33> to <40>, wherein the developing step uses a developer bearing member that makes contact with the surface of the latent electrostatic image bearing member to develop the latent electrostatic image formed on the surface of the latent electrostatic image bearing member and collect a residual toner remaining on the surface of the latent electrostatic image bearing member.

<43> The image forming method according to any one of the items <33> to <42>, wherein the fixing step uses at least any one of a roller and a belt to fix the transferred image on a recording medium by heating and pressurizing the transferred image from a surface of the recording medium which is not in contact with the toner.

<44> The image forming method according to any one of the items <33> to <42>, wherein the fixing step uses at least any one of a roller and a belt to fix the transferred image on a recording medium by heating and pressurizing the transferred image from a surface of the recording medium which is in contact with the toner.

<45> The image forming method according to any one of the items <33> to <42>, wherein the fixing step uses a fixing having a heating roller that is composed of a magnetic metal and is heated by electromagnetic induction, a fixing roller placed in parallel with the heating roller, a toner heating medium formed in an endless belt which is spanned over the heating roller and the fixing roller and is heated by the heating roller and rotated by these rollers, and a pressurizing roller that is pressed contact with the fixing roller via the toner heating medium and rotates in the forward direction relative to the toner heating medium to form a fixing nip, wherein an unfixed image formed on a recording medium is passed through between the toner heating medium and the pressurizing roller to thereby thermally fix the unfixed image.

<46> A process cartridge detachably mounted on an image forming apparatus main body, having at least a latent electrostatic image bearing member and a developing unit configured to develop a latent electrostatic image formed on the surface of the latent electrostatic image bearing member using a toner to form a visible image, wherein the toner is a toner according to any one of the items <1> to <17>.

The toner of the present invention contains at least a binder resin, a releasing agent and a colorant, wherein the binder resin contains at least a polyester resin (A) having a softening point Tm (A) of 120° C. to 160° C., a polyester resin (B) having a softening point Tm (B) of 80° C. or more and less than 120° C. and a composite resin (C) containing a condensation polymerization monomer and an addition polymerization monomer, at least any one of the polyester resins (A) and (B) is a polyester resin prepared by condensation-polymerizing an alcohol component substantially composed of only aliphatic alcohol with a carboxylic acid component, and 65 mole % or more of the alcohol component is 1,2-propanediol.

In the toner of the present invention, the polyester resin (A) having high-softening point contributes to an improvement in anti-offset property, and the polyester resin (B) having low-softening point contributes to an improvement in low-temperature fixing property. The use in combination of these polyester resins is effective in satisfying both the low-temperature fixing property and anti-offset property. The 1,2-propanediol which is a branched chain alcohol having 3 carbon atoms is effective in improving low-temperature fixing property with maintaining anti-offset property as compared to an alcohol having 2 or less carbon atoms, and the use thereof allows for fixing an image at an extremely low temperature and improving storage stability. Further, the composite resin (C) composed of a condensation polymerization monomer and an addition polymerization monomer is excellently dispersed in a blend of the polyester resins (A) and (B) of the present invention and is capable of uniformly dispersing generally used releasing agents in the resin components with an optimum dispersion diameter without making them excessively soluble in the resin components, and thus the releasing property of the toner to fixing members is excellently improved. Furthermore, the composite resin (C) is more excellent in mechanical strength than a polyester substantially composed of an aliphatic alcohol and imparts resistance to stirring hazards to the toner in a developing device. As a result of these synergetic effects, the toner of the present invention becomes excellent in low-temperature fixing property, anti-offset property, storage stability, mechanical strength, anti-fouling property to developing devices, toner filming resistance to latent electrostatic image bearing members and carrier particles, and pulverizability and becomes capable of forming high-quality images.

The developer of the present invention contains the toner of the present invention. Thus, when an image is formed using the developer by electrophotography, a high-quality image can be obtained with keeping excellence in all of the low-temperature fixing property, anti-offset property, storage stability, mechanical strength, anti-fouling property to developing devices, toner filming resistance to latent electrostatic image bearing members and carrier particles.

The image forming apparatus of the present invention has at least a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, and as the toner, the toner of the present invention is used.

In the image forming apparatus of the present invention, the charging unit is configured to uniformly charge the surface of the latent electrostatic image bearing member. The exposing unit is configured to expose the surface of the latent electrostatic image bearing member to form a latent electrostatic image. The developing unit is configured to develop the latent electrostatic image formed on the surface of the latent electrostatic image bearing member using a toner to form a visible image. The transfer unit is configured to transfer the visible image onto a recording medium. The fixing unit is configured to fix the transferred image on the recording medium. In the above image formation process, as the toner, the toner of the present invention is used, and thus it is possible to form extremely high-quality images with no change in color tone and with no abnormal images such as a reduction in image density and background smear being observed for a long period of time.

The image forming method of the present invention includes at least charging the surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, and as the toner, the toner of the present invention is used.

In the image forming method of the present invention, in the charging step, the surface of the latent electrostatic image bearing member is uniformly charged; in the exposing step, the surface of the latent electrostatic image bearing member is exposed to form a latent electrostatic image; in the developing step, the latent electrostatic image formed on the surface of the latent electrostatic image bearing member is developed using a toner to form a visible image; in the transferring step, the visible image is transferred onto a recording medium; and in the fixing step, the transferred image is fixed on the recording medium. In the image formation process, for the toner, the toner of the present invention is used, and thus it is possible to form extremely high-quality images with no change in color tone and with no abnormal images such as a reduction in image density and background smear being observed for a long period of time.

The process cartridge of the present invention has at least a latent electrostatic image bearing member and a developing unit configured to develop a latent electrostatic image formed on the surface of the latent electrostatic image bearing member using a toner to form a visible image and is detachably mounted on an image forming apparatus main body. Since the process cartridge is excellent in user-friendliness and the toner of the present invention is used therein, it allows for forming extremely high-quality images with no change in color tone and with no abnormal images such as a reduction in image density and background smear being observed for a long period of time.

DETAILED DESCRIPTION OF THE INVENTION (Toner)

Figure 1:
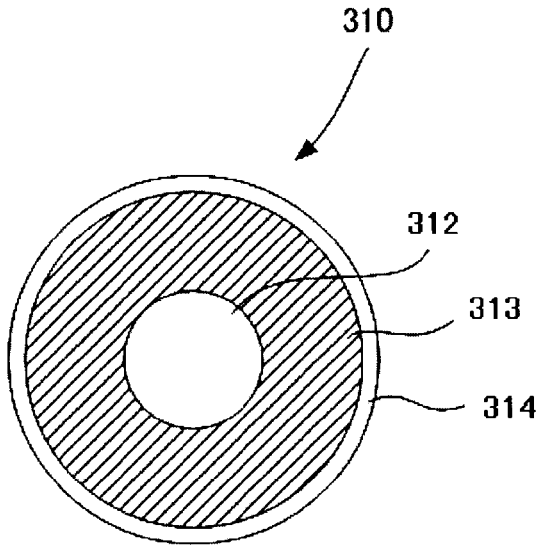
FIG. 1 is a cross-sectional view schematically showing one example of a charging roller used in an image forming apparatus according to the present invention.

The toner of the present invention contains at least a binder resin, a releasing agent and a colorant, contains external additives, and further contains other components in accordance with the necessity.

<Binder Resin>

The binder resin contains at least a polyester resin (A) having a softening point Tm (A) of 120° C. to 160° C., a polyester resin (B) having a softening point Tm (B) of 80° C. or more and less than 120° C. and a composite resin (C) containing a condensation polymerization monomer and an addition polymerization monomer.

—Polyester Resins (A) and (B)—

The polyester resins (A) and (B) can be obtained by condensation-polymerizing an alcohol component and a carboxylic acid component.

The softening point Tm (A) of the polyester resin (A) is 120° C. to 160° C., preferably 130° C. to 155° C., and more preferably 135° C. to 155° C.

The softening point Tm (B) of the polyester resin (B) is 80° C. or more and less than 120° C., preferably 85° C. to 115° C., and more preferably 90° C. to 110° C.

The difference of the Tm (A) minus the Tm (B), that is [ΔTm; Tm (A)−Tm (B)], is preferably 10° C. or more, more preferably 15° C. to 55° C., and still more preferably 20° C. to 50° C.

To provide low-temperature fixing property, anti-hot offset property and heat resistance-storage stability to the toner, the mass ratio [(A)/(B)] of the polyester resin (A) to the polyester resin (B) is preferably 10/90 to 90/10, more preferably 20/80 to 80/20, and still more preferably 30/70 to 70/30.

As for the polyester resins (A) and (B) provided such characteristic values, the polyester resin (A) having a high-softening point contributes to an improvement in anti-offset property, and the polyester resin (B) having a low-softening point contributes to an improvement in low-temperature fixing property. The use in combination of these polyester resins (A) and (B) is effective in satisfying both the low-temperature fixing property and anti-offset property.

In the present invention, at least any one of the polyester resins (A) and (B) contains 65 mole % or more of 1,2-propanediol in the alcohol component and can be obtained by condensation-polymerizing an alcohol component substantially composed of only aliphatic alcohol with a carboxylic acid component.

—Alcohol Component—

The 1,2-propanediol, which is a branched chain alcohol having 3 carbon atoms, used in the alcohol component is effective in improving low-temperature fixing property with maintaining anti-offset property as compared to an alcohol having 2 or less carbon atoms and is effective in preventing a reduction in storage stability accompanied by a decrease in glass transition temperature as compared to a branched chain alcohol having 4 or more carbon atoms. The 1,2-propanediol exerts a remarkable effect that the use thereof allows for fixing an image at an extremely low temperature and improving storage stability. Further, a polyester resin containing 1,2-propanediol as an alcohol component is excellent in solubility in releasing agents and easily dispersed therein. Particularly when the content of 1,2-propanediol is 65 mole % or more in the alcohol component, it exerts excellent low-temperature fixing property and anti-offset property.

The alcohol component may contain alcohols other than 1,2-propanediol within the range where the purposes and effects of the present invention are not impaired, however, the content of 1,2-propanediol in the alcohol component is 65 mole % or more, preferably 70 mole % or more, more preferably 80 mole % or more, and still more preferably 90 mole % or more.

Examples of divalent alcohol components other than 1,2-propandiol include 1,3-propanediol, ethylene glycols having a different carbon atoms, hydrogenated bisphenol A or aliphatic dialcohols such as alkylene (having 2 to 4 carbon atoms) oxide adducts (with average added moles: 1 to 16) thereof.

The content of the divalent alcohol component in the alcohol component is preferably 60 mole % to 95 mole % and more preferably 65 mole % to 90 mole %.

The alcohol component of the polyester resin (A) preferably contains 1,3-propanediol from the perspective of anti-offset property. The molar ratio (1,2-propanediol/1.3-propanediol) of 1,2-propanediol to 1,3-propanediol in the alcohol component is preferably 99/1 to 65/35, more preferably 95/5 to 70/30, still more preferably 90/10 to 75/25, and particularly preferably 85/15 to 77/23.

The alcohol component of at least any one of the polyester resins (A) and (B) may contain aromatic alcohols including alkylene oxide adducts of bisphenol A such as polyoxypropylene (2,2)-2,2-bis (4-hydroxyphenyl) propane, and polyoxyethylene (2,2)-2,2-bis (4-hydroxyphenyl) propane, however, the alcohol component of at least any one of the polyester resins (A) and (B) is substantially composed of only aliphatic alcohol, and it is preferred that both of the alcohol components of the polyester resins (A) and (B) are substantially composed of only aliphatic alcohol.

Note that the description "the alcohol component substantially composed of aliphatic alcohol" means that the content of the aliphatic alcohol in the alcohol component is 90 mole % or more, more preferably 95 mole % or more, still more preferably 98 mole % or more, and particularly preferably 99 mole % or more.

—Carboxylic Acid Component—

The carboxylic acid component is not particularly limited and may be suitably selected in accordance with the intended use, however, it is preferable that an aliphatic dicarboxylic acid compound having 2 to 4 carbon atoms be contained in the carboxylic acid component. Examples of the aliphatic dicarboxylic acid compound having 2 to 4 carbon atoms include adipic acid, maleic acid, malic acid, succinic acid, fumaric acid, citraconic acid, itaconic acid or anhydrides of acids thereof. Of these, at least one aliphatic dicarboxylic acid compound selected from succinic acid, fumaric acid, citraconic acid and itaconic acid is preferable in terms of effectiveness in improving low-temperature fixing property, and itaconic acid is particularly preferable.

The content of the aliphatic dicarboxylic acid having 2 to 4 carbon atoms in the carboxylic acid component is preferably 0.5 mole % to 20 mole % and more preferably 1 mole % to 10 mole % from the perspective of improving low-temperature fixing property and preventing decreases in glass transition temperature. A polyester resin that can be obtained by condensation-polymerizing such an aliphatic carboxylic acid compound having no aromatic rings with 1,2-propanediol allows for improving solubility in releasing agents, and thus the use thereof in combination with a releasing agent makes it possible to further improve toner filming resistance.

Further, it is preferred that a rosin be contained in the carboxylic component. By using a rosin which has a polycyclic aromatic ring, the water absorbing property held by a conventional aliphatic alcohol polyester is reduced to thereby further improve the effect of preventing a reduction in charged amount under high-temperature and high-humidity conditions.

The rosin is a natural resin obtained from pine tree (*pinus rigidia*) and the main component thereof is a resin acid such as abietic acid, neoabietic acid, palustrene acid, pimaric acid, isopimaric acid, sandrakopimaric acid, and dehydroabietic acid or a mixture thereof.

The rosin is broadly classified into tall rosin obtained from tall oil that can be obtained as a by-product in the course of producing a pulp, gum rosin obtained from crude pine rosin, wood rosin obtained from pine stubs and the like. The rosin used in the present invention is preferably tall rosin from the perspective of low-temperature fixing property.

The rosin may be a modified rosin such as disproportionated rosin and hydrogenated rosin, however, in the present invention, it is preferable to use a so-called "crude rosin", which is not modified, from the perspective of low-temperature fixing property and storage stability.

The rosin is preferably a purified rosin from the perspective of improving storage stability and deodorization.

The purified rosin is a rosin from which impurities have been removed by purification process. Examples of major impurities include 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethyl cyclohexanone, 1-methyl-2-(1-methylethyl) benzene, 3,5-dimethyl 2-cyclohexane, and 4-(1-methylethyl) benzaldehyde. In the present invention, peak intensities of three types of impurities, from among the above-mentioned impurities, i.e., hexanoic acid, pentanoic acid and benzaldehyde, detected as volatilized components by Headspace GC-MS can be used as indicators of the purified rosin. Note that the reason of using volatilized components as indicators, instead of using the absolute amount of impurities is that the use of a purified rosin in the present invention contributes deodorization, which is one of the improved points of the present invention, as compared to conventional polyester resins each of which contains rosin.

The purified rosin mentioned in the present invention is a rosin of which in the hereinafter described measurement conditions based on Headspace GC-MS, the peak intensity of hexanoic acid is $0.8\times10^7$ or less, the peak intensity of pentanoic acid is $0.4\times10^7$ or less, and the peak intensity of benzaldehyde is $0.4\times10^7$ or less. Further, from the perspective of storage stability and deodorization, the peak intensity of hexanoic acid is preferably $0.6\times10^7$ or less and more preferably $0.5\times10^7$ or less. The peak intensity of pentanoic acid is preferably $0.3\times10^7$ or less and more preferably $0.2\times10^7$ or less. The peak intensity of benzaldehyde is preferably $0.3\times10^7$ or less and more preferably $0.2\times10^7$ or less.

Further, from the perspective of storage stability and deodorization, it is preferable that the amount of impurities of n-hexanal and 2-pentylfuran be reduced, in addition to the above-mentioned three impurities. The peak intensity of n-hexanal is preferably $1.7\times10^7$ or less, more preferably $1.6\times10^7$ or less, and still more preferably $1.5\times10^7$ or less. The peak intensity of 2-pentylfuran is preferably $1.0\times10^7$ or less, more preferably $0.9\times10^7$ or less, and still more preferably $0.8\times10^7$ or less.

The purification method of the rosin is not particularly limited and known methods in the art are utilized. Examples thereof include distillation, recrystallization, and extraction. The rosin is preferably purified by distillation. For the distillation method, for example, the methods described in Japanese Patent Application Laid-Open (JP-A) No. 7-286139 can be used, such as reduced-pressure distillation, molecular distillation and steam distillation. The rosin is preferably purified by reduced-pressure distillation. For example, a distillation is generally carried out under a pressure of 6.67 kPa or less and a still temperature of 200° C. to 300° C., and distillation methods such as thin-layer distillation, rectification distillation, including commonly used simple distillation can be used. In normal distillation conditions, to the used rosin, 2% by mass to 10% by mass of high-molecular weight substances is removed as a pitch portion, and 2% by mass to 10% by mass of an initial fraction is removed.

The softening point of the purified rosin is preferably 50° C. to 100° C., more preferably 60° C. to 90° C., and still more preferably 65° C. to 85° C. By purifying the used rosin, impurities contained in the rosin are removed. The softening point of the purified rosin in the present invention means a softening point measured when a rosin is melted once by the method to be described below and then the rosin is naturally cooled for one hour under an environment of a temperature of 25° C. and a relative humidity of 50%.

The acid value of the purified rosin is preferably 100 mgKOH/g to 200 mgKOH/g, more preferably 130 mgKOH/g to 180 mgKOH/g, and still more preferably 150 mgKOH/g to 170 mgKOH/g.

The content of the purified rosin in the carboxylic acid component is preferably 2 mole % to 50 mole %, more preferably 5 mole % to 40 mole %, and still more preferably 10 mole % to 30 mole %.

The carboxylic acid component may contain the aliphatic carboxylic acid compound and carboxylic acid compounds other than rosins within the range where the effects of the present invention are not impaired. From the perspective of securing the desired glass transition temperature, it is preferable that aromatic dicarboxylic acids such as phthalic acid, isophthalic acid and terephthalic acid be contained in the carboxylic acid component. The content of the aromatic dicarboxylic acid in the carboxylic acid component is preferably 40 mole % to 95 mole %, more preferably 50 mole % to 90 mole %, and still more preferably 60 mole % to 80 mole %.

The polyester resin is preferably a crosslinked polyester resin, and it is preferred that a trivalent or higher raw monomer be contained in at least any one of the alcohol component and the carboxylic acid component. The content of the trivalent or higher raw monomer in the total amount of the alcohol component and the carboxylic acid component is preferably 0 mole % to 40 mole % and more preferably 5 mole % to 30 mole %.

For a trivalent or higher polyhydric carboxylic acid compound in the trivalent or higher raw monomer, for example, trimellitic acid or a derivative thereof is preferable. For a trivalent or higher polyhydric alcohol, for example, glycerin, pentaerythritol, trimethylolpropane, sorbitol or alkylene (having 2 to 4 carbon atoms) oxide adducts (average added moles: 1 to 16) and the like are exemplified. Of these, glycerin is particularly preferable because it not only acts as a crosslinker, but also is effective in improvements in low-temperature fixing property. From these viewpoints, it is preferable that the alcohol component of at least any one of the polyester resins (A) and (B) contain glycerin. The content of the glycerin in the alcohol component is preferably 5 mole % to 40 mole %, and more preferably 10 mole % to 35 mole %.

—Esterified Catalyst—

A condensation polymerization reaction between the alcohol component and the carboxylic acid component is preferably carried out in the presence of an esterified catalyst. Examples of the esterified catalyst include Lewis acids such as p-toluene sulfonic acid; titanium compounds, and tin (II) compounds having no Sn—C bond. These esterified catalysts may be used alone or two of them may be used in combination. Of these, titanium compounds and tin (II) compounds having no Sn—C bond are particularly preferable.

For the titanium compound, a titanium compound having a Ti—O bond is preferable, and a compound containing an alkoxy group, an alkenyloxy group or an acyloxy group each having the total carbon atoms of 1 to 28 is more preferable.

Examples of the titanium compound include titanium diisopropylate bis(triethanolaminate) [$Ti(C_6H_{14}O_3N)_2(C_3H_7O)_2$], titanium diisopropylate bis(diethanolaminate) [$Ti(C_4H_{10}O_2N)_2(C_3H_7O)_2$], titanium dipentylate bis(triethanolaminate) [$Ti(C_6H_{14}O_3N)_2(C_5H_{11}O)_2$], titanium diethylate bis(triethanolaminate) [$Ti(C_6H_{14}O_3N)_2(C_2H_5O)_2$], titanium dihydroxy octylate bis(triethanolaminate) [$Ti(C_6H_{14}O_3N)_2(OHC_8H_{16}O)_2$], titanium distearate bis(triethanolaminate) [$Ti(C_6H_{14}O_3N)_2(C_{18}H_{37}O)_2$], titanium triisopropylate triethanolaminate [$Ti(C_6H_{14}O_3N)_1(C_3H_7O)_3$], and titanium monopropylate tris(triethanolaminate) [$Ti(C_6H_{14}O_3N)_3(C_3H_7O)_1$]. Of these, titanium diisopropylate bis(triethanolaminate), titanium diisopropylate bis(diethanolaminate), and titanium dipentylate bis(triethanolaminate) are particularly preferable. These titanium compounds are commercially available from Matsumoto Trading Co., Ltd.

Preferred examples of other titanium compounds include tetra-n-butyltitanate [$Ti(C_4H_9O)_4$], tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyl dihydroxyoctyl titanate [$Ti(C_8H_{17}O)_2(OHC_8H_{16}O)_2$], and dimyristyl dioctyl titanate [$Ti(C_{14}H_{29}O)_2(C_8H_{17}O)_2$]. Of these, tetrastearyl titanate, tetramyristyl titanate, tetraoctyl titanate, and dioctyl dihydrooxyoctyl titanate are preferable. These titanium compounds can be obtained, for example, by reacting titanium halide with a corresponding alcohol and are commercially available from NISSO Co., Ltd.

The existing amount of the titanium compound to 100 parts by mass of the total amount of the alcohol component and the carboxylic acid component is preferably 0.01 parts by mass to 1.0 part by mass and more preferably 0.1 parts by mass to 0.7 parts by mass.

For the tin (II) compound having no Sn—C bond, a tin (II) compound having an Sn—O bond, a tin (II) compound having an Sn—X (X indicates a halogen atom) bond and the like are preferable, and a tin (II) compound having an Sn—O bond is more preferable.

Examples of the tin (II) compound having an Sn—O bond include tin (II) carboxylate containing a carboxylic group having 2 to 28 carbon atoms such as tin (II) oxalate, tin (II) diacetate, tin (II) dioctanoate, tin(II) dilaurate, tin(II) distearate, and tin(II) dioleate; dialkoxy tin (II) containing an alkoxy group having 2 to 28 carbon atoms such as dioctyloxy tin (II), dilauroxy tin (II), distearoxy tin (II), and dioleyloxy tin (II); and tin (II) oxides; and tin (II) sulfates.

Examples of the tin (II) compound having an Sn—X (X indicates a halogen atom) bond include tin (II) halides such as tin (II) chloride, and tin (II) bromide. Of these, in terms of advantageous effect of charge start-up and catalytic capability, aliphatic tin (II) represented by $(R^1COO)_2Sn$ ($R^1$ represents an alkyl group or an alkenyl group having 5 to 19 carbon atoms), dialkoxy tin (II) represented by $(R^2O)_2Sn$ ($R^2$ represents an alkyl group or an alkenyl group having 6 to 20 carbon atoms), and tin (II) oxide represented by SnO are preferable; aliphatic tin (II) represented by $(R^1COO)_2Sn$ and tin (II) oxide are more preferable; and tin (II) dioctanoate, tin(II) distearate, and tin(II) oxide are especially preferable.

The existing amount of the tin (II) compound having no Sn—C bond to 100 parts by mass of the total amount of the alcohol component and the carboxylic acid component is preferably 0.01 parts by mass to 1.0 part by mass, and more preferably 0.1 parts by mass to 0.7 parts by mass.

When the titanium compound is used in combination with the tin(II) compound having no Sn—C bond, the total existing amount of the titanium compound and the tin (II) compound to 100 parts by mass of the total amount of the alcohol component and the carboxylic acid component is preferably 0.01 parts by mass to 1.0 part by mass, and more preferably 0.1 parts by mass to 0.7 parts by mass.

A condensation polymerization reaction between the alcohol component and the carboxylic acid component can be carried out, for example, in the presence of the esterified catalyst under an inert gas atmosphere at a temperature of 180° C. to 250° C. The softening point of the polyester resins can be adjusted depending on reaction time.

The glass transition temperature of the polyester resins (A) and (B) is preferably 45° C. to 75° C., more preferably 50° C. to 70° C., and still more preferably 50° C. to 65° C. from the perspective of fixing property, storage stability and durability. The acid value thereof is preferably 1 mgKOH/g to 80 mgKOH/g, and more preferably 10 mgKOH/g to 50 mgKOH/g from the perspective of chargeability and environment safety.

In the present invention, it is preferable that the polyester resins (A) and (B) be amorphous polyesters, which differ from crystalline polyesters. In the present invention, the words "amorphous polyester" mean a polyester having a difference in temperature of 30° C. or more between the softening point and the glass transition temperature (Tg).

The polyester resins (A) and (B) may also be modified polyester resins. The modified polyester resin means a polyester resin grafted or blocked with phenol, urethane or the like.

In the binder resin, conventional binder resins, for example, vinyl resin such as styrene-acrylic resin, and other resins such as epoxy resin, polycarbonate, and polyurethane, may be used in combination within the range where the effects of the present invention are not impaired, however, the total content of the polyester resins (A) and (B) in the binder resin is preferably 70% by mass or more, more preferably 80% by mass or more, and still more preferably 90% by mass or more.

—Composite Resin (C)—

The composite resin (C) is a resin in which a condensation polymerization monomer and an addition polymerization monomer are chemically bonded to each other (may be referred to as a hybrid resin). In other words, the composite resin (C) has a condensation polymerization resin unit and an addition polymerization resin unit.

The composite resin (C) can be obtained by subjecting a mixture containing raw materials of a condensation polymerization monomer and an addition polymerization monomer to a condensation polymerization reaction and an addition polymerization reaction in a same reaction vessel in parallel, or by carrying out a condensation polymerization reaction and an addition polymerization reaction in this order or in reverse order.

The use of the composite resin (C) in combination with the polyester resins (A) and (B) serves to keep the excellent fixing and releasing properties and mechanical strength of toner. The polyester resins (A) and (B) respectively have excellent low-temperature property and anti-offset property, however, are poor in mechanical strength because each of them is substantially composed of only aliphatic alcohol. In addition, the polyester resins (A) and (B) allow for uniformly dispersing releasing agents, but releasing agents are easily soluble therein, and therefore, the used releasing agents are less prone to phase separation on a toner surface layer at the time of fixing a toner image. Therefore, these polyester resins may exhibit unsatisfactory fixing and releasing properties. The composite resin (C) can moderately prevent the solubility between the polyester resins (A) and (B) and releasing agents, exhibit excellent fixing and releasing properties, and can impart mechanical strength to the toner, without impairing low-temperature fixing property and heat resistance-storage stability of the toner. The composite resin (C) can obtain the above-mentioned effects only after it is used in combination with the polyester resins (A) and (B).

Examples of the condensation polymerization monomer to be used in the composite resin (C) include a polyhydric alcohol and a polyhydric carboxylic acid forming a polyester resin unit; a polyhydric carboxylic acid and an amine or an amino acid forming a polyamide resin unit or a polyester-polyamide resin unit.

Examples of divalent alcohol components include 1,2-propanediol, 1,3-propanediol, ethylene glycol, propylene glycol, 1,3-butandiol, 1,4-butandiol, 2,3-butandiol, diethylene glycol, triethylene glycol, 1,5-pentanediol, 1,6-hexanediol, neopentylglycol, 2-ethyl-1,3-hexanediol, hydrogenated bisphenol A or diol obtained by polymerizing a cyclic ether such as ethylene oxide or propylene oxide with bisphenol A.

Examples of trivalent or higher polyhydric alcohols include sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Of these, hydrogenated bisphenol A or alcohol components having bisphenol A skeleton such as diol obtained by polymerizing a cyclic ether such as ethylene oxide or propylene oxide with bisphenol A can be preferably used because they can impart heat resistance-storage stability and mechanical strength to resins.

Examples of the carboxylic acid components include benzene dicarboxylic acids such as phthalic acid, isophthalic acid, and terephthalic acid or anhydrides thereof; alkyl dicarboxylic acids such as succinic acid, adipic acid, sebacic acid, and azelaic acid or anhydrides thereof; unsaturated dibasic acids such as maleic acid, citraconic acid, itaconic acid, alkenylsuccinic acid, fumaric acid, and mesaconic acid; and unsaturated dibasic acid anhydrides such as maleic anhydrides, citraconic anhydrides, itaconic anhydrides, and alkenylsuccinic anhydrides.

Examples of trivalent or higher polyhydric carboxylic acid components include trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxy propane, tetra(methylenecarboxy)methane, 1,2,7,8-octane tetracarboxylic acid, EnPol trimer acid, and their anhydrides and partial lower alkyl esters.

Of these, aromatic polyhydric carboxylic acid components such as phthalic acid, isophthalic acid, terephthalic acid, and trimellitic acid are preferably used from the perspective of heat resistance-storage stability and mechanical strength of resins.

Examples of the amine components and amino acid components include diamines (B1), trivalent or higher polyamines (B2), aminoalcohols (B3), aminomercaptanes (B4), amino acids (B5), and amines (B6) obtained by blocking the amino group of B1 to B5.

Examples of the diamines (B1) include aromatic diamines (phenylenediamine, diethyltoluene diamine, 4,4'-diaminodiphenylmethane, etc.); alicyclic diamines (4,4'-diamino-3,3'-dimethyldicyclohexylmethane, diaminocyclohexane, isophoronediamine, etc.); and aliphatic diamines (ethylenediamine, tetramethylenediamine, hexamethylenediamine, etc.).

Examples of the trivalent or higher polyamines (B2) include diethylenetriamine, and triethylenetetramine.

Examples of the aminoalcohols (B3) include ethanolamine, and hydroxyethylaniline.

Examples of the aminomercaptanes (B4) include aminoethyl mercaptane, and aminopropyl mercaptane.

Examples of the amino acids (B5) include amino propionic acid, amino caproic acid, and ϵ-caprolactam.

Examples of the amines (B6) obtained by blocking the amino group of B1 to B5 include ketimine compounds obtained from the amines of (B1) to (B5) and ketones (acetone, methylethylketone, methylisobutylketone, etc.) and oxazolidine compounds.

The molar ratio of the condensation polymerization monomer component in the composite resin (C) is preferably 5 mole % to 40 mole %, and more preferably 10 mole % to 25 mole %. When the molar ratio is less than 5 mole %, the dispersibility of the composite resin (C) in the polyester resins degrades, and when more than 50 mole %, the dispersibility of used releasing agents tends to degrade.

When the condensation polymerization reaction is carried out, an esterified catalyst etc. may be used, and all catalysts as mentioned above may be used.

The addition polymerization monomer to be used in the composite resin (C) is not particularly limited and may be suitably selected in accordance with the intended use, however, a vinyl monomer is typically used. Examples of the vinyl monomer include styrene vinyl monomers such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorstyrene, 3,4-dichlorostyrene, m-nitrostyrene, o-nitrostyrene, and p-nitrostyrene; acrylate vinyl monomers such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chlorethyl acrylate, and phenyl acrylate; methacrylate vinyl monomers such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate; and other vinyl monomers or other monomers forming a copolymer.

Examples of the above-mentioned other vinyl monomers or other monomers forming a copolymer include monoolefins such as ethylene, propylene, butylene, and isobutylene; polyenes such as butadiene, and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrrole, N-vinyl carbazole, N-vinyl indole, and N-vinyl pyrrolidone; vinyl naphthalines; acrylic acid or methacrylic acid derivatives such as acrylonitrile, methacrylonitrile, and acrylamide; unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; monoesters of unsaturated dibasic acids such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenylsuccinic acid monoethyl ester, fumaric acid monomethyl ester, and mesaconic acid monomethyl ester; unsaturated dibasic acid esters such as dimethyl maleic acid, and dimethyl fumaric acid; α,β-unsaturated acids such as crotonic acid, and cinnamic acid; α,β-unsaturated acid anhydrides such as crotonic acid anhydride, and cinnamic acid anhydride; monomers containing carboxyl group such as an anhydride between the α,β-unsaturated acid and a lower fatty acid, alkenyl malonic acid, alkenyl glutaric acid, alkenyl adipic acid, acid anhydrides thereof or monoesters thereof; acrylic or methacrylic acid hydroxyalkyl esters such as 2-hydroxyethyl acrylate, 2-hydroxyethyl methacrylate, and 2-hydroxypropyl methacrylate; and monomers containing hydroxy group such as 4-(1-hydroxy-1-methylbutyl)styrene, and 4-(1-hydroxy-1-methylhexyl)styrene.

Of these vinyl monomers, styrene, acrylic acid, n-butyl acrylate, 2-ethylhexyl acrylate, methacrylic acid, n-butyl methacrylate, 2-ethylhexyl methacrylate, etc. are preferably used. It is particularly preferable to use at least styrene and an acrylic acid in combination because the use of the combination allows for extremely improving the dispersibility of releasing agents.

Further, a crosslinker for the addition polymerization monomer can be added in accordance with the necessity. For the crosslinker, for example, as an aromatic divinyl compound, divinyl benzene, divinyl naphthalene etc. are exemplified.

As diacrylate compounds bonded with an alkyl chain, for example, ethylene glycol diacrylate, 1,3-butylene glycol diacrylate, 1,4-butadiol diacrylate, 1,5-pentandiol diacrylate, 1,6-hexanediol diacrylate, neopentyl glycol diacrylate, and diacrylate compounds in which the acrylate of these compounds is substituted with methacrylate etc. are exemplified.

As diacrylate compounds bonded with an alkyl chain containing an ether bond, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and diacrylate compounds in which the acrylate of these compounds is substituted with methacrylate etc. are exemplified. Besides the above-mentioned diacrylate compounds, diacrylate compounds and dimethacrylate compounds each bonded with a chain containing an aromatic group and an ether bond are exemplified. As polyester diacrylates, for example, trade name MANDA (manufactured by NIPPON KAYAKU CO., LTD.) is exemplified. For polyfunctional crosslinkers, pentaerythritol triacrylate, trimethylolethane triacrylate, trimethylolpropane triacrylate, tetramethylolethane tetraacrylate, oligoester acrylate; polyfunctional crosslinkers in which the acrylate in the above-mentioned compounds is substituted with methacrylate; triallyl cyanurate, and triallyl trimeritate are exemplified.

The additive amount of the crosslinker to 100 parts by mass of the used addition polymerization monomer is preferably 0.01 parts by mass to 10 parts by mass, and more preferably 0.03 parts by mass to 5 parts by mass.

A polymerization initiator to be used when the above-mentioned addition polymerization monomer is polymerized is not particularly limited and may be suitably selected in accordance with the intended use. Examples thereof include azo polymerization initiators such as 2,2'-azobis-isobutylonitrile, 2,2'-azobis(4-methoxy-2,4-dimethylvaleronitrile), and 2,2'-azobis(2,4-dimethylvaleronitrile); and peroxide polymerization initiators such as methylethylketone peroxide, acetyl acetone peroxide, 2,2-bis(tert-butylperoxy)butane, tert-butylhydro peroxide, benzoyl peroxide, and n-butyl-4,4-di-(tert-butylperoxy)valerate. Two or more of these polymerization initiators may be mixed for use for the purpose of adjusting the molecular weight and molecular weight distribution of the resins.

The additive amount of the polymerization initiator to 100 parts by mass of the used addition polymerization monomer is preferably 0.01 parts by mass to 15 parts by mass, and more preferably 0.1 parts by mass to 10 parts by mass.

To chemically bond the condensation polymerization resin unit with the addition polymerization resin unit, for example, a reactive monomer for both the condensation polymerization and the addition polymerization is used. For such a bireactive monomer, for example, unsaturated carboxylic acids such as acrylic acid, and methacrylic acid; unsaturated dicarboxylic acids such as fumaric acid, maleic acid, citraconic acid, and itaconic acid or anhydrides thereof; and vinyl monomers containing a hydroxy group are exemplified.

The additive amount of the bireactive monomer to 100 parts by mass of the used addition polymerization monomer is 1 part by mass to 25 parts by mass, and more preferably 2 parts by mass to 20 parts by mass.

The composite resin (C) allows for promotion and/or completion of both of the condensation polymerization reaction and the addition polymerization reaction at the same time, provided that these reactions are carried out in a same reaction vessel, and also allows for independently completing the promotion of each of the reactions in a same vessel by adjusting respective reaction temperatures and reaction times for the condensation reaction and the addition polymerization reaction. For example, there is a method in which in a reaction vessel, a mixture composed of an addition polymerization monomer and a polymerization initiator is delivered by drops into a mixture composed of a condensation polymerization monomer to mix the mixtures, first an addition polymerization is completed by a radical polymerization reaction, and then the reaction mixture is subjected to a condensation polymerization reaction by raising the reaction temperature. As described above, two types of resin units can be efficiently dispersed and bonded to each other by promoting two independent reactions in a same reaction vessel.

Further, for preferred conditions for satisfying low-temperature fixing property, anti-hot offset property and heat-resistance-storage stability as well as optimally dispersing the used releasing agent, the molar ratio [(C)/((A)+(B))] of the composite resin (C) to the polyester resins (A) and (B) is preferably 3/97 to 20/80, more preferably 5/95 to 15/85, and still more preferably 8/92 to 13/87.

The softening point Tm (C) of the composite resin (C) is preferably 90° C. to 130° C., and more preferably 100° C. to 120° C. When the softening point Tm (C) is lower than 90° C., the heat resistance-storage stability and the anti-offset property of the toner may possibly degrade, and when higher than 130° C., the low-temperature fixing property may possibly degrade. The glass transition temperature of the composite resin (C) is preferably 45° C. to 80° C., more preferably 50° C. to 70° C., and still more preferably 53° C. to 65° C. from the perspective of fixing property, storage stability, and durability. The acid value of the composite resin (C) is preferably 5 mgKOH/g to 80 mgKOH/g, and more preferably 15 mgKOH/g to 40 mgKOH/g from the perspective of chargeability and environment safety.

—Releasing Agent—

The releasing agent is not particularly limited and may be suitably selected from among those known in the art in accordance with the intended use, however, wax is preferable. Examples of the wax include aliphatic hydrocarbon waxes such as low-molecular weight polyethylene, low-molecular weight polypropylene, polyolefin wax, microcrystalline wax, paraffin wax, and sazole wax; oxides of aliphatic hydrocarbon waxes such as polyethylene oxide wax or block copolymers thereof; vegetable waxes such as candelilla wax, carnauba wax, Japan tallow, and jojoba wax; animal waxes such as beeswax, lanolin and spermaceti; mineral waxes such as ozokerite, ceresin, and petrolatum; waxes containing aliphatic ester as main component such as montanoic acid ester wax, and caster wax; and waxes such as deoxidized carnauba wax in which the aliphatic ester is partly or fully deoxidized.

Examples of the releasing agent further include unsaturated straight-chain fatty acids such as pulmitic acid, stearic acid, montanoic acid, and straight chain alkyl carboxylic acids containing a straight chain alkyl group; unsaturated fatty acids such as brassidic acid, eleostearic acid, and varinaline acid; saturated alcohols such as stearyl alcohol, eicosyl alcohol, behenyl alcohol, carnaubyl alcohol, ceryl alcohol, melissyl alcohol; polyhydric alcohols such as sorbitol; fatty acid amides such as linoleic acid amide, oleic acid amide, and lauric acid amide; saturated fatty acid bisamides such as methylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyl adipic acid amide, and N,N'-oleyl sebacic acid amide; aromatic bisamides such as m-xylene bis-stearic acid amide, and N,N'-distearyl isophthalic acid amide; metal salts of fatty acids, such as calcium stearate, calcium laurate, zinc stearate, and magnesium stearate; waxes prepared by grafting a vinyl monomer such as styrene or acrylic acid to an aliphatic hydrocarbon series wax; partial ester compounds between a fatty acid such as behenic acid monoglyceride and a polyhydric alcohol; and methyl ester compounds containing a hydroxyl group, which are obtained by hydrogenizing a plant oil and fat.

Further, the following are exemplified as such: polyolefin obtained by subjecting an olefin to radical polymerization under a high pressure, polyolefin prepared by purifying a low-molecular weight byproduct obtained at the time of polymerizing a high-molecular weight polyolefin, polyolefin polymerized using a catalyst like Ziegler catalyst and metallocene catalyst under a low pressure, polyolefin polymerized utilizing radiation, electromagnetic wave or light, low-molecular weight polyolefin obtained by thermally decomposing a high-molecular weight polyolefin, paraffin wax, microcrystalline wax, Fisher Tropshe wax, synthetic hydrocarbon series wax synthesized by Synthol method, hydrocol method, or Arge method, synthetic wax prepared by using a compound having one carbon atom as monomer, hydrocarbon series wax having a functional group such as hydroxyl group or carboxyl group, a mixture between a hydrocarbon series wax and a hydrocarbon series wax having a functional group, and graft modified wax grafted with a vinyl monomer such as styrene, maleate, acrylate, methacrylate, or maleic anhydride using each of the above-mentioned waxes as a base.

Furthermore, wax whose molecular weight distribution is made sharp by the press sweating method, solvent method, recrystallization method, vacuum distillation method, supercritical gas extraction method or solution crystallization method; and those where low-molecular weight solid aliphatic acid, low-molecular weight solid alcohol, low-molecular weight solid compound and impurities are removed are preferably used.

Particularly when a toner produced by pulverization is used, the toner is easily pulverized at the interface between a binder resin and a releasing agent used in the toner, and therefore, there is a problem that the releasing agent oozes out onto the toner surface, causing toner-filming on a photoconductor and a carrier used in the image formation process. However, the binder resin used in the present invention is extremely excellent in dispersibility of releasing agents, and the releasing agent is hardly exfoliated from the toner by the solubility of the binder resin in the releasing agent. For this reason, the toner of the present invention cause extremely less occurrence of toner-filming as compared to conventional toners. Among the above-mentioned releasing agents, carnauba waxes are more preferable because they show the most preferred dispersibility for the binder resin to be used in the present invention. Among the carnauba waxes, free fatty acid-removed-type carnauba wax is particularly preferable.

The melting point of the releasing agent is preferably 60° C. to 120° C., and more preferably 70° C. to 110° C. in order to keep the fixing property and anti-offset property in balance. When the melting point of the releasing agent is lower than 60° C., the anti-blocking property may possibly degrade, and when higher than 120° C., the anti-offset property may be hardly exhibited.

Further, the use of two or more different releasing agents in combination makes it possible to exhibit a plasticization effect and a releasing effect in parallel, which are effects of releasing agents. For releasing agents having a plasticization effect, for example, a releasing agent having a low melting point, a releasing agent whose molecules have a branched structure, and a releasing agent having a structure containing a polar group are exemplified. For releasing agents having a releasing effect, releasing agents having a high-melting point are exemplified. For the molecular structure thereof, those having a straight chain structure, and those of non-polar type having no functional group are exemplified. For the use example, a combination of two or more different releasing agents having a different melting point, the difference of which is 10° C. to 100° C., and a combination between a polyolefin and a graft-modified polyolefin are exemplified.

When two types of releasing agents having a similar structure are selected, a releasing agent having a relatively low melting point exerts a plasticization effect and a releasing agent having a relatively high melting point exerts a releasing effect. In this case, when the difference in melting point is 10° C. to 100° C., the functional separation is effectively exhibited. When the difference in melting point is less than 10° C., the functional separate may be hardly exhibited, and when the difference in melting point is more than 100° C., the functions by interaction therebetween may be rarely emphasized. In this case, the melting point of at least one releasing agent is preferably 60° C. to 1200, and more preferably 70° C. to 110° C. because the functional separation effect tends to be easily exhibited.

For the releasing agents, relatively, a releasing agent having a branched structure, a releasing agent having a polar group like functional group or a releasing agent modified by a different component from the main component exhibits a plasticization effect, and a releasing agent having a straight chain structure, a releasing agent of non-polar type having no functional group or an unmodified releasing agent exhibits a releasing effect. Examples of preferred combinations include a combination of a polyethylene homopolymer or a copolymer containing ethylene as the main component with a polyolefin homopolymer or a copolymer containing olefin other than ethylene as the main component; a combination of a polyolefin with a graft-modified polyolefin; a combination of an alcohol wax, an aliphatic wax or an ester wax and a hydrocarbon series wax; a combination of a Fisher Tropshe wax or a polyolefin wax with a paraffin wax or a microcrystal wax; a combination of a Fisher Tropshe wax with a polyolefin wax; a combination of a paraffin wax with a microcrystal wax; and a combination of a carnauba wax, a candelilla wax, a rise wax or a montan wax, and a hydrocarbon series wax.

In any of the above combinations, from the perspective that the storage stability and the fixing property of toner are easily kept in balance, in endothermic peaks observed in DSC measurement of toner, the toner preferably has a peak top temperature of the maximum peak in the range of 60° C. to 120° C., and more preferably has the maximum peak in the range of 70° C. to 110° C. In the present invention, a peak top temperature of the maximum peak of endothermic peaks of a releasing agent (wax) measured by DSC is to be the melting point of the releasing agent.

In the present invention, as DSC measurement device for the releasing agent or toner, differential scanning calorimeters (TA-60WS and DSC-60, manufactured by Shimazu Corporation) were used and a maximum endothermic peak was determined from a DSC curve obtained by the measurement. The measurement test was conducted according to ASTM D3418-82. For the DSC curve used in the present invention, a DSC curve is used which is measured when the temperature of a releasing agent is once raised and then decreased to previously maintain the history records, subsequently, the temperature of the releasing agent is raised at a temperature increasing rate of 10° C./min.

The mass ratio [(releasing agent/binder resin)×100] of the releasing agent to the binder resin is preferably 1% by mass to 20% by mass, and more preferably 3% by mass to 15% by mass. Within the range of the mass ratio, the releasing agent has excellent dispersibility in the toner and can exert extremely excellent fixing and releasing properties.

—Colorant—

The colorant is not particularly limited and may be suitably selected from among conventional dyes and pigments in accordance with the intended use. Examples thereof include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These colorants may be used alone or in combination of two or more.

Color of the colorant is not particularly limited and may be suitably selected in accordance with the intended use. For example, black colorants and color colorants are exemplified. These colorants may be used alone or in combination of two or more.

Examples of colorants for black ink include carbon black (C.I. Pigment Black 7) colorants such as furnace black, lamp black, acetylene black, and channel black; metal powders such as copper, iron (C.I. Pigment Black 11), and titanium oxide; and organic pigments such as aniline black (C.I. Pigment Black 1).

Examples of colorants for magenta ink include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I. Vat 1, 2, 10, 13, 15, 23, 29, and 35.

Example of colorants for cyan ink include C.I. Pigment Blue 2, 3, 15, 15:1, 15:2, 15:3, 15:4, 15:6, 16, 17, 60; C.I. Vat Blue 6; C.I. Acid Blue 45 or copper phthalocyanine pigment in which phthalocyanine skeleton is substituted with one to five phthalimidemethyl groups, C.I. Pigment Green 7 and Green 36.

Examples of colorants for yellow ink include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, 3, and 20; and C.I. Pigment Orange 36.

The content of the colorant in the toner is not particularly limited and may be suitably selected in accordance with the intended use, however, it is preferably 1% by mass to 15% by mass, and more preferably 3% by mass to 10% by mass. When the content of the colorant is less than 1% by mass, a reduction of tinting strength is observed, and when more than 15% by mass, a dispersion defect of the pigment may take place in the toner to cause a reduction of tinting strength and a reduction of electrical properties of the toner.

The colorant may be used as a masterbatch obtained by combining the colorant and a resin. The resin is not particularly limited and may be suitably selected from among those know in the art in accordance with the intended use. Examples of the binder resin include polymers of styrene or substituted styrene, styrene-based copolymers, polymethyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylate resins, rosins, modified rosins, terpene resins, aliphatic hydrocarbon resin, alicyclic hydrocarbon resins, aromatic series petroleum resins, chlorinated paraffins, and paraffins. These binder resins may be used alone or in combination of two or more.

Examples of the polymers of styrene or substituted styrene include polyester resins, polystyrene resins, poly-(p-chlorostyrene) resins, and polyvinyl toluene resins. Examples of the styrene-based copolymers include styrene-p-chlorostyrene copolymers, styrene-propylene copolymers, styrene-vinyltoluene copolymers, styrene-vinylnaphthaline copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinylmethylethylketone copolymers, styrene-butadiene copolymers, styrene-isoprene copolymers, styrene-acrylonitrile-indene copolymers, styrene-maleic acid copolymers, and styrene-maleate copolymers.

The masterbatch may be obtained by mixing and kneading the resin for masterbatch and the colorant under the application of high shear force. At this time, it is preferable to use an organic solvent to enhance the interaction between the colorant and the resin. A so-called flashing method, where aqueous paste containing colorant water is mixed and kneaded with a resin and an organic solvent to transfer the colorant to the resin, and water content and organic solvent component are removed, may also be preferably used because wet cake of the colorant may be directly used without drying the cake. For the mixing and kneading, a high-shearing dispersion apparatus such as a triple roll mill is preferably used.

—Charge Controlling Agent—

The toner of the present invention may further contain a charge controlling agent for controlling the charged amount of a toner. The charge controlling agent is not particularly limited and may be suitably selected from among those known in the art in accordance with the intended use. However, when a colored material is used, the color tone may be changed. Therefore, a colorless or near white material is preferable. Examples of such a charge controlling agent include triphenylmethane dyes, molybdic acid chelate pigments, Rhodamine series dyes, alkoxy-based amines, quaternary ammonium salts (including fluorine-modified quaternary ammonium salts), alkylamide, single substance or compounds of phosphorus, single substance or compounds of tungsten, fluorine-based active agents, metal salicylates, and metal salts of salicylic acid derivatives. These charge controlling agents may be used alone or in combination of two or more.

For the charge controlling agent, a commercially available product may be used. Examples thereof include BONTRON P-51 (quaternary ammonium salt), BONTRON E-82 (oxynaphthoic acid metal complex), E-84 (salicylic acid metal complex), and E-89 (phenolic condensation product), which are manufactured by Orient Chemical Industries, Ltd.; TP-302 and TP415 (quaternary ammonium salt molybdenum complex), which are manufactured by Hodogaya Chemical Co., LTD.; COPY CHARGE PSY VP2038 (quaternary ammonium salt), COPY BLUE PR (triphenylmethane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; quinacridone, azo pigments; and polymer compounds having a functional group such as a sulfonate group, a carboxyl group, or a quaternary ammonium salt group.

The charge controlling agent may be melted and kneaded with the masterbatch and dissolved or dispersed therein or may be added when directly dissolved or dispersed in the organic solvent with each of the toner components or may be fixed on the surface of toner after toner particles are produced.

The content of the charge controlling agent in the toner varies depending on the type of the binder resin, presence or absence of additives, dispersing method, etc. and cannot be unequivocally defined, however, for example, to 100 parts by mass of the binder resin, it is preferably 0.1 parts by mass to 10 parts by mass, and more preferably 0.2 parts by mass to 5 parts by mass. When the content of the charge controlling agent is less than 0.1 parts by mass, charge controlling property may not be obtained, and when more than 10 parts by mass, the chargeability of the toner is excessively increased to reduce the effect of the main charge controlling agent, and the electrostatic attraction force to the developing roller increased, which may cause a reduction in flowability of the developer and/or a reduction in image density.

—External Additives—

The external additive is not particularly limited and may be suitably selected from among those known in the art in accordance with the intended use. Preferred examples thereof include silica fine particles, hydrophobized silica fine particles, aliphatic metal salts (such as zinc stearate, and aluminum stearate); metal oxides (such as titania, alumina, tin oxide, and antimony oxide) or hydrophobized products thereof, and fluoropolymers. Of these, hydrophobized silica fine particles, titania particles, and hydrophobized titania fine particles are preferably exemplified.

Specific examples of the silica fine particles include HDK H 2000, HDK H 2000/4, HDK H 2050EP, HVK21, and HDK H 1301 (all manufactured by Hoechst AG); and R972, R974, RX200, RY200, R202, R805, and R812 (all manufactured by Japan AEROSIL Inc.). Specific examples of the titania fine particles include P-25 (manufactured by Japan AEROSIL Inc.); STT-30, and STT-65C-S (both manufactured by Titanium Kogyo K.K.); TAF-140 (manufactured by Fuji Titanium Kogyo K.K.); and MT-150W, MT-500B, MT-600B, and MT-150A (all manufactured by Teika Co., Ltd.). Specific examples of the hydrophobized titanium oxide fine particles include T-805 (manufactured by Japan AEROSIL Inc.); STT-30A, and STT-65S—S (both manufactured by Titanium Kogyo K.K.); TAF-500T, and TAF-1500T (both manufactured by Fuji Titanium Kogyo K.K.); MT-100S and MT-100T (both manufactured by Teika Co., Ltd.); and IT-S (manufactured by Ishihara Sangyo Kaisha Ltd.).

The hydrophobized silica fine particle, hydrophobized titania fine particle and hydrophobized alumina fine particle can be obtained by hydrophobizing a hydrophilic fine particle with a silane coupling agent such as methyl trimethoxy silane, methyl triethoxy silane, and octyl trimethoxy silane.

Examples of the hydrophobizing agent include silane coupling agents such as dialkyl halogenated silane, trialkyl halogenated silane, alkyl tri-halogenated silane, hexamethyldisilazane, silylation agents, silane coupling agents having an alkyl fluoride group, organic titanate coupling agents, aluminum-based coupling agents, silicone oils, and silicone varnishes.

Further, a silicone oil-treated inorganic fine particle in which a silicone oil is added to an inorganic fine particle under application of heat if necessary, is also preferably used.

Examples of the inorganic fine particle include silica, alumina, titanium oxide, barium titanate, magnesium titanate, calcium titanate, strontium titanate, iron oxide, copper oxide, zinc oxide, tin oxide, silica sand, clay, mica, wollastonite, silious earth, chrome oxide, cerium oxide, red iron oxide, antimony trioxide, magnesium oxide, zirconium oxide, barium sulfate, barium carbonate, calcium carbonate, silicon carbide, and silicon nitride. Of these, silica, and titanium dioxide are particularly preferable.

Examples of the silicone oil include dimethyl silicone oil, methylphenyl silicone oil, chlorphenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercaptane-modified silicone oil, acryl or methacryl-modified silicone oil, and α-methylstyrene-modified silicone oil.

The average particle diameter of primary particle of the inorganic fine particle is preferably 1 nm to 100 nm, and more preferably 3 nm to 70 nm. When the average particle diameter is smaller than 1 nm, the inorganic fine particle is buried in the toner and it may be difficult that the function is effectively exerted, and when the average particle diameter is larger than 100 nm, it may unevenly damage the surface of a latent electrostatic image bearing member used in the image formation process. For the external additives, the inorganic fine particle and a hydrophobized inorganic fine particle may be used in combination, however, the average particle diameter of the primary particle that has been hydrophobized is preferably 1 nm to 100 nm, and more preferably 5 nm to 70 nm. Further, it is more preferable that at least two inorganic fine particles having an average particle diameter of their hydrophobized primary particles of 20 nm or less be contained and at least one inorganic fine particle having an average particle diameter of the hydrophobized primary particle of 30 nm or more be contained. The specific surface of the inorganic fine particles measured by BET method is preferably 20 $m^2/g$ to 500 $m^2/g$.

The additive amount of the external additives to the toner is preferably 0.1% by mass to 5% by mass, and more preferably 0.3% by mass to 3% by mass.

As the external additives, a resin fine particle can be also added. Examples of the resin fine particle include polystyrenes obtained by soap-free emulsification polymerization, suspension polymerization, or dispersion polymerization; copolymers of methacrylic ester or acrylic ester; particles produced by condensation polymerization such as silicone, benzoguanamine, and nylon; and polymer particles produced using a thermosetting resin. By using such a resin fine particle in combination, it is possible to reinforce the chargeability of the toner, reduce the amount of reversely charged toner and to reduce the occurrence of background smear. The additive amount of the resin fine particle to the toner is preferably 0.01% by mass to 5% by mass, and more preferably 0.1% by mass to 2% by mass.

—Other Components—

The above-mentioned other components are not particularly limited and may be suitably selected in accordance with the intended use. For example, flowability improver, cleaning property improver, magnetic material, and metal soap are exemplified.

The flowability improver is used in performing a surface treatment to increase hydrophobicity of toner and is capable of preventing degradation of flowability property and charging property even under high-humidity conditions. Examples of the flowability improver include silane coupling agents, silylation agents, silane coupling agents having a fluoride alkyl group, organic titanate coupling agents, aluminum coupling agents, silicone oils, and modified silicone oils.

The cleaning property improver is added to the toner for removing a residual developer remaining on the latent electrostatic image bearing member and the intermediate transfer member after an image transfer. Examples thereof include aliphatic metal salts such as zinc stearate, calcium stearate, and stearic acid; and polymer fine particles produced by soap-free emulsification polymerization such as polymethyl methacrylate fine particle, and polystyrene fine particle. For the polymer fine particle, a particle having a relatively narrow particle size distribution is preferable, which has a volume average particle diameter of 0.01 μm to 1 μm.

The magnetic material is not particularly limited and may be suitably selected from among those known in the art in accordance with the intended use. For example, iron powder, magnetite, and ferrite are exemplified. Of these magnetic materials, white materials are preferable in terms of color tone.

—Toner Production Method—

The toner production method is not particularly limited and may be suitably selected from among conventionally know toner production methods in accordance with the intended use. Examples thereof include kneading-pulverizing method, polymerization method, dissolution-suspension method, and spray granulation method. Of these, kneading-pulverizing method is particularly preferable from the perspective of dispersibility of releasing agents and colorants and productivity of toner.

—Kneading-Pulverizing Method—

The kneading-pulverizing method is a method in which for example, toner materials containing at least a binder resin, a releasing agent, and a colorant is melted and kneaded, and the obtained kneaded product is pulverized and classified to thereby produce a toner base particle for the toner.

In the melting and kneading, the toner materials are mixed, and the mixture is placed in a melt-kneader to melt and knead the mixture. For the melt-kneader, for example, a uniaxial or biaxial continuous kneader or a batch type kneader with a roll mill can be used. For example, a KTK type biaxial extruder manufactured by Kobe Steel, Ltd., a TEM type biaxial extruder manufactured by Toshiba Machine Co., Ltd, a biaxial extruder manufactured by KCK, a PCM type biaxial extruder manufactured by Ikegai Co. Ltd., a Ko-kneader manufactured by Bus etc. are preferably used. The melting and kneading are preferably carried out under such appropriate conditions that do not cause cutting-off of molecular chains of the binder resin. Specifically, the melting and kneading temperature is selected in reference to the softening point of the binder resin. When the melting and kneading temperature is excessively higher than the softening point of the binder resin, molecular chains of the binder resin are severely broken, and when excessively lower then the softening point, the dispersion may not proceed.

In the pulverization, the kneaded product obtained in the kneading is pulverized. In this pulverization, it is preferable that first the kneaded product be coarsely crushed and then finely pulverized. In this process, the kneaded toner product is preferably pulverized by hitting the kneaded toner constituents against a collision board in a jet air stream or by colliding the particles with each other, or by passing through a narrow gap between a rotor which mechanically revolves and a stator.

In the classification, the pulverized product obtained in the pulverization is classified to prepare particles so as to have a predetermined particle diameter. The classification of toner particles can be performed by removing fine particles, for example, by a cyclone, a decanter, a centrifugal separator or the like.

After completion of the pulverization and the classification, the pulverized product is classified in an air stream using a centrifugal force, thereby producing a toner base particle having a predetermined particle diameter.

Next, external additives are externally added to the toner base particle. By mixing and stirring the toner base particle and the external additive using a mixer, the toner base particle surface is coated with the external additives while being fused. In this process, it is important, in terms of durability, to make external additives such as inorganic fine particle and resin fine particle uniformly and solidly adhere on the surface of the toner base particles.

—Toner Production Method by Polymerization—

As for the toner production method by polymerization, for example, a method is exemplified in which toner materials containing at least a modified polyester resin capable of forming a urea or urethane bond, a releasing agent and a colorant is dissolved or dispersed in an organic solvent, the solution or dispersion is dispersed in an aqueous medium to subject it to a polyaddition reaction, the solvent in the dispersion is removed, and the resultant product is washed to thereby obtain a toner.

Examples of the polyester resin capable of forming a urea or urethane bond include a polyester prepolymer having an isocyanate group obtained by reacting a carboxyl group or hydroxyl group at the end of polyester with a polyvalent isocyanate compound (PIC). Then, a modified polyester resin obtained by reacting the polyester prepolymer with an amine or the like to crosslink and/or elongate the molecule chains can improve anti-hot-offset property with keeping the low-temperature fixing property of toner.

Examples of the polyvalent isocyanate compound (PIC) include aliphatic polyvalent isocyanate (such as tetramethylen diisocyanate, hexamethylen diisocyanate, and 2,6-diisocyanate methyl caproate); alicyclic polyisocyanate (such as isophorone diisocyanate, and cyclohexyl methane diisocyanate); aromatic diisocyanate (such as tolylene diisocyanate, and diphenylmethane diisocyanate); aromatic aliphatic diisocyanate (such as $\alpha,\alpha,\alpha',\alpha'$-tetramethyl xylylene diisocyanate); isocyanates; and a compound in which the above noted polyisocyanate is blocked with a phenol derivative, oxime, caprolactam, or the like. these polyvalent isocyanate compounds may be used alone or in combination of two or more.

The polyvalent isocyanate compound (PIC) is mixed such that the equivalent ratio ([NCO]/[OH]) of an isocyanate group [NCO] to a hydroxyl group [OH] of polyester having the isocyanate group is preferably from 5/1 to 1/1, more preferably from 4/1 to 1.2/1, and still more preferably from 2.5/1 to 1.5/1.

The number of isocyanate groups contained in one molecule in the polyester prepolymer (A) having the isocyanate group is preferably one or more, more preferably 1.5 to 3 on the average, and still more preferably 1.8 to 2.5 on the average.

Examples of the amine (B) to be reacted with the polyester prepolymer include divalent amine compounds (B1), trivalent or higher polyvalent amine compounds (B2), aminoalcohols (B3), aminomercaptanes (B4), amino acids (B5), and amines (b6) obtained by blocking the amino group of (B1) to (B5).

Examples of the divalent amine compound (B1) include diamines (such as phenylenediamine, diethyltoluenediamine, 4,4'-diaminodiphenylmethane); alicyclic diamines (such as 4,4'-diamino-3,3'-dimethyldicyclohexylmethane, diamine cyclohexane, and isophoronediamine); and aliphatic diamines (such as ethylenediamine, tetramethylene diamine, and hexamethylenediamine).

Examples of the trivalent or higher polyvalent amine compounds (B2) include diethylenetriamine, and triethylenetetramine.

Examples of the aminoalcohols (B3) include ethanolamine, and hydroxyethylaniline.

Examples of the aminomercaptanes (B4) include aminoethylmercaptane, and aminopropylmercaptane.

Examples of the amino acids (B5) include aminopropionic acid, and aminocaproic acid.

Examples of the amines obtained by blocking the amino group of B1 to B5 include ketimine compounds obtained from the amine of B1 to B5 and ketone (such as acetone, methylethylketone, and methylisobutylketone), and oxazolidine compounds. Of these amines (B), B1 and a mixture of B1 with a small amount of B2 is particularly preferable.

The amine (B) is mixed such that the equivalent ratio [NCO]/[NHx] of an isocyanate group [NCO] in the polyester prepolymer (A) having an isocyanate group to an amino group [NHx] in the amine (B) is preferably 1/2 to 2/1, more preferably 1.5/1 to 1/1.5, and still more preferably 1.2/1 to 1/1.2.

According to the toner production method by polymerization, it is possible to produce a toner having a small particle diameter and a spherical shape at low cost with less environmental impact.

The color of the toner is not particularly limited and may be suitably selected in accordance with the intended use, and at least one can be selected from black toner, cyan toner, magenta toner, and yellow toner. Each of these toners can be obtained by suitably selecting the colorant type from the above-mentioned colorants, and color toners are preferable.

The weight average particle diameter of the toner is not particularly limited and may be suitably adjusted in accordance with the intended use, however, to obtain high-quality images that are excellent in granularity, sharpness, and thin-line reproductivity, the weight average particle diameter is preferably 3 μm to 10 μm, and more preferably 4 μm to 7 μm. When the weight average particle diameter is smaller than 3 μm, the flowability and transferring property of the toner may possibly degrade, although toner images each excellent in image sharpness and thin-line reproductivity can be obtained.

The weight average particle diameter of the toner can be determined, for example, as follows.

Measurement device: COULTER MULTISIZER III (manufactured by Beckman Coulter, Inc.)

Aperture diameter: 100 μm

Analyzer software: BECKMAN COULTER MULTISIZER III Ver. 3.51 (manufactured by Beckman Coulter, Inc.)

Electrolyte: ISOTONE III (manufactured by Beckman Coulter, Inc.)

Dispersion liquid: 10% by mass surfactant (alkylbenzene sulfonate, NEOGEN SC-A, manufactured by DAI-ICHI KOGYO SEIYAKU CO., LTD.

Dispersion conditions: In 5 mL of the dispersion liquid, 10 mg of a measurement sample is added and dispersed using an ultrasonic dispersion device for one minute. Subsequently, 25 mL of the electrolyte is added thereto and further dispersed in the ultrasonic dispersion device for one minute.

Measurement conditions: in a beaker, 100 mL of the electrolyte and the resultant dispersion liquid are added, 30,000 particles are measured at a concentration where the particle diameter of 30,000 particles can be measured during 20 seconds, and the weight average particle diameter can be determined from the obtained particle diameter distribution.

(Developer)

The developer of the present invention contains at least the toner of the present invention and further contains suitably selected other components such as a carrier. The developer may be a one-component developer or may be a two-component developer, however, when the toner is to be used in a high-speed printer etc. capable of responding to recent high-speed processing of information, it is preferable to use the two-component developer in terms of lifetime extension When the one-component developer obtained using the toner is used, there is less variation in toner particle diameter even when toner inflow and outflow are performed, and even in the use of a developing unit for long hours i.e., even during a long-time agitation in a developing unit, it is possible to obtain images with highly stable developing property without substantially causing filming of the toner to a developing roller used as a developer bearing member as well as fusing of the toner to a layer thickness controlling member used for forming a thin layer of the toner, such as blade. When the two-component developer obtained using the toner is used, there is less variation in particle diameter of the toner contained in the developer even when toner inflow and outflow are performed, and it is possible to obtain highly stable developing property even during a long-time agitation in a developing unit.

—Carrier—

The carrier is not particularly limited and may be suitably selected in accordance with the intended use, however, the carrier preferably has a core material and a resin layer for coating the core material.

The material used as the core material is not particularly limited and may be suitably selected from among those known in the art. For example, 50 emu/g to 90 emu/g of manganese-strontium (Mn—Sr) materials and of manganese-magnesium (Mn—Mg) materials are preferable. In terms of ensuring high image density, ferromagnetic materials such as iron powder (100 emu/g or more), and magnetite (75 emu/g to 120 emu/g) are preferable. Further, in terms of capability of having a weak impact on a latent electrostatic image bearing member on which surface a toner is held vertically and the advantageousness of forming high-quality images, feebly magnetic materials such as copper-zinc (Cu—Zn) (30 emu/g to 80 emu/g) and the like are preferable. These materials may be used alone or in combination of two or more.

For the particle diameter of the core material, on the basis of the average particle diameter (volume average particle diameter ($D_{50}$)), it is preferably 10 μm to 200 μm, and more preferably 40 μm to 100 μm. When the average particle diameter (volume average particle diameter ($D_{50}$)) of the core material is smaller than 10 μm, in a carrier particle distribution, the amount of fine powder particles is increased, and the magnetization per one molecule is reduced, which may cause carrier scattering. When the volume average particle diameter ($D_{50}$) is larger than 200 μm, the specific surface is reduced, which may cause toner scattering, and in a full-color image with a large portion of solid parts, the reproductivity of the solid parts particularly may possibly degrade.

The material used for the resin layer is not particularly limited and may be suitably selected from among conventional resins in accordance with the intended use. Examples thereof include amino resins, polyvinyl resins, polystyrene resins, halogenated olefin resins, polyester resins, polycarbonate resins, polyethylene resins, polyvinyl fluorides, polyvinylidene fluorides, polytrifluoroethylene resins, polyhexafluoropropylene resins, copolymers between vinylidene fluoride and acryl single substance, copolymers between vinylidene fluoride and vinyl fluoride, fluoroterpolymers (tri(multiple)fluoride copolymers) such as terpolymer of tetrafluoroethylene, vinylidene fluoride and nonfluorinated single substance, and silicone resins. These resins may be used alone or in combination of two or more. Of these, silicone resins are particularly preferable.

The silicone resin is not particularly limited and may be suitably selected from among generally known silicone resins in accordance with the intended use. Examples thereof include straight silicone resins composed of only organosiloxane bond; and modified silicone resins which are modified with alkyd resin, polyester resin, epoxy resin, acrylic resin, urethane resin or the like.

The silicone resins are commercially available. Specific examples of the commercially available straight silicone resins include KR271, KR255, and KR152 manufactured by Shin-Etsu Chemical Co., Ltd.; and SR2400, SR2406, and SR2410 manufactured by Toray Daw Corning Silicone K.K.

Specific examples of the commercially available modified silicone resins include KR206 (alkyd-modified), KR5208 (acryl-modified), ES1001N (epoxy-modified), and KR305 (urethane-modified) manufactured by Shin-Etsu Chemical Co., Ltd.; and SR2115 (epoxy-modified), and SR2110 (alkyd-modified) manufactured by Toray Daw Corning Silicone K.K.

Note that each of these silicone resins can be used as a single substance, but it is also possible to use a cross-linkable component, a component capable of controlling charged amount and the like in combination.

The resin layer may contain a conductive powder in accordance with the necessity. Examples of the conductive powder include metal powders, carbon black, titanium oxides, tin oxides, and zinc oxides. The average particle diameter of these conductive powders is preferably 1 μm or less. When the average particle diameter is larger than 1 μm, it may be difficult to control the electric resistance.

The resin layer can be formed, for example, by dissolving the silicone resin and the like in a solvent to prepare a coating solution, uniformly coating the surface of the core material with the coating solution by a known coating method, drying the core material surface, followed by baking the dried surface. For the coating method, for example, immersion method, spray method, and brush-coating method are exemplified.

The solvent is not particularly limited and may be suitably selected in accordance with the intended use. Examples of the solvent include toluene, xylene, methylethylketone, methylisobutylketone, Cellosolve, and butylacetate.

The backing method is not particularly limited and may be external heating method or internal heating method. For example, there are exemplified methods wherein the core material surface is baked using a fixed type electric furnace, a fluid type electric furnace, a rotary type electric furnace, a burner furnace or the like, or using a microwave.

The amount of the resin layer in the carrier is preferably 0.01% by mass to 5.0% by mass. When the amount of the resin layer is less than 0.01% by mass, the resin layer may not be uniformly formed on the surface of the core material, and when more than 5.0% by mass, granulation between carrier particles occurs due to the excessively thick resin layer, and it may be impossible to obtain a carrier particle having a uniform diameter.

When the developer is a two-component developer, the content of the carrier in the two-component developer is not particularly limited and may be suitably adjusted in accordance with the intended use. For example, it is preferably 90% by mass to 98% by mass, and more preferably 93% by mass to 97% by mass.

For the mixture ratio between a toner and a carrier in the two-component developer, generally preferably, a toner is mixed in an amount of 1 part by mass to 10.0 parts by mass relative to 100 parts by mass of a carrier.

(Image Forming Apparatus and Image Forming Method)

The image forming apparatus of the present invention has at least a latent electrostatic image bearing member, a charging unit, an exposing unit, a developing unit, a transfer unit and a fixing unit, may have a cleaning unit, and may further have suitably selected other units in accordance with the intended use, for example, a charge eliminating unit, a recycling unit, a controlling unit and the like. Note that a combination of a charging unit and an exposing unit may be referred to as "a latent electrostatic image forming unit".

The image forming method of the present invention can be preferably carried out through the use of the image forming apparatus of the image forming apparatus of the present invention. The charging step can be carried out by using the charging unit; the exposing step can be carried out by using the exposing unit; the developing step can be carried out by using the developing unit; the transferring step can be carried out by using the transfer unit; the fixing step can be carried out by using the fixing unit; and the other steps can be carried out by using the other units.

<Latent Electrostatic Image Bearing Member>

The latent electrostatic image bearing member is not particularly limited as to the material, shape, structure, size and the like, and may be suitably selected in accordance with the intended use. For the shape, a drum shape, a sheet shape, and an endless belt shape are exemplified. For the structure, it may have a single layer structure or a laminated structure. The size of the latent electrostatic image bearing member can be suitably selected according to the size and specifications of the image forming apparatus. Examples of the material include inorganic photoconductors such as amorphous silicon, selenium, CdS, and ZnO; and organic photoconductors (OPC) such as polysilane, and phthalopolymethine.

The amorphous silicon photoconductor is prepared, for example, by heating a substrate at 50° C. to 400° C. and forming a photosensitive layer composed of a-Si over the surface of the substrate by a film forming method such as vacuum evaporation method, sputtering method, ion-plating method, thermal CVD method, photo CVD method, and plasma CVD method. Of these film forming methods, plasma CVD method is particularly preferable. Specifically, a photosensitive layer forming method is preferably used in which a raw material gas is decomposed by a direct current, high-frequency wave or micro wave or glow discharge to thereby form a photosensitive layer composed of a-Si on a substrate surface.

The organic photoconductors (OPC) are generally widely used for the reasons of (1) optical properties such as wide light absorption wavelength range, and large light absorption amount, (2) electric properties such as high-sensitivity, and stable charge property, (3) wide selection range of materials, (4) easiness of production, (5) low-cost, and (6) nontoxic property. The layer structure of these organic photoconductors is broadly classified into single-layer structure and laminated layer structure.

The photoconductor formed in a single-layer structure has a substrate, a single-layer photosensitive layer formed on the substrate, and further has a protective layer, an intermediate layer and other layers in accordance with the necessity.

The photoconductor formed in a laminated structure has a substrate, and at least a charge generating layer and a charge transporting layer formed in this order on the substrate, and further has a protective layer, an intermediate layer and other layers in accordance with the necessity.

<Charging Step and Charging Unit>

The charging step is a step of charging the surface of a latent electrostatic image bearing member and is carried out by means of the charging unit.

The charging unit is not particularly limited and may be suitably selected in accordance with the intended use, as long as it can apply a voltage on the surface of a latent electrostatic image bearing member to uniformly charge the surface of the latent electrostatic image bearing member. The charging unit is broadly classified into the following types: (1) contact type charging unit that charges the surface of a latent electrostatic image bearing member in contact therewith, and (2) non-contact type charging unit that charges the surface of a latent electrostatic image bearing member in non-contact therewith.

—Contact Type Charging Unit—

For the contact type charging unit (1), for example, conductive or semiconductive charging rollers, magnetic brushes, fur brushes, films, and rubber blades. The charging roller allows for drastically reducing the amount of ozone generation as compared with corona discharge type devices, is excellent in stability in repetitive use of the latent electrostatic image bearing member, and is effective in preventing image degradation.

The magnetic brush is composed of a nonmagnetic conductive sleeve supporting various types of ferrite particle such as Zn—Cu ferrite particle, and a magnet roll included in the nonmagnetic conductive sleeve. When a fur brush is used as a charging unit, a material of the fur brush is, for example, a fur that becomes conductive by treatment with, for example, carbon, copper sulfide, a metal or a metal oxide, and the fur is coiled or mounted to a metal or another metal core rod which becomes conductive by treatment.

FIG. 1 is a cross-sectional view schematically showing one example of a charging roller. A charging roller 310 shown in FIG. 1 has a metal core rod 312 formed in a cylindrical shape as a conductive support, a resistance controlling layer 313 formed on the outer circumferential surface of the metal core rod 312, and a protective layer 314 coating the surface of the resistance controlling layer 313 to prevent leakage.

The resistance controlling layer 313 is formed by extrusion molding or injection molding a thermoplastic resin composition containing at least a thermoplastic resin and a polymer ion conductive agent on the circumferential surface of the metal core rod 312.

The volume specific resistance value of the resistance controlling layer 313 is preferably $10^6$ Ω·cm to $10^9$ Ω·cm. When the volume specific resistance value is higher than $10^9$ Ω·cm, the charged amount is insufficient, and it may be difficult for the photoconductor drum to have enough charge potential to obtain images with no nonuniformity of tones and colors. When the volume specific resistance value is lower than $10^6$ Ω·cm, it may possibly cause a leakage to the entire photoconductor drum.

A thermoplastic resin used for the resistance controlling layer 313 is not particularly limited and may be suitably selected in accordance with the intended use. Examples thereof include polyethylene (PE), polypropylene (PP), polymethyl methacrylate (PMMA), polystyrene (PS) or copolymers of polystyrene (AS, ABS, etc.).

For the polymer ion conductive agent, a polymer ion conductive agent is used which has a resistance value of about $10^6$ Ωcm to $10^{10}$ Ω·cm as a single substance and is capable of easily lowering the resistance of resin. As an example of the polymer ion conductive agent, a compound containing a polyetheresteramide component is exemplified. To adjust the resistance value of the resistance controlling layer 313 within the range, the blend amount of the polymer ion conductive agent to 100 parts by mass of the thermoplastic resin is preferably 30 parts by mass to 70 parts by mass.

Further, as the polymer ion conductive agent, a quaternary ammonium salt group-containing polymer compound can also be used. For the quaternary ammonium salt group-containing polymer compound, for example, quaternary ammonium salt group-containing polyolefins are exemplified. To adjust the resistance value of the resistance controlling layer 313 within the range, the blend amount of the quaternary ammonium salt group-containing polymer compound to 100 parts by mass of the thermoplastic resin is preferably 10 parts by mass to 40 parts by mass.

The polymer ion conductive agent can be dispersed in the thermoplastic resin by means of a biaxial kneader, a kneader or the like. Since the polymer ion conductive agent is uniformly dispersed on the molecular level in the thermoplastic resin composition, the resistance controlling layer 313 has no variation in resistance value associated with a dispersion defect of conductive materials, which are generally observed in a resistance controlling layer in which a conductive pigment is dispersed. Further, because the polymer ion conductive agent is a polymer compound, it is uniformly dispersed and fixed in the thermoplastic resin composition, rarely causing bleed-out.

The protective layer 314 is formed so as to have a resistance value higher than that of the resistance controlling layer 313. It is thereby possible to avoid a leakage to defective portions of the photoconductor drum. However, when the protective layer 314 has an excessively high resistance value, the charge efficiency is reduced. Thus, the difference in resistance value between the protective layer 314 and the resistance controlling layer 313 is preferably $10^3$ Ω·cm or less.

For a material used for the protective layer 314, a resin material is preferably used in terms of its excellence in film formability. For the resin material, for example, fluorine resin, polyamide resin, polyester resin, and polyvinyl acetal resin are preferable in that they are excellent in nonadhesiveness and can prevent toner adhesion. Further, these resins materials generally have electrical insulating properties, and thus when the protective layer 314 is formed using the resin material singularly, the charging roller will have insufficient properties. To avoid the problem, various conductive agents are dispersed in the resin material to thereby control the resistance value of the protective layer 314. Further, to improve the adhesive property between the protective layer 314 and the resistance controlling layer 313, a reactive curing agent such as isocyanate may be dispersed in the resin material.

The charging roller 310 is connected to a power source, and a predetermined voltage is applied to the charging roller 310. The voltage may be a direct current (DC) voltage alone, but it is preferably a voltage including an alternating current (AC) voltage superimposed on a direct current (DC) voltage. By applying an AC voltage to the charging roller 310, the surface of the photoconductor drum can be uniformly charged.

Figure 2:
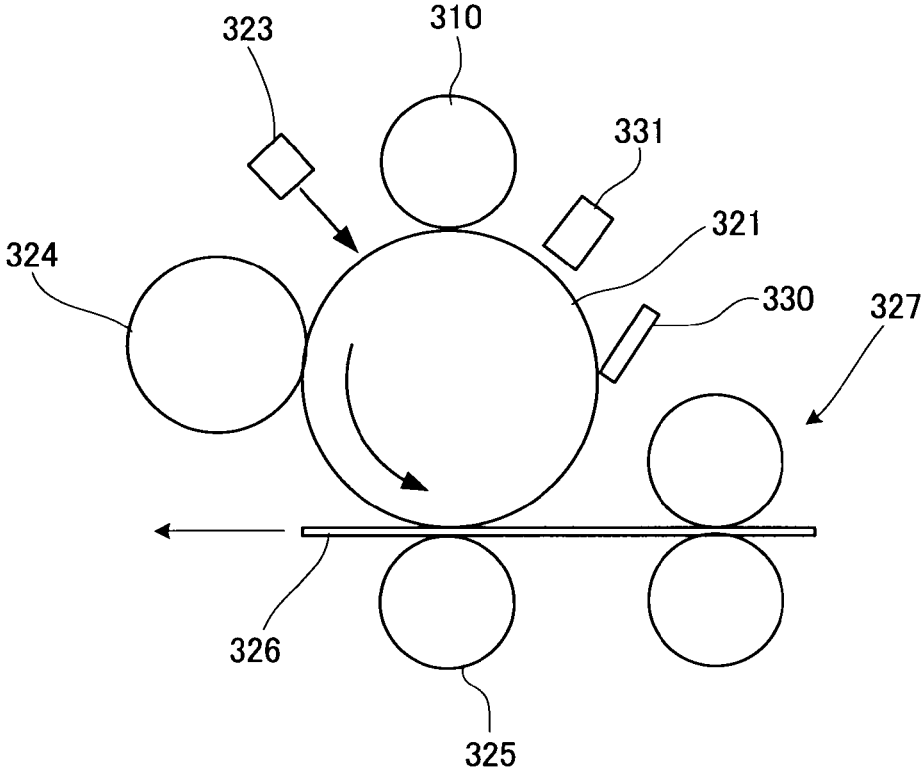
FIG. 2 is a schematic view showing one example in which a contact type charging roller is used in an image forming apparatus according to the present invention.

FIG. 2 is a schematic view showing one example in which a contact type charging roller 310 as illustrated in FIG. 1 is used as a charging unit in an image forming apparatus according to the present invention. In FIG. 2, in the periphery of a photoconductor drum 321 as a latent electrostatic image bearing member, there are placed in the following order: a charging unit 310 for charging the surface of the photoconductor drum 321, an exposing unit 323 for forming a latent electrostatic image on the charge processing surface, a developing unit 324 for forming a visible image by making a toner adhere on the latent electrostatic image formed on the photoconductor drum surface, a transfer unit 325 for transferring the visible image formed on the surface of the photoconductor drum 321 onto a recording medium 326, a fixing unit 327 for fixing the transferred image on the recording medium 326, a cleaning unit 330 for removing and collecting a residual toner remaining on the photoconductor drum 321, and a charge eliminating device 331 for removing a residual potential on the photoconductor drum 321. For the charging unit, the contact type charging roller 310 as illustrated in FIG. 1 is provided, and the surface of the photoconductor drum 321 is uniformly charged by the charging roller 310.

—Non-Contact Type Charging Unit—

For the non-contact type charging unit (2), for example, a non-contact charger utilizing a corona discharge, a needle electrode device, and a solid discharging device; a conductive or semiconductive charging roller provided with a minute gap with a latent electrostatic image bearing member are exemplified.

The corona discharge method is a non-contact charging method which gives positive or negative ions generated by corona discharge in an air to the surface of a latent electrostatic image bearing member, and there are the following types of corona discharging devices: a corotron charger having properties capable of giving a fixed charge amount to a latent electrostatic image bearing member, and a scorotron charger having properties capable of giving a fixed potential to a latent electrostatic image bearing member. The corotron charger is composed of a casing electrode which occupies a half space around a discharge wire and the discharge wire placed nearly the center thereof.

The scorotron charger is the same as the corotron charger, except that it further has a grid electrode, and the grid electrode is arranged at the position which is 1.0 mm to 2.0 mm away from the surface of a latent electrostatic image bearing member.

Figure 3:
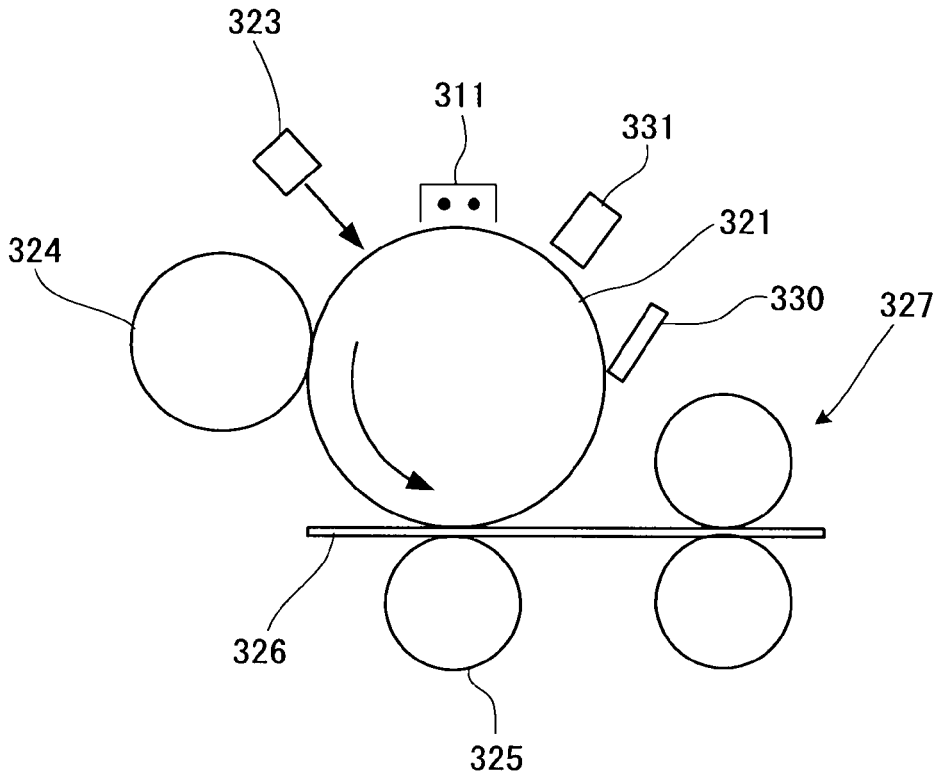
FIG. 3 is a schematic view showing one example in which a non-contact type corona charger is used in an image forming apparatus according to the present invention.

FIG. 3 is a schematic view showing one example in which a non-contact type corona charger is used as a non-contact type corona charger in an image forming apparatus according to the present invention. In FIG. 3, the same parts as in FIG. 2 are given the same reference numerals.

As the charging unit, a non-contact type corona charger 311 is provided, and the surface of a photoconductor drum 321 is uniformly charged by the corona charger 311.

As for a charging roller provided with keeping a minute gap with respect to the latent electrostatic image bearing member, the charging roller as shown in FIG. 2 is improved so as to keep a minute gap with respect to the latent electrostatic image bearing member. The minute gap is preferably from 10 μm to 200 μm, and more preferably from 10 μm to 100 μm.

Figure 4:
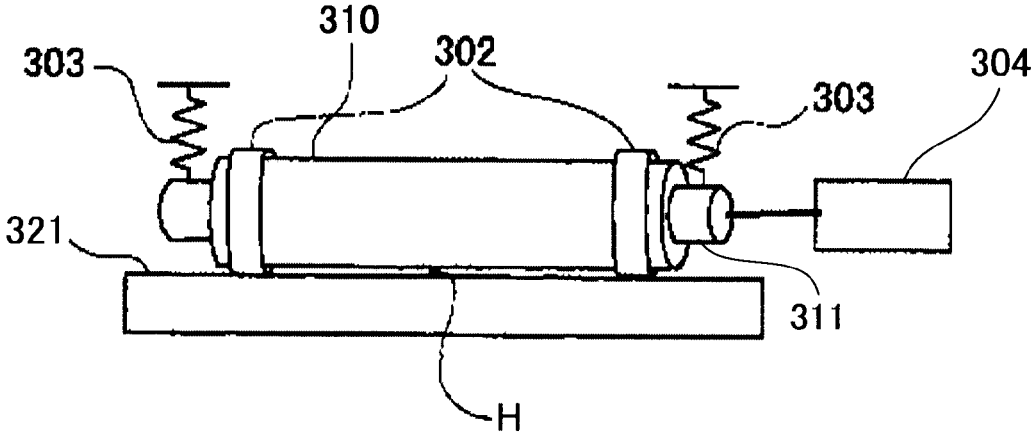
FIG. 4 is a schematic view showing one example of a non-contact type charging roller used in an image forming apparatus according to the present invention.

FIG. 4 is a schematic view showing one example of a non-contact type charging roller. In FIG. 4, a charging roller 310 is provided while keeping a minute gap H with respect to a photoconductor drum 321. The minute gap H can be set by winding a spacer member having a fixed thickness at the non-imaged area of both ends of the charging roller 310, thereby allowing the surface of the spacer member to contact with the surface of the photoconductor drum 321. In FIG. 4, the reference numeral 304 denotes a power source.

In FIG. 4, to keep the minute gap H, a film 302 is wound at both ends of the charging roller 310 to form a spacer member. This spacer 302 is brought into contact with the photoconductive surface of the latent electrostatic image bearing member to obtain a fixed minute gap H in the image area between the charging roller and the latent electrostatic image bearing member. Also, as an applied bias, an AC superposition type voltage is applied, and the latent electrostatic image bearing member is charged by discharge generated at the minute gap H between the charging roller and the latent electrostatic image bearing member. As shown in FIG. 4, maintaining accuracy of the minute gap H is improved by pressurizing an axis 311 of the charging roller 310 using a spring 303.

The spacer member and the charging roller may be integrally formed into a single unit. At this time, at least the surface of a gap section is made of an insulating material. Consequently, discharge at the gap section is eliminated and a discharge product is accumulated at the gap section, and thus it is possible to prevent the toner from adhering onto the gap section because of tackiness of the discharge product, resulting in a widen gap.

As the spacer member, a thermal contraction tube may be used. For the thermal contraction tube, for example, SUMITUBE for 105° C. (trade name: F105, manufactured by Sumitomo Chemical Co., Ltd) is exemplified.

<Exposing Step and Exposing Unit>

The exposing step is a step of exposing the charged surface of the latent electrostatic image bearing member and is carried out by means of the exposing unit.

The exposing may be carried out, for example, by imagewise exposing the surface of the latent electrostatic image bearing member using the exposing unit.

The optical systems used for the exposure may be broadly classified into analogue optical systems and digital optical systems. The analogue optical systems are those projecting directly an original image onto the surface of a photoconductor, and the digital optical systems are those where image information is input as electric signals, the electric signals are then converted into optical signals and the photoconductor is exposed to form an image.

The exposing unit is not particularly limited and may be suitably selected in accordance with the intended use, as long as capable of imagewise exposing the surface of a photoconductor that has been charged by a charging unit. Examples of the exposing unit include various exposure systems such as optical reproducing systems, rod-lens-eye systems, optical laser systems, optical liquid crystal shutter systems, and LED optical systems.

In the present invention, a backlight system may be employed for the exposure, in which the latent electrostatic image bearing member is imagewise-exposed from the back side thereof.

<Developing Step and Developing Unit>

The developing step is a step of developing the latent electrostatic image using the toner or developer of the present invention to form a visible image.

The visible image can be formed, for example, by developing the latent electrostatic image using the toner or the developer by means of the developing unit.

The developing unit is not particularly limited and may be suitably selected from among conventional developing devices, as long as capable of developing a latent electrostatic image using, for example, a toner or developer. For example, a developing system is preferably exemplified which has at least a developing unit capable of housing the toner or the developer and supplying the toner or the developer to a latent electrostatic image.

The developing unit may employ a dry developing process or may employ a wet developing process. Further, the developing unit may be a monochrome developing unit or may be a multi-color developing unit. Preferably, a developing unit is exemplified which has a stirrer that can frictionally stir the toner or the developer so as to be charged and a rotatable magnet roller.

In the developing unit, for example, the toner and the carrier are mixed and agitated, which causes a friction to charge the toner and maintains the charged toner in a state of being held vertically on the surface of the rotating magnet roller to form a magnetic brush thereon. The magnet roller is set near the latent electrostatic image bearing member, therefore, a part of the toner constituting the magnetic brush formed on the surface of the magnetic roller transfers to the surface of the latent electrostatic image bearing member by electrical attraction. As a result, the latent electrostatic image is developed using the toner, and a visible image formed of the toner is then formed on the surface of the latent electrostatic image bearing member.

The developer housed in the developing unit is a developer containing the toner of the present invention, and it may be a one-component developer or may be a two-component developer.

[One-Component Developing Unit]

As the one-component developing unit, for example, a one-component developing device is preferably used, which has a developer bearing member and a layer thickness controlling member that forms a toner-thin layer on the surface of the developer bearing member.

Figure 5:
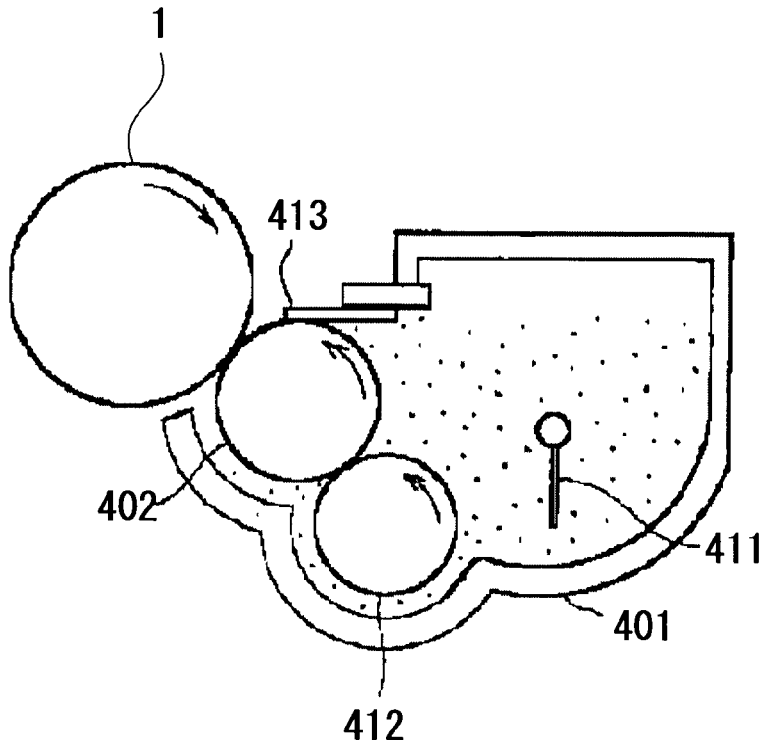
FIG. 5 is a schematic view showing one example of a one-component developing unit used in an image forming apparatus according to the present invention.

FIG. 5 is a schematic view showing one example of a one-component developing unit. This one-component developing unit is configured to develop a latent electrostatic image formed on the surface of a photoconductor drum 1 using a one-component developer composed of a toner and to transport a toner layer onto the surface of a developing roller 402 so as to be in contact with the photoconductor drum 1 that serves as a latent electrostatic image bearing member, thereby forming the toner layer on the surface of the developing roller 402, which is called a contact one-component developing process.

In FIG. 5, the toner housed in a casing 401 is agitated by rotation of an agitator 411 serving as an agitating unit to be mechanically supplied to a supplying roller 412 serving as a toner supplying member. The supplying roller 412 is formed of foamed polyurethane, etc., has flexibility and is structured to easily hold the toner in a cell having a diameter of 50 μm to 500 μm. The JIS-A hardness of a supplying roller is relatively low of 10° to 30° and thus the supplying roller can be uniformly abutted against the surface of the developing roller 402.

The supplying roller 412 is driven to rotate in the same direction as the rotational direction of the developing roller 402, i.e. such that at the opposed area to the developing roller 402, the surface of the supplying roller 412 moves in the reverse direction to the rotational direction of the developing roller 402. The linear velocity ratio (supplying roller/developing roller) between both rollers is preferably 0.5 to 1.5. The supplying roller 412 may be driven to rotate in the reverse direction to the rotational direction of the developing roller 402, i.e. such that at the opposed area to the developing roller 402, the surface of the supplying roller 412 moves in the same direction to the rotational direction of the developing roller 402. In this embodiment, the supplying roller 412 is driven to rotate in the same direction as the rotational direction of the developing roller 402, and the linear velocity ratio is set to 0.9. The penetration amount of the supplying roller 412 to the developing roller 402 is set to 0.5 mm to 1.5 mm. In this embodiment, when a unit effective width is 240 mm (A4 size, vertical orientation), the required torque is 14.7 N·cm to 24.5 N·cm.

The developing roller 402 has a surface layer composed of a rubber material on a conductive substrate and has a diameter of 10 mm to 30 mm, the surface of which is coarsely formed so as to have a surface roughness Rz of 1 μm to 4 μm. The surface roughness Rz to the average particle diameter of the toner is preferably 13% to 80%. Thereby, the toner can be conveyed without being buried in the surface of the developing roller 402. Especially, the surface roughness Rz of the developing roller 402 is preferably in a range from 20% to 30% of the average particle diameter of the toner.

Examples of the rubber material include silicone rubbers, butadiene rubbers, NBR rubbers, hydrine rubbers, and EPDM rubbers. It is preferred that the surface of the developing roller 402 be coated with a coat layer to particularly stabilize the stability with time. For a material used for the coat layer, silicone materials and TEFLON (registered) materials are exemplified. The silicone materials are excellent in charging properties of toner, and the TEFLON (registered) materials are excellent in releasing properties. To obtain conductivity, a conductive material such as carbon black may be contained in the coat layer in an appropriate amount. The thickness of the coat layer is preferably 5 μm to 50 μm. When the thickness is out of the range, it may be liable to cause a problem that the coat layer is susceptible to fracture.

A toner having a predetermined polarity (in this embodiment, the toner has a negative polarity) that resides on or inside the supplying roller 412 is caught at the contact point between the supplying roller 412 and the developing roller 402 rotating in the reverse direction to the rotational direction of the supplying roller 412 to obtain a negative electrical charge by friction charge effect, the toner thereby being held on the developing roller by the generated electrostatic force and by conveying effect due to the surface roughness of the developing roller. However, the toner layer formed on the surface of the developing roller 402 at that time has not a uniform thickness and adheres thereon in an excessive amount (1 mg/cm$^2$ to 3 mg/cm$^2$). Then, by abutting a controlling blade 413 as a layer thickness controlling member against the surface of the developing roller 402, a toner-thin layer having a uniform thickness is formed on the surface of the developing roller 402. The tip of the controlling blade 413 faces downstream in the rotational direction of the developing roller 402, and the center portion of the controlling blade 413 is abutted against the surface of the developing roller 402, which is so-called a "belly contact". However, the controlling blade 413 may be set in the reverse direction, and an edge abutment can also be employed.

The material used for the controlling blade 413 is preferably a metal such as SUS304, and the thickness thereof is 0.1 mm to 0.15 mm. Besides metals, a rubber material such as polyurethane having a thickness of 1 mm to 2 mm and a resin material having a relatively high hardness such as silicone resin can be used. Because the controlling blade 413 can be made to have a low resistance by mixing carbon black or the like, instead of using a metal, a bias power source is connected to the controlling blade 413, thereby an electric field can be formed between the controlling blade 413 and the developing roller 402.

The controlling blade 413 serving as a layer thickness controlling member preferably has a free end length from the holder of 10 mm to 15 mm. When the free end length is longer than 15 mm, the size of the developing roller becomes large, and the developing rolled cannot be housed in a compact image forming apparatus, and when shorter than 10 mm, it may easily cause vibrations when the controlling blade 413 is brought into contact with the surface of the developing roller 402, and abnormal images such as lateral-gradual image non-uniformity may easily occur on images.

The abutment pressure of the controlling blade 413 is preferably in the rage of 0.049 N/cm to 2.45 N/cm. When the abutment pressure is higher than 2.45 N/cm, the adhesion amount of the toner on the surface of the developing roller 402 is reduced and the charged amount of the toner is excessively increased. Therefore, image density may be lowered due to the reduced developed amount of toner. When the abutment pressure is lower than 0.049 N/cm, an agglomerate of toner may pass by the controlling blade without a thin layer being formed uniformly, and the image quality may significantly degrade. In this embodiment, for the developing roller 402, the one having a JIS-a hardness of 30° was used, for the controlling blade 413, an SUS plate of 0.1 mm in thickness was used, and the abutment pressure therebetween was set to 60 gf/cm. By this setting, a targeted adhesion amount of toner could be obtained on the developing roller.

The contact angle of the controlling blade 413 serving as a layer thickness controlling member to the tangent line of the developing roller 402 in a direction that the tip faces the downstream of the developing roller 402 is preferably 10° to 45°. The unnecessary portion for forming a toner-thin layer interposed between the controlling blade 413 and developing roller 402 is separated from the developing roller 402 and a thin layer is formed with a uniform thickness of intended 0.4 mg/cm$^2$ to 0.8 mg/cm$^2$. At this stage, the toner charge is finally −10 μC/g to −30 μC/g, then the toner is used for developing a latent electrostatic image on the photoconductor drum 1.

As such, in accordance with the one-component developing apparatus in this embodiment, the distance between the surface of the photoconductor drum 1 and the surface of the developing roller 402 can be narrowed still further compared to conventional two-component developing units, thereby increasing the developing ability and making possible to develop with lower voltages.

[Two-Component Developing Unit]

The two-component developing unit is preferably one having a magnetic field-generating unit fixed therein and a rotatable developer bearing member that carries on its surface a two-component developer formed of a magnetic carrier and toner.

Figure 6:
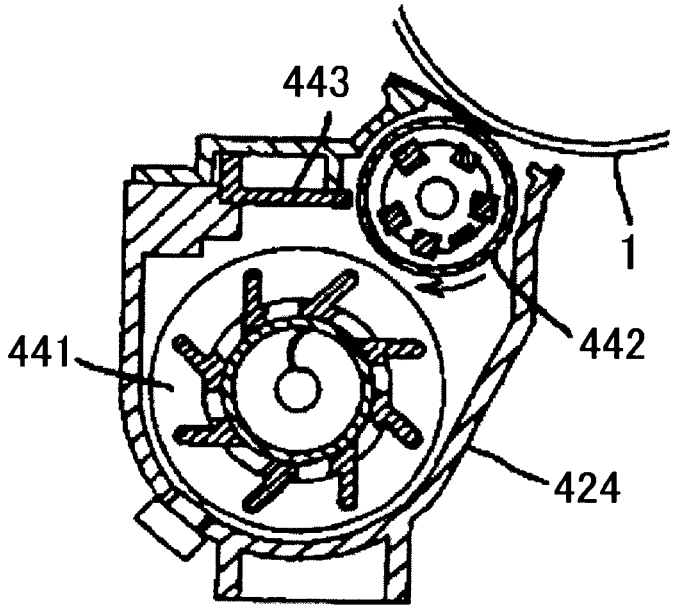
FIG. 6 is a schematic view showing one example of a two-component developing unit used in an image forming apparatus according to the present invention.

FIG. 6 is a schematic view showing one example of a two-component developing unit that uses a two-component developer composed of a magnetic carrier and a toner. In this two-component developing unit of FIG. 6, a developer is stirred and transported by a screw 441 and sent to a developing sleeve 442. The two-component developer sent to the developing sleeve 442 is regulated by a doctor blade 443 serving as a layer thickness controlling member, and the supplied amount of the developer is controlled by a doctor gap, which is a space between the doctor blade 443 and the developing sleeve 442. When the doctor gap is too small, the amount of developer is insufficient, leading to insufficient image density, and when the doctor gap is too large, the developer is excessively supplied in amount, causing a problem of carrier attachment on the photoconductor drum 1. Therefore, the developing sleeve 442 is equipped therein with a magnet that forms a magnetic field so as to hold the developer vertically on the peripheral surface, and the developer is held vertically in a form of chains on the developing sleeve 442 along the magnetic field lines that are radiated from the magnet in the normal line direction, forming a magnetic brush.

The developing sleeve 442 and the photoconductor drum 1 are arranged so as to be adjacent to each other with a certain space (development gap) in between and a developing region is formed where the developing sleeve 442 and the photoconductor drum 1 are facing each other. The developing sleeve 442 is made of non-magnetic substance such as aluminum, brass, stainless steel, and conductive resin in a form of cylinder, and it is rotated by a rotary drive mechanism (not shown). The magnetic brush is transported to the developing region by the rotation of the developing sleeve 442. A developing voltage is applied to the developing sleeve 442 by means of a power source for development (not shown), the toner on the magnetic brush is separated from the carrier by means of development field formed between the developing sleeve 442 and the photoconductor drum 1, and is developed on the latent electrostatic image on the photoconductor drum 1. It is also possible for the developing voltage to be overlapped with alternating current.

The development gap can be set to approximately 5 times to 30 times as much as the particle diameter of the developer, and when the particle diameter of the developer is 50 μm, the development gap can be set to 0.5 mm to 1.5 mm. When the development gap is wider than the above, it is difficult to obtain desired image density.

It is also preferable that the doctor gap be approximately equivalent or somewhat larger than the development gap. The drum diameter or drum linear velocity of the photoconductor drum 1 and the sleeve diameter or sleeve linear velocity of the developing sleeve 442 are determined depending on the copying speed or size of the apparatus, etc. The ratio of the sleeve linear velocity to the drum linear velocity is preferably 1.1 or more for obtaining required image density. It is also possible to install a sensor in a position after developing and control the process condition by detecting the amount of toner adhesion amount from optical reflectance.

<Transferring Step and Transfer Unit>

The transferring step is a step of transferring the visible image onto a recording medium and is carried out by means of a transfer unit. The transfer unit is broadly classified into a transfer unit where a visible image on a latent electrostatic image bearing member is directly transferred onto a recording medium, and a secondary transfer unit where a visible image is primarily transferred onto an intermediate transfer member and then the visible image is secondarily transferred onto the recording medium.

The visible-image transfer may be carried out, for example, by charging the photoconductor using a transferring charger, which may be performed by the transfer unit. In a preferable aspect, the transfer unit has a primary transfer unit that transfers the visible image to the intermediate transfer member to form a composite transfer image, and a secondary transfer unit that transfers the compounded transfer image to the recording medium.

—Intermediate Transfer Member—

The intermediate transfer member is not particularly limited and may be suitably selected from among conventional transfer members in accordance with the intended use. Preferred examples thereof include transfer belts and transfer rollers.

The stationary friction coefficient of the intermediate transfer member is preferably 0.1 to 0.6, and more preferably 0.3 to 0.5. The volume resistance of intermediate transfer member is preferably more than several Ω·cm and less than $10^3$ Ω·cm. The volume resistance within the range of several Ω·cm to $10^3$ Ωcm may prevent charging of the intermediate transfer member itself, and the charge from the charging unit is unlikely to remain on the intermediate transfer member, therefore, transfer nonuniformity at the secondary transferring may be prevented and the application of transfer bias at the secondary transferring becomes relatively easy.

Materials used for the intermediate transfer member is not particularly limited and may be suitably selected from conventional ones in accordance with the intended use. Examples of the material are as follows: (1) materials with high Young's modulus (tension elasticity) used as a single layer belt such as polycarbonates (PC), polyvinylidene fluoride (PVDF), polyalkylene terephthalate (PAT), blend materials of PC/PAT, blend materials of ethylene tetrafluoroethylene copolymer (ETFE) and PC, blend materials of ETFE and PAT, blend materials of PC and PAT, and thermosetting polyimides of carbon black dispersion. These single layer belts having high Young's modulus are small in their deformation against stress during image formation and are particularly advantageous in that registration error is less likely to occur during color image formation; (2) a double or triple layer belt using the belt having high Young's modulus as a base layer is available, where being added with a surface layer and an optional intermediate layer around the peripheral side of the base layer. The double or triple layer belt has a capability of preventing drop-out in a lined image that is caused by hardness of the single layer belt; and (3) an elastic belt with relatively low Young's modulus is available that incorporates a rubber or an elastomer. This belt is advantageous in that there is almost no print defect of unclear center portion in a line image due to its softness. Additionally, by making width of the belt wider than drive roller or tension roller and thereby using the elasticity of edge portions that extend over the rollers, it can prevent meandering of the belt. It is also cost effective for not requiring ribs or units to prevent meandering. Of these, the elastic belt (3) is preferable in particular.

The elastic belt deforms corresponding to the surface roughness of toner layers and the recording medium having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no letter void even with a recording medium of low flatness.

The resin used for the elastic belt is not particularly limited and may be selected in accordance with the intended use. Examples thereof include polycarbonate resins, fluorine resins (such as ETFE and PVDF); polystyrene resins, chloropolystyrene resins, poly-α-methylstyrene resins; styrene resins (monopolymers or copolymers containing styrene or styrene substituents) such as styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers and styrene-phenyl methacrylate copolymers); styrene-α-chloromethyl acrylate copolymers, styrene-acrylonitrile acrylate copolymers, methyl methacrylate resins, and butyl methacrylate resins; ethyl acrylate resins, butyl acrylate resins, modified acrylic resins (such as silicone-modified acrylic resins, vinyl chloride resin-modified acrylic resins and acrylic urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins. These resins may be used alone or in combination with two or more.

The rubber used for the elastic belt is not particularly limited and may be suitably selected in accordance with the intended use. Examples thereof include natural rubber, butyl rubber, fluorine-based rubber, acryl rubber, EPDM rubber, NBR rubber, acrylonitrile-butadiene-styrene rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, and hydrogenated nitrile rubber. These rubbers may be used alone or in combination of two or more.

The elastomer used for the elastic is not particularly limited and may be suitably selected in accordance with the intended use. Examples thereof include polystyrene thermoplastic elastomers, polyolefin thermoplastic elastomers, polyvinyl chloride thermoplastic elastomers, polyurethane thermoplastic elastomers, polyamide thermoplastic elastomers, polyurea thermoplastic elastomers, polyester thermoplastic elastomers, and fluorocarbon thermoplastic elastomers. These elastomers may be used alone or in combination of two or more.

The conductive agent used for the elastic belt for adjusting resistance is not particularly limited and may be suitably selected in accordance with the intended use. Examples thereof include carbon black, graphite, metal powders such as aluminum and nickel; conductive metal oxides such as tin oxide, titanium oxide, antimony oxide, indium oxide, potassium titanate, antimony tin oxide (ATO), and indium tin oxide (ITO). The conductive metal oxides may be coated with insulating fine particles such as barium sulfate, magnesium silicate, and calcium carbonate.

The material used for the surface layer is required to prevent contamination of the photoconductor due to elastic material as well as to reduce the surface frictional resistance of the transfer belt so that toner adhesion is lessened while improving the cleaning ability and the secondary transfer property. The surface layer preferably contains a binder resin such as polyurethane resin, polyester resin, and epoxy resin and materials that reduce surface energy and enhance lubrication, for example, powders or particles such as fluorine resin, fluorine compound, carbon fluoride, titanium dioxide, and silicon carbide. In addition, it is possible to use a material such as fluorine rubber that is treated with heat so that a fluorine-rich layer is formed on the surface and the surface energy is reduced.

The method to produce the elastic belt is not particularly limited and may be suitably selected in accordance with the intended use. Examples thereof include (1) centrifugal forming in which material is poured into a rotating cylindrical mold to form a belt, (2) spray coating method in which a liquid coating solution is sprayed to form a film, (3) dipping method in which a cylindrical mold is dipped into a solution of material and then pulled out, (4) injection mold method in which material is injected into inner and outer molds, (5) a method in which a compound is applied onto a cylindrical mold and the compound is vulcanized and ground.

The method to prevent elongation of the elastic belt is not particularly limited and may be suitably selected in accordance with the intended use. Examples thereof include (1) a method in which materials that prevent elongation are added to a core layer and (2) a method in which a rubber layer is formed on a core layer which is less stretchable The material that prevents elongation is not particularly limited and may be suitably selected in accordance with the intended use. For example, natural fibers such as cotton, and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenol fibers; inorganic fibers such as carbon fibers, glass fibers, and boron fibers; metal fibers such as iron fibers, and copper fibers; and materials that are in a form of a weave or thread may be preferably used.

The method for forming the core layer is not particularly limited and may be suitably selected in accordance with the intended use. Examples thereof include (1) a method in which a weave that is woven in a cylindrical shape is placed on a mold or the like and a coating layer is formed on top of it, (2) a method in which a weave that is woven in a cylindrical shape is dipped in a liquid rubber or the like so that coating layer(s) is formed on one side or on both sides of the core layer and (3) a method in which a thread is twisted helically around a mold or the like with an arbitrary pitch, and then a coating layer is formed thereon.

As the coated layer comes to thicker, elongation and contraction of the surface comes to more significant and the surface layer is susceptible to cracks, causing significant elongation and contraction of images, therefore, excessive thickness such as above 1 mm is undesirable.

The transfer unit, i.e. the primary transfer unit and the secondary transfer unit, preferably has at least a transferer that is configured to charge so as to separate the visible image formed on the latent electrostatic image bearing member and transfer the visible image onto a recording medium. One transferer or two transferers may be used. Examples of the transferer include corona transferers utilizing corona discharge, transfer belts, transfer rollers, pressure-transfer rollers, and adhesion-transferers.

A typical recording medium is regular paper, and it is not particularly limited and may be suitably selected as long as capable of receiving transferred, unfixed image after developing; and PET bases for OHP may also be used.

—Transfer Unit for Tandem Image Forming Apparatus—

The tandem image forming apparatus has at least image forming elements arranged in plural numbers including a latent electrostatic image bearing member, a charging unit, a developing unit, and a transfer unit. The tandem image forming apparatus can form full-color images at higher speeds because it has four image forming elements for yellow, magenta, cyan and black, forms each visible image in parallel by means of four image forming elements and superimposes one another on a recording medium or intermediate transfer member.

Figure 7:
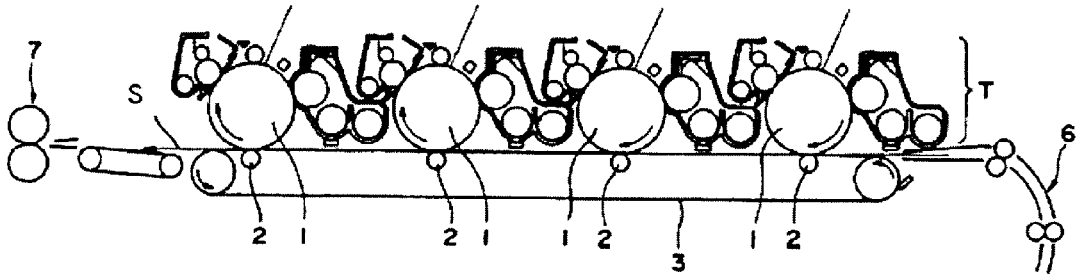
FIG. 7 is a schematic view showing one example of a direct transfer method used with the tandem type image forming apparatus of the present invention.
Figure 8:
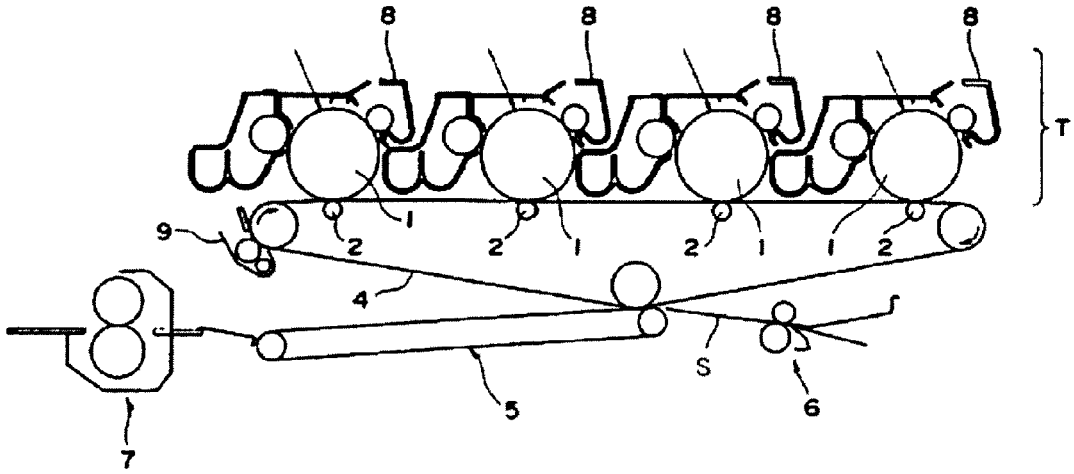
FIG. 8 is a schematic view showing one example of an indirect transfer method used with the tandem type image forming apparatus of the present invention.

There are two types of tandem image forming apparatus: (1) direct transfer type and (2) indirect transfer type: in (1) direct transfer type, visible images formed on each of photoconductors 1 are transferred sequentially by a transfer unit 2 onto a recording medium S whose surface is being transported so as to pass through the transfer position, which is facing each of the photoconductors 1 constituting a plurality of image forming elements as shown in FIG. 7; and in (2) indirect transfer type, visible images on each photoconductor 1 of a plurality of image forming elements are temporarily transferred sequentially by a primary transfer unit 2 to the surface of an intermediate transfer member 4 and then all the images on the intermediate transfer member 4 are transferred together onto the recording medium S at a time by a secondary transfer unit 5 as shown in FIG. 8. Note that in FIG. 8, as a secondary transfer unit, a transfer-conveying belt is used, but it may be in a roller shape.

The direct transfer type (1), as compared to the indirect transfer type (2), has a drawback of glowing in size in a transporting direction of the recording medium because a paper feeding unit 6 must be placed on the upper side of a tandem image forming section T where the photoconductors 1 are aligned, whereas a fixing unit 7 must be placed on the lower side of the apparatus. In contrast, the indirect transfer type (2) is advantageous in that the secondary transfer site may be installed relatively freely, and the paper feeding unit 6 and the fixing unit 7 may be placed together with the tandem image forming section T, making it possible to be downsized.

To avoid size-glowing in the transporting direction of the recording medium in the direct transfer type (1), the fixing unit 7 must be placed close to the tandem image forming section T. However, it is impossible to place the fixing unit 7 in a way that gives enough space for the recording medium S to bend, and the fixing unit 7 may easily affect the image forming on the upper side by the impact generated from the leading end of the recording medium S as it approaches the fixing unit 7 (this becomes conspicuous with a thick sheet), or by the difference between the transporting speed of the recording medium when it passes through the fixing unit 7 and the transporting speed of the recording medium when it is transported by the transfer-conveying belt. In contrast, the indirect transfer type allows the fixing unit 7 to be placed in a way that gives recording medium S an enough space to bend and the fixing unit 7 has almost no effect on the image formation. For above reasons, the indirect transfer type of the tandem image forming apparatus is particularly interested recently. And this type of color image forming apparatus as shown in FIG. 8, prepares for the next image formation by removing a residual toner remaining on the photoconductors 1 by photoconductor cleaning units 8 to clean the surface of the photoconductors 1 after the primary transfer. It also prepares for the next image formation by removing a residual toner remaining on the intermediate transfer member 4 by an intermediate transfer member cleaning unit 9 to clean the surface of the intermediate transfer member 4 after the secondary transfer.

<Fixing Step and Fixing Unit>

The fixing step is a step of fixing the transferred visible image on a recording medium using a fixing unit.

The fixing unit is not particularly limited and may be suitably selected in accordance with the intended use, however, a fixing device having fixing members and a heat source for heating the fixing member is preferably used.

The fixing members are not particularly limited and may be suitably selected in accordance with the intended use, as long as they can be in contact with each other to form a nip.

Examples of the fixing members include a combination of an endless belt and a roller, and a combination of a roller and a roller. In view of shorter warm-up period and energy saving, a combination of an endless belt and a roller or induction heating where the transferred image is heated from the surfaces of fixing members, is preferably employed.

The fixing member is exemplified by conventional heating and pressurizing units, i.e. a combination of a heating unit and a pressurizing unit. For the heating and pressurizing units, in the case of the combination of an endless belt and a roller, it is exemplified by a combination of a heating roller, a pressurizing roller, and an endless belt, and in the case of the combination of a roller and a roller, it is exemplified by a combination of a heating roller and a pressurizing roller.

In the case where the fixing member is an endless-shaped belt, preferably, the endless-shaped belt is made of materials having a small heat capacity, and includes one in which, for example, there is provided on a base an offset preventing layer. Materials forming the base include, for example, nickel and polyimide. Materials forming the offset preventing layer include, for example, silicone rubbers, and fluorine-based resins.

In the case where the fixing member is a roller, preferably, a metal core rod of this roller is made of a non-elastic member in order to prevent the deformation or deflection due to a high pressure. These non-elastic members are not particularly limited and may be suitably selected depending on the purpose. For example, the non-elastic members preferably include high thermal conductivity materials such as aluminum, iron, stainless steel, and brass. Moreover, the roller is preferably covered with an offset preventing layer at the surface thereof. Materials forming this offset preventing layer may be suitably selected depending on the purpose without particular limitation, and preferably include, for example, RTV silicone rubber, tetrafluoroethylene-perfluoroalkyl vinylether (PFA), and polytetrafluoroethylene (PTFE).

In the fixing step, the toner image is transferred onto the recording medium, the recording medium having an image may be passed through the nip to thereby fix the image on the recording medium or the image may be transferred and also fixed simultaneously at the nip.

In addition, the fixing step may be carried out for each color toner at every transferring onto the recording medium or may be carried out for color toner images all together in a state where all the color toners are superimposed.

The nip is formed by contacting at least two fixing members each other.

The nip pressure may be suitably selected depending on the purpose without particular limitation; preferably, the pressure is 5 $N/cm^2$ or more, more preferably 7 $N/cm^2$ to 100 $N/cm^2$, and still more preferably 10 $N/cm^2$ to 60 $N/cm^2$. When the nip pressure is excessively high, the roller durability may degrade. In contrast, when the nip pressure is lower than 5 $N/cm^2$, it may result in insufficient anti-offset property.

The fixing temperature of the toner, i.e. the surface temperature of the fixing member heated by the heating unit, may be properly selected depending on the purpose; preferably, the temperature is 120° C. to 170° C., and more preferably 120° C. to 160° C. When the fixing temperature is lower than 120° C., it may result in insufficient fixing property, and when higher than 170° C., it is undesirable in terms of energy saving.

The fixing unit is broadly classified into (1) internal heating mode, i.e. the fixing unit is equipped with at least one of rollers and belts, the heating energy is supplied to the surface that is not in contact with toner, and the image transferred onto the recording medium is heated and pressurized to thereby fix the image, and (2) external heating mode, i.e. the fixing unit is equipped with at least one of rollers and belts, the heating energy is supplied to the surface that is in contact with toner, and the image transferred onto the recording medium is heated and pressurized to thereby fix the image. It is also possible to use a combination of them.

For the (1) fixing unit adopting the internal heating mode, for example, the fixing member itself may be equipped with a heating unit therein. Examples of the heating unit are heaters and halogen lamps.

—Fixing Unit Adopting External Heating Mode—

For the (2) fixing unit adopting the external heating mode, for example, an aspect is preferable in which at least part of one or more surfaces of the fixing members is heated by a heating unit. The heating unit is not particularly limited and may be suitably selected in accordance with the intended use. Examples thereof include electromagnetic induction-heating units.

The electromagnetic induction-heating unit is not particularly limited and may be suitably selected in accordance with the intended use. However, the electromagnetic induction-heating unit preferably has a magnetic field generating unit and a heat-generating unit that generates heat by electromagnetic induction.

The electromagnetic induction-heating unit may preferably be composed of an induction coil placed so as to be accessible to the fixing member such as a heating roller, a shielding layer on which the induction coil is formed, and an insulating layer formed on the surface opposed to the surface of the shielding layer on which the induction coil is formed. The heating roller is preferably of a magnetic material or heat pipe.

It is preferred that the induction coil be placed to surround the half-cylinder of the heating roller at the side opposite to the site where the heating roller and the fixing member are in contact with each other.

—Fixing Unit Adopting Internal Heating Mode—

Figure 9:
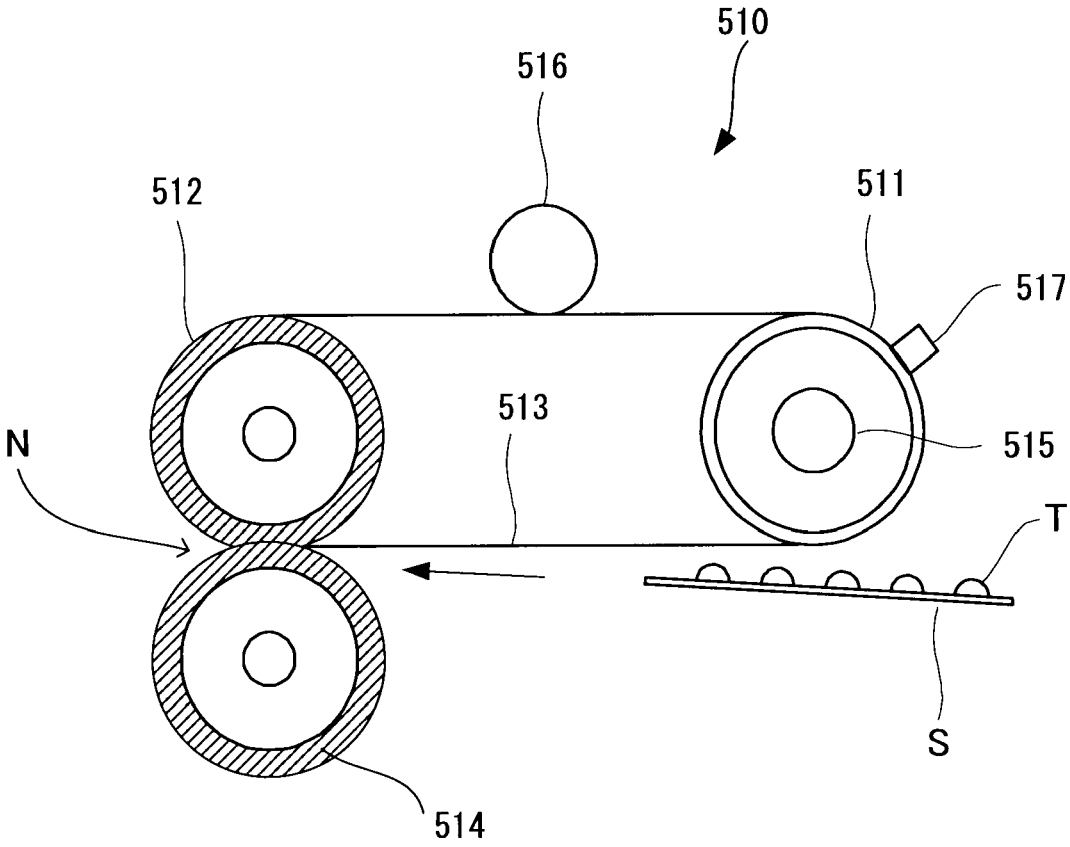
FIG. 9 is a schematic view showing one example of a belt fixing unit used in an image forming apparatus according to the present invention.

FIG. 9 exemplarily shows a belt-type fixing unit adopting internal heating mode. A belt-type fixing unit 510 illustrated in FIG. 9 is equipped with a heating roller 511, a fixing roller 512, a fixing belt 513 and a pressurizing roller 514.

The fixing belt 513 is spanned over the heating roller 511 and the fixing roller 512 that are rotatably located inside thereof and is heated at a predetermined temperature by the heating roller 511. The heating roller 511 incorporates a heat source 515 inside thereof and is configured to be capable of controlling temperature by a temperature sensor 517 mounted near. The fixing roller 512 is rotatably located inside the fixing belt 513 while being in contact with the inner surface of the fixing belt 513. The pressurizing roller 514 is rotatably located outside of the fixing belt 513 while being in contact with the outer surface of the fixing belt 513 so as to press-contact with the fixing roller 512. The surface hardness of the fixing belt 513 is lower than that of the pressurizing roller 514, and at a nip N formed between the fixing roller 512 and the pressurizing roller 514, the middle region between the introduction end and the ejection end of a recording medium S is situated near the fixing roller 512 than the introduction end and the ejection end of the recording medium S.

In the belt-type fixing unit 510 shown in FIG. 9, first, the recording medium S formed thereon with a toner image T to be fixed is transported to the heating roller 511, the toner image T formed on the recording medium S is heated to be a molten state by the heating roller 511 and the fixing belt 513 that have been heated to a predetermined temperature by the action of the activated heat source 515 incorporated into the heating roller 511, with keeping this state, the recording medium S is inserted into the nip N formed between the fixing roller 512 and the pressurizing roller 514, the recording medium S is then contacted with the surface of the fixing belt 513 that rotates in synchronization with the rotation of the fixing roller 512 and the pressurizing roller 514 and is press-contacted when passing through the nip N, thereby the toner image T being fixed on the recording medium S.

Next, the recording medium S with the toner image fixed thereon is passed through between the fixing roller 512 and the pressurizing roller 514 and is separated from the fixing belt 513 to be transported to a tray (not shown). At this point, the recording medium S is ejected toward the side of the pressurizing roller 514, and thus the recording medium is prevented from wrapping around the fixing belt 513 which is to be cleaned with a cleaning roller 516.

Figure 10:
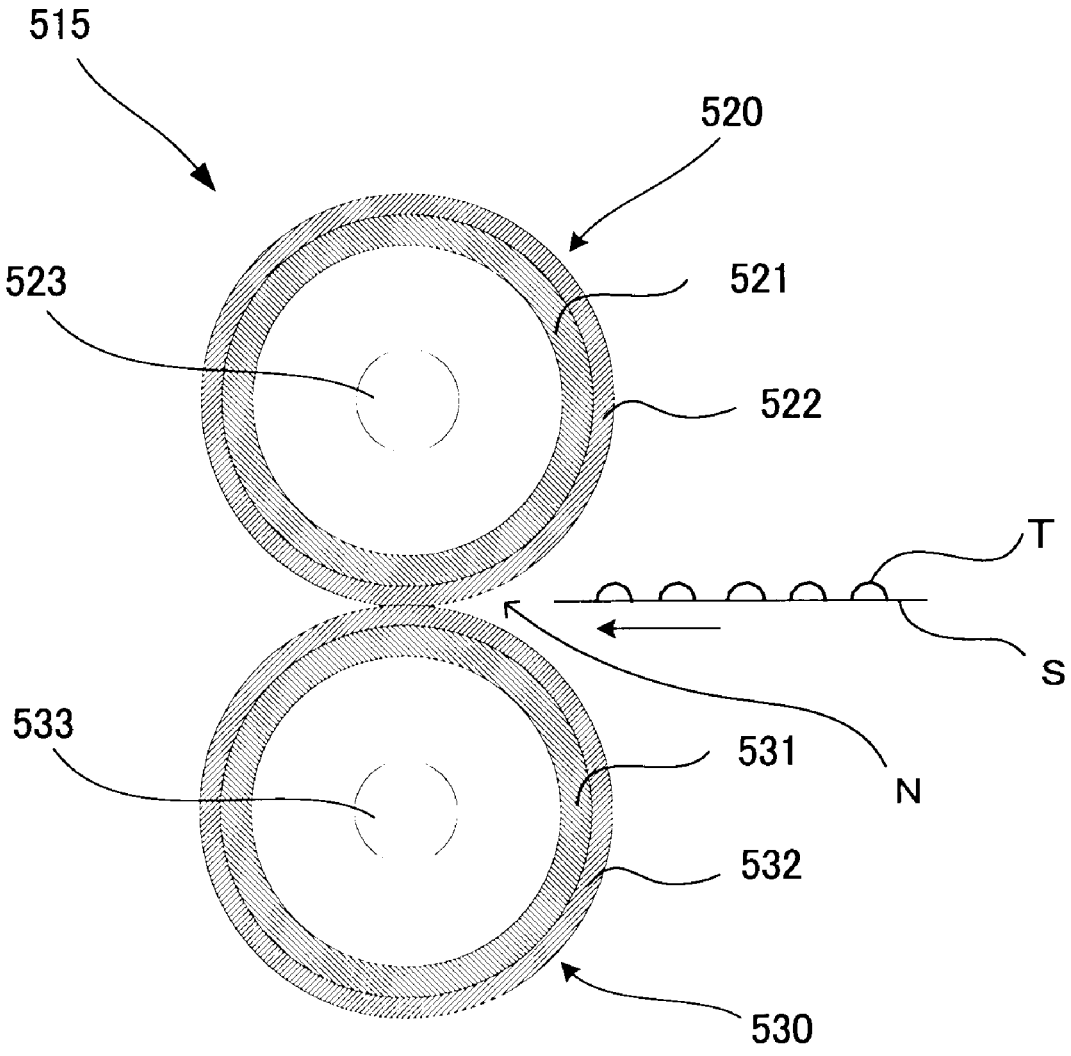
FIG. 10 is a schematic view showing one example of a heat-roll fixing unit used in an image forming apparatus according to the present invention.

A heat-roll fixing device 515 shown in FIG. 10 is equipped with a heating roller 520 as the above-mentioned fixing member, and a pressurizing roller 530 placed so as to be in contact with the heating roller 520.

The heating roller 520 is formed in a hollow metal cylinder 521, the surface of which is coated with an offset-preventing layer 522, and the inside of which a heat lamp 523 is provided. The pressurizing roller 530 is formed in a metal cylinder 531, the surface of which is coated with an offset-preventing layer 532. In the pressurizing roller 530, the metal cylinder 531 may be formed in a hollow shape, and a heat lamp 533 may be provided inside thereof.

The heating roller 520 and the pressurizing roller 530 are biased by a spring (not shown) so as to be rotatably provided in a state of being in contact with each other, thereby forming a nip N. The surface hardness of the offset-preventing layer 522 in the heating roller 520 is lower than that of the offset-preventing layer 532 in the pressurizing roll 530, and at a nip N formed between the heating roller 520 and the pressurizing roller 530, the middle region between the introduction end and the ejection end of a recording medium S is situated near the heating roller 520 than the introduction end and the ejection end of the recording medium S.

In the heat-roll fixing device 515 shown in FIG. 10, first, the recording medium S formed thereon with a toner image T to be fixed is transported to the nip N formed between the heating roller 520 and the pressurizing roller 530, the toner image T formed on the recording medium S is heated to be a molten state by the heating roller 520 that has been heated to a predetermined temperature by the action of the activated heat lamp 523 incorporated into the heating roller 520, and simultaneously, the recording medium S is press-contacted by the pressing force of the pressurizing roller 530, thereby the toner image T being fixed on the recording medium S.

Next, the recording medium S with the toner image fixed thereon is passed through between the fixing roller 520 and the pressurizing roller 530 and transported to a tray (not shown). At this point, the recording medium S is ejected toward the side of the pressurizing roller 530, and thus the recording medium S is prevented from wrapping around the heating roller 520 which is to be cleaned with a cleaning roller (not shown).

—Fixing Unit Adopting External Heating Mode—

Figure 11:
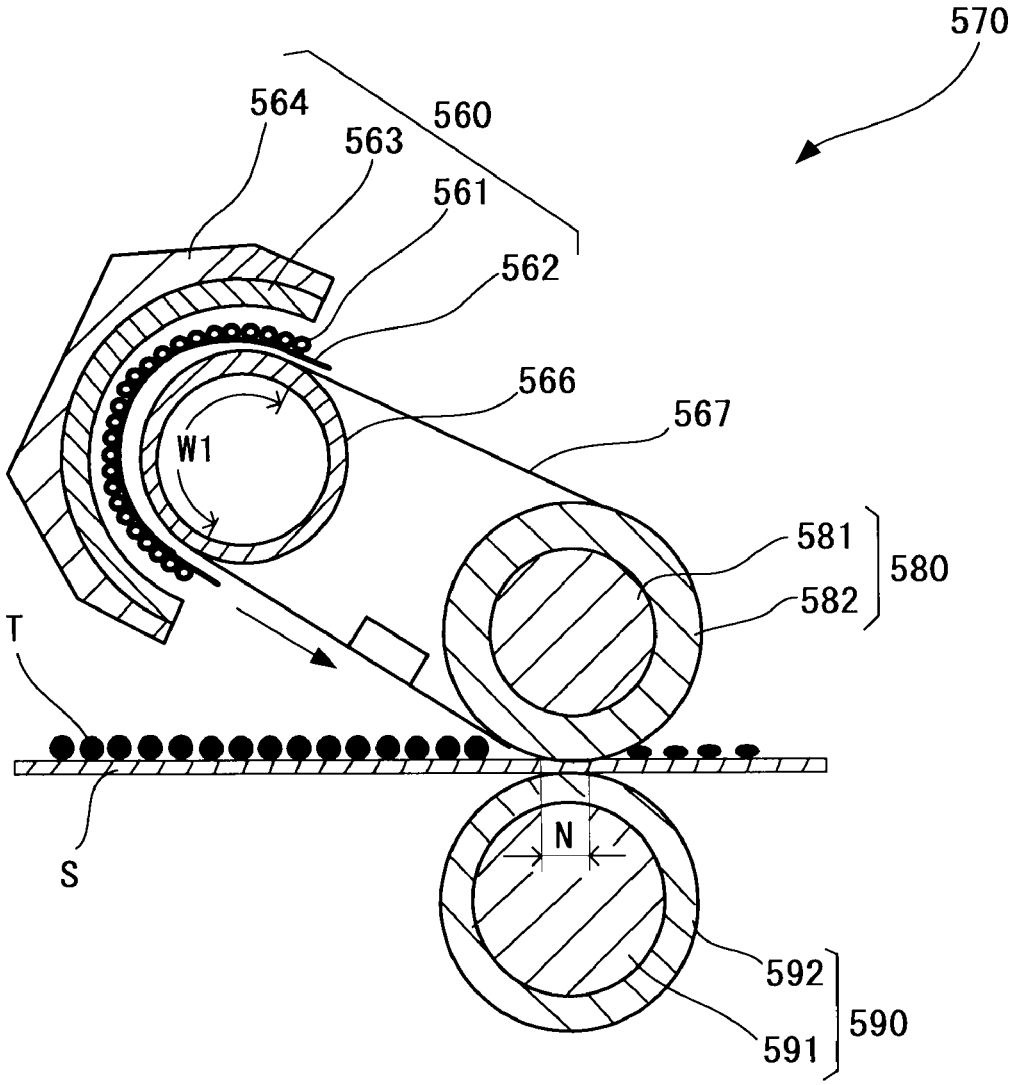
FIG. 11 is a schematic view showing one example of an electromagnetic induction heating fixing unit used in an image forming apparatus according to the present invention.

FIG. 11 shows an electromagnetic induction heating type fixing device 570 as an example of the fixing unit adopting external heating mode. This electromagnetic induction heating type fixing device 570 is equipped with a heating roller 566, a fixing roller 580, a fixing belt 567, a pressurizing roller 590, and an electromagnetic induction heating unit 560.

The fixing belt 567 is spanned over the heating roller 566 and the fixing roller 580 that are rotatably located inside thereof and is heated at a predetermined temperature by the heating roller 566.

The heating roller 566 has a hollow cylinder-shaped magnetic metal member composed, for example, of iron, cobalt, nickel or an alloy thereof, is formed, for example, so as to have an external diameter of 20 mm to 40 mm and a wall thickness of 0.3 mm to 1.0 mm and is constructed so as to allow for fast temperature increase with a low heat capacity.

The fixing roller 580 has a metal core rod 581 composed of metal such as stainless steel, the surface of which is coated with an elastic layer 582 prepared by forming a silicone rubber having heat resistance into a solid or foamed state, and is rotatably located inside the fixing belt 567 while being in contact with the inner surface of the fixing belt 567. The fixing roller 580 is designed so as to have an external diameter of about 20 mm to 40 mm to be larger than that of the heating roller 566 in order to form a nip N with a predetermined width between the pressurizing roller 590 and the fixing roller 580 by the pressing forth from the pressurizing roller 590. The elastic layer 582 has a wall thickness of about 4 mm to 6 mm such that the heat capacity of the heating roller 566 is smaller than that of the fixing roller 580, allowing for shortening warm-up time of the heating roller 566.

The pressurizing roller 590 has a metal core rod 591 composed of a metal cylinder member having high thermal conductivity such as copper, and aluminum, the surface of which is coated with an elastic layer 592 having high heat resistance and high toner-releasing property, and is rotatably located outside the fixing belt 567 such that the fixing roller 580 is press-contacted to the outer surface of the fixing belt 567. Besides the above-mentioned metals, SUS may be used for the metal core rod 591.

The electromagnetic induction heating unit 560 is provided near the heating roller 566 and in the axial direction of the heating roller 566. The electromagnetic induction heating unit 560 has an exciting coil 561 serving as a magnetic field generating unit and a coil guide plate 562 around which the exciting coil 561 is wound. The coil guide plate 562 is formed in a semi-cylindrical shape and located near the outer surface of the heating roller 566, and the exciting coil 561 is formed by alternately winding a long exciting coil wire around the coil guide plate 562 in the axial direction of the heating roller 566. The exciting coil 561 is connected to a driving power source (not shown) in which the frequency of oscillation circuit is variable. Radially outward the exciting coil 561, a semi-cylindrical exciting coil core 563 composed of a ferromagnetic material such as ferrite is provided near the exciting coil 561 with being fixed to an exciting coil core supporting member 564.

In the image-fixing device of electromagnetic induction heating type 570 shown in FIG. 11, once the exciting coil 561 of the electromagnetic induction heating unit 560 is electrified, an alternating magnetic field is formed around the electromagnetic-induction heating unit 560, thereby uniformly and efficiently preheating the heating roller 566, which comes adjacent to and surrounded by the exciting coil 561, by the excitation of overcurrent. A recording medium S having a toner image T to be fixed is transferred to a nip N formed between the fixing roller 580 and the pressurizing roller 590. The heating roller 566 is heated at a predetermined temperature by means of the electromagnetic induction heating unit 560. The fixing belt 567 is heated at a contact region W1 with the heating roller 566 by means of the heating roller 566. The toner image T on the recording medium S is heated to be a molten state by the fixing belt 567. In this condition, the recording medium S is inserted into the nip N formed between the fixing roller 580 and the pressurizing roller 590. The recording medium S is then contacted with the surface of the fixing belt 580 which rotates in synchronization with the rotation of the fixing roller 580 and the pressurizing roller 590, thereby the toner image T being fixed on the recording medium S.

Next, the recording medium S on which the toner image T is fixed is passed through between the fixing roller 580 and the pressurizing roller 590, separated from the fixing belt 567, and transported to a tray (not shown). In this process, the recording medium S is ejected toward the side of the pressurizing roller 590, and thus the recording member S is prevented from wrapping around the fixing belt 567 which is to be cleaned with a cleaning roller (not shown).

Figure 12:
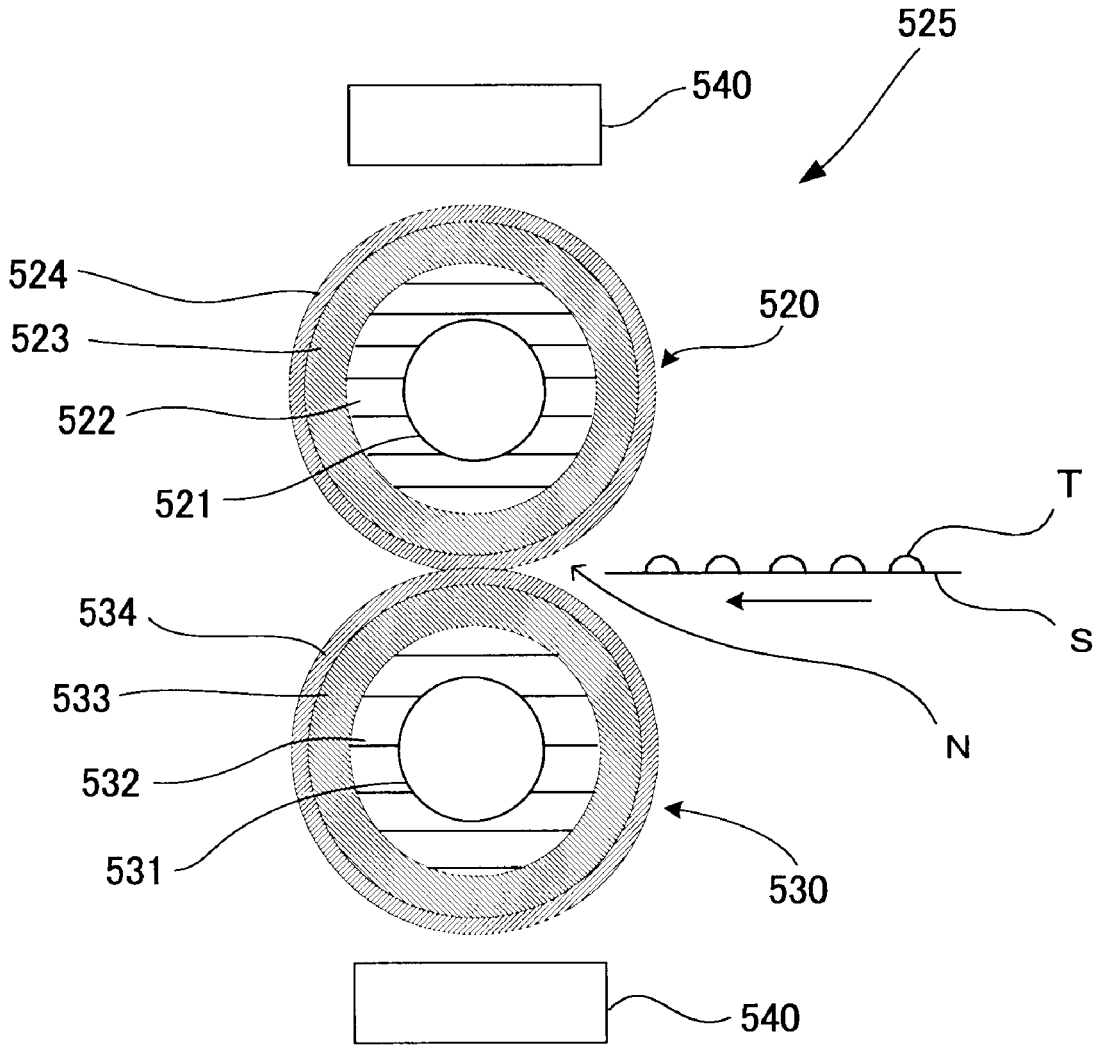
FIG. 12 is a schematic view showing another example of an electromagnetic induction heating fixing unit used in an image forming apparatus according to the present invention.

A roll-fixing device 525 of electromagnetic type shown FIG. 12 is a fixing unit equipped with a fixing roller 520 as a fixing member, a pressurizing roller 530 located so as to be in contact with the fixing roller 520, and an electromagnetic induction heat source 540 for heating externally the fixing roller 520 and the pressurizing roller 530.

The fixing roller 520 has a metal core rod 521, the surface of which is coated with a heat-insulating elastic layer 522, a heat-generating layer 523, and a releasing layer 524 formed in this order. The pressurizing roller 530 has a metal core rod 531, the surface of which is coated with a heat-insulating elastic layer 532, a heat-generating layer 533, and a releasing layer 534 formed in this order. The releasing layers 524 and 534 are formed of tetrafluoroethylene-perfluoroalkyl vinylether (PFA).

The fixing roller 520 and the pressurizing roller 530 are biased by a spring (not shown) so as to be rotatably provided in a state of being in contact with each other, thereby forming a nip N.

The electromagnetic induction heat sources 540 are respectively disposed near the fixing roller 520 and the pressurizing roller 530 to heat the heat generating layers 523 and 533 by electromagnetic induction.

In the fixing unit shown in FIG. 12, the fixing roller 520 and the pressurizing roller 530 are uniformly and efficiently preheated by the electromagnetic induction heat sources 540. Two-dimensional high pressures may be easily achieved at the nip N due to the combination of rollers.

<Cleaning Step and Cleaning Unit>

The cleaning step is a step of removing a residual toner remaining on the latent electrostatic image bearing member and is preferably carried out by a cleaning unit.

In the case where the developing unit has a developer bearing member that contacts with the surface of the photoconductor and develops a latent electrostatic image formed on the photoconductor as well as collects a residual toner remaining on the photoconductor, then the cleaning may be conducted without the cleaning unit in a cleaning-less manner.

The cleaning unit is not particularly limited and may be suitably selected from among conventional cleaners, as long as capable of removing a residual toner remaining on the latent electrostatic image bearing member. Examples thereof include magnetic brush cleaners, electrostatic brush cleaners, magnetic roller cleaners, blade cleaners, brush cleaners, and web cleaners. Of these, cleaning blades are particularly preferable in view of higher toner-removing ability, compact size, and lower cost.

Rubber material used for the cleaning rubber blade may be urethane rubber, silicone rubber, fluorinated rubber, chloroprene rubber, and butadiene rubber. Of these, urethane rubber is particularly preferable.

Figure 13:
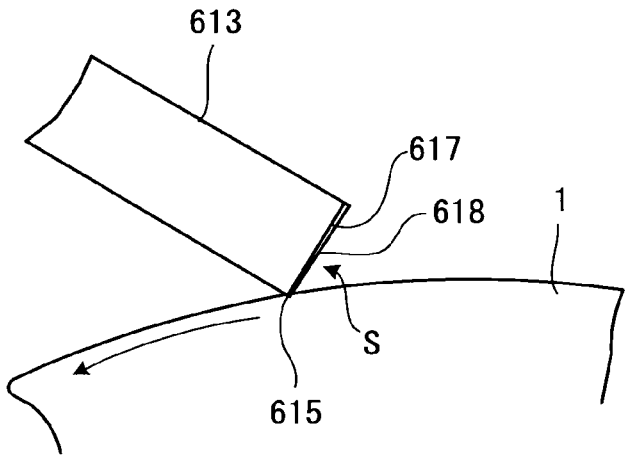
FIG. 13 is a schematic view showing one example of a cleaning blade used in an image forming apparatus according to the present invention.

FIG. 13 is an enlarged view that explains the vicinity around a contact portion 615 between a cleaning blade 613 and the photoconductor. The cleaning blade 613 has a toner-blocking surface 617 forming in relation with the surface of the photoconductor drum 1 a space S that broadens from the contact portion 615 toward the upstream of the rotational direction of the latent electrostatic image bearing member. In this embodiment, the toner-blocking surface 617 is extended from the contact portion 615 toward the upstream of the rotational direction of the photoconductor drum 1 so as to form an acute angle in the space S.

A coat portion 618 is provided at the toner-blocking surface 617, as shown in FIG. 13, as a higher friction portion with a higher friction coefficient than that of the cleaning blade 613. The coat portion 618 is formed of a material with a higher friction coefficient than that of the cleaning blade 613. Such a high friction material is exemplified by diamond-like carbon (DLC), but not limited thereto. The coat portion 618 is provided on the toner-blocking surface 617 so as not to contact with the surface of the photoconductor drum 1.

Note that the view of the cleaning unit is omitted, but it is equipped with a toner-collecting blade that collects the residual toner scraped by the cleaning blade and a toner-collecting coil that conveys the residual toner collected by the toner-collecting blade.

—Cleaning-Less Image Forming Apparatus—

Figure 14:
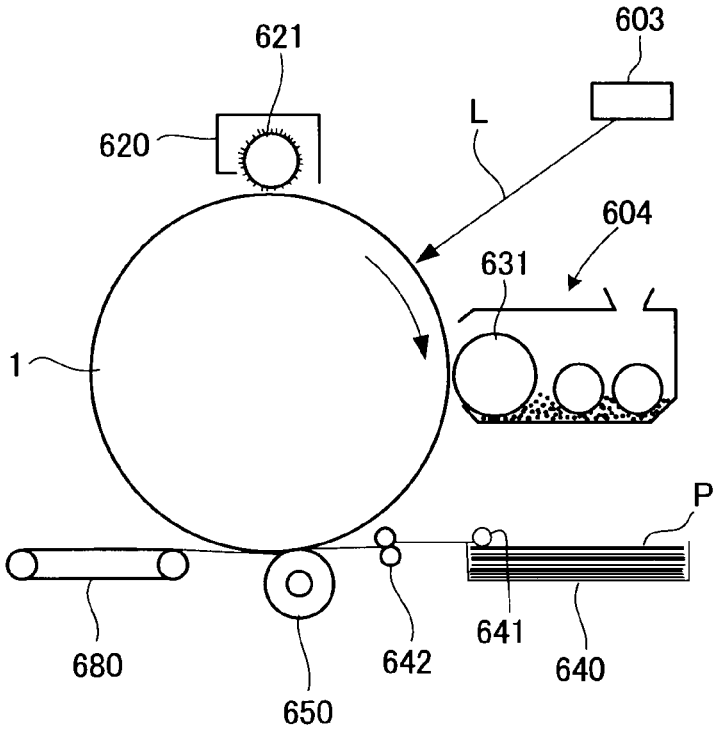
FIG. 14 is a schematic view exemplarily showing a cleaning-less image forming apparatus according to the present invention.

FIG. 14 is a schematic view exemplarily showing a cleaning-less image forming apparatus in which a developing unit also servers as a cleaning unit.

In FIG. 14, the cleaning-less image forming apparatus is equipped with a photoconductor drum 1 as a latent electrostatic image bearing member, a brush charger 620 as a contact charging unit, an exposure device 603 as an exposing unit, a developing device 604 as a developing device, a paper-feeding cassette 640, and a roller transfer unit 650. In the figure, P denotes a recording medium.

In this cleaning-less image forming apparatus, an untransferred toner remaining on the surface of the photoconductor drum 1 is moved to a position of the contact charger 620 that contacts with the photoconductor drum 1 by the continuing rotation of the photoconductor drum 1 and is temporarily collected to a magnetic brush section (not shown) of a brush charging member 621 that contacts with the photoconductor drum 1, and the collected toner is discharged again to the surface of the photoconductor drum 1 and finally collected with a developer by a developer bearing member 631 into the developing device 604 to be reused on the surface of the photoconductor drum 1 for the next image formation.

The description "the developing unit 604 also serves as a cleaning unit" means a method in which a small amount of residual toner left on the photoconductor drum 1 after transferring is collected by a developing bias (an electric potential difference between a direct current voltage applied to the developer bearing member 631 and a surface electric potential of the photoconductor drum 1).

In such an image forming apparatus where the developing unit also serves as a cleaning unit, the residual toner is collected into the developing unit 604 and reused in the subsequent image formation processes, therefore, such effects may be achieved as elimination of waste toner, maintenance free, and cleaner-less system, thus leading to higher space efficiency and significant downsizing of image forming apparatuses.

<Other Steps and Other Units>

The charge eliminating step is a step of applying a discharge bias to the latent electrostatic image bearing member to discharge it and can be preferably carried out by a charge eliminating unit.

The charge eliminating unit is not particularly limited and may be suitably selected from among conventional charge eliminating devices, as long as capable of applying a discharge bias to the latent electrostatic image bearing member. Preferred examples thereof are discharge lamps.

The recycling step is a step of recycling the electrophotographic toner removed in the cleaning step into the developing unit and can be preferably carried out by a recycling unit. The recycling unit is not particularly limited, and examples thereof are conventional transporting units.

The controlling step is a step of controlling each of the above-mentioned steps and can be preferably carried out by a controlling unit.

The controlling unit is not particularly limited and may be suitably selected in accordance with the intended use, as long as capable of controlling the operations of each of the units. Examples thereof include equipment such as sequencers and computers.

—Image Forming Apparatus and Image Forming Method—

Hereinafter, one embodiment of the image forming method of the present invention by means of the image forming apparatus will be described with reference to FIG. 15. An image forming apparatus 100 shown in FIG. 15 is equipped with a photoconductor drum 10 as a latent electrostatic image bearing member, a charging roller 20 as a charging unit, an exposure device 30 as an exposing unit, a developing device 40 as a developing unit, an intermediate transfer member 50, a cleaning blade 60 as a cleaning unit, and a charge eliminating lamp 70 as a charge eliminating unit.

The intermediate transfer member 50 is an endless belt, and is designed to be spanned over three rollers 51 disposed inside thereof and to be rotatable in the direction indicated by the arrow in the figure by means of the three rollers 51. One or more of the three rollers 51 also functions as a transfer bias roller capable of applying a certain transfer bias or a primary transfer bias to the intermediate transfer member 50. A cleaning blade 90 is provided adjacent to the intermediate transfer member 50. There is provided a transferring roller 80 as the transfer unit capable of applying a transfer bias at a position to face the intermediate transfer member 50 so as to secondarily transfer a visible image (toner image) to a recording medium 95. Further, there is provided a corona charger 58 in the periphery of the intermediate transfer member 50 for applying charges to the toner image transferred on the intermediate transferring medium 50. The corona charger 58 is placed between the contact region of the photoconductor 10 and the intermediate transferring medium 50 and the contact region of the intermediate transfer member 50 and the recording medium 95 in the rotational direction of the intermediate transfer member 50.

The developing device 40 is composed of a developing belt 41 as a developer bearing member, a black developing unit 45K, an yellow developing unit 45Y, a magenta developing unit 45M and a cyan developing unit 45C, the developing units being positioned around the developing belt 41. The black developing unit 45K is equipped with a developer container 42K, a developer supplying roller 43K, and a developing roller 44K. The yellow developing unit 45Y is equipped with a developer container 42Y, a developer supplying roller 43Y, and a developing roller 44Y. The magenta developing unit 45M is equipped with a developer container 42M, a developer supplying roller 43M, and a developing roller 44M. The cyan developing unit 45C is equipped with a developer container 42C, a developer supplying roller 43C, and a developing roller 44C. The developing belt 41 is an endless belt that is spanned over a plurality of belt rollers so as to be rotatable. A part of the developing belt 41 is in contact with the photoconductor 10.

Figure 15:
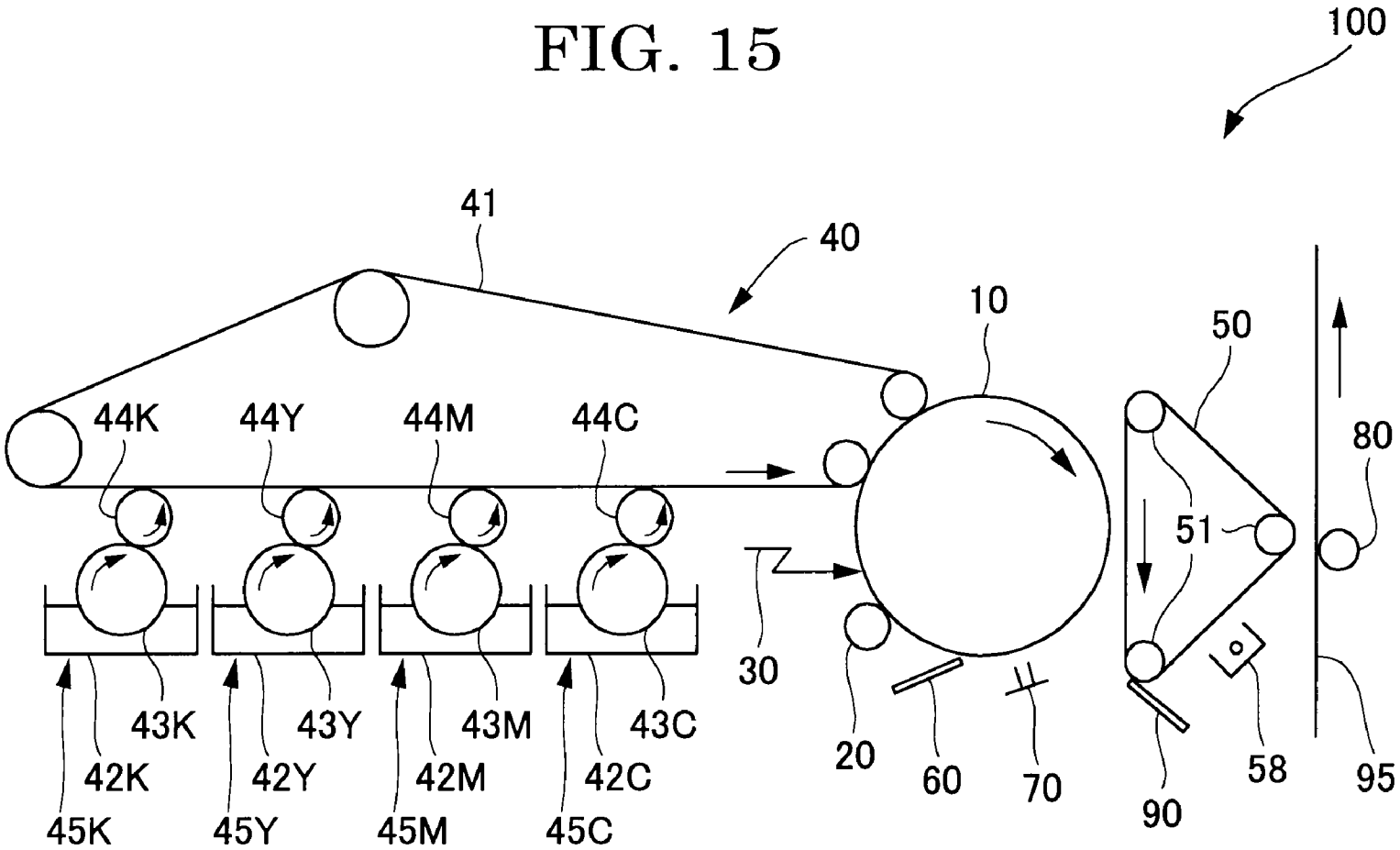
FIG. 15 is a schematic view showing one example of an image forming apparatus according to the present invention.

In the image forming apparatus 100 shown in FIG. 15, the photoconductor drum 10 is uniformly charged by means of the charging roller 20. The photoconductor drum 10 is exposed to a light 30 imagewise by an exposure device (not shown) to form a latent electrostatic image. The latent electrostatic image formed on the photoconductor drum 10 is provided with a toner from the developing device 40 to form a visible image. The visible image is primarily transferred onto the intermediate transfer member 50 by a bias voltage applied from the rollers 51 (primary transferring), and is further transferred to the recording medium 95 (secondary transferring). In this way a transferred image is formed on the recording medium 95. Subsequently, a residual toner remaining on the photoconductor drum 10 is removed by means of the cleaning blade 60, and charges remaining on the photoconductor drum 10 are eliminated by means of the charge eliminating lamp 70 on a temporary basis.

Figure 16:
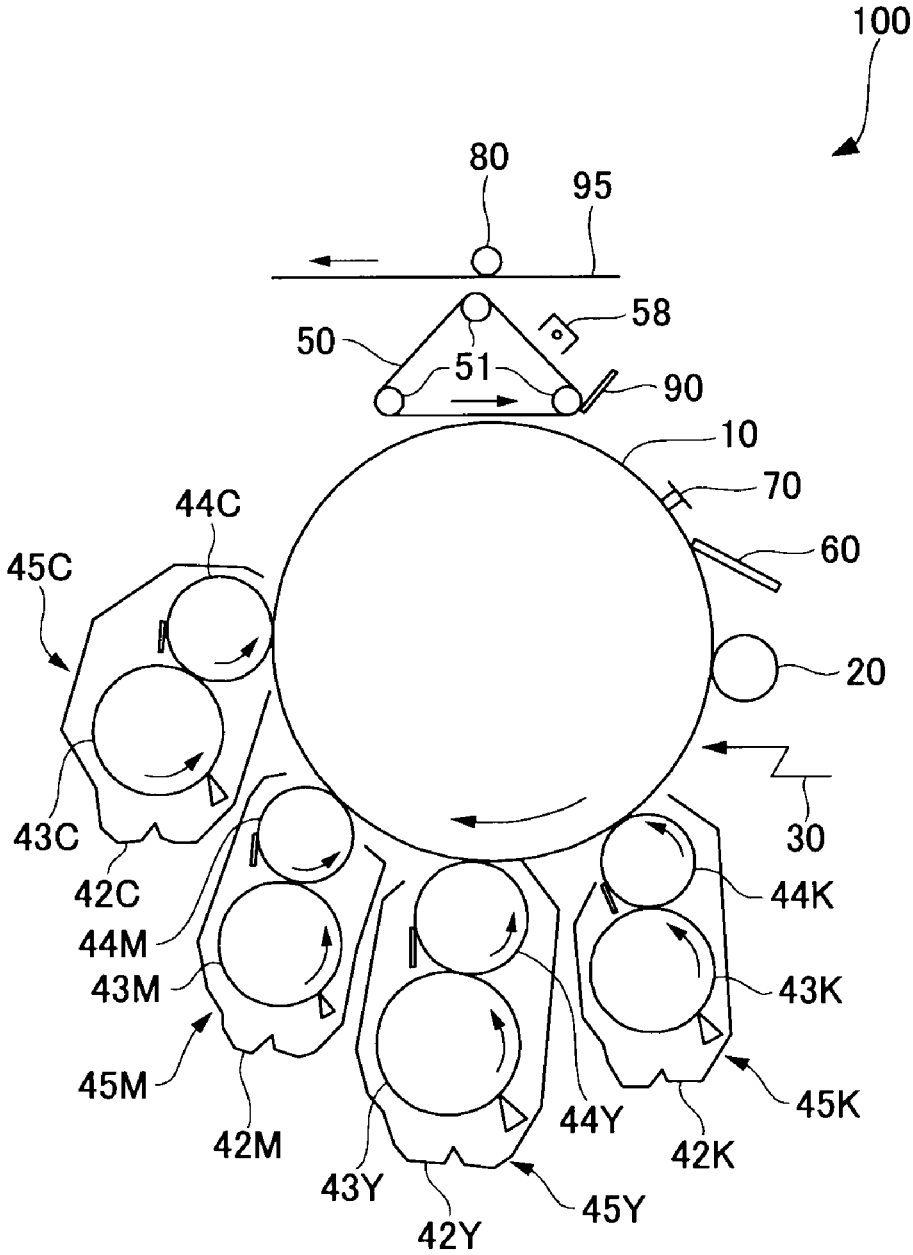
FIG. 16 is a schematic view showing another example of an image forming apparatus according to the present invention.

Next, another embodiment of the image forming method of the present invention by means of the image forming apparatus will be explained with reference to FIG. 16. An image forming apparatus 100 shown in FIG. 16 has an identical configuration and working effects to those of the image forming apparatus 100 shown in FIG. 15 except that this image forming apparatus 100 is not equipped with the developing belt 41 as a developer bearing member and that the black developing unit 45K, yellow developing unit 45Y, magenta developing unit 45M and cyan developing unit 45C are disposed around the periphery of the photoconductor drum 10. The reference numerals in FIG. 16 that are identical to those of FIG. 15 are denoted by the same reference numerals as those of FIG. 15.

—Tandem Image Forming Apparatus and Image Forming Method—

Figure 17:
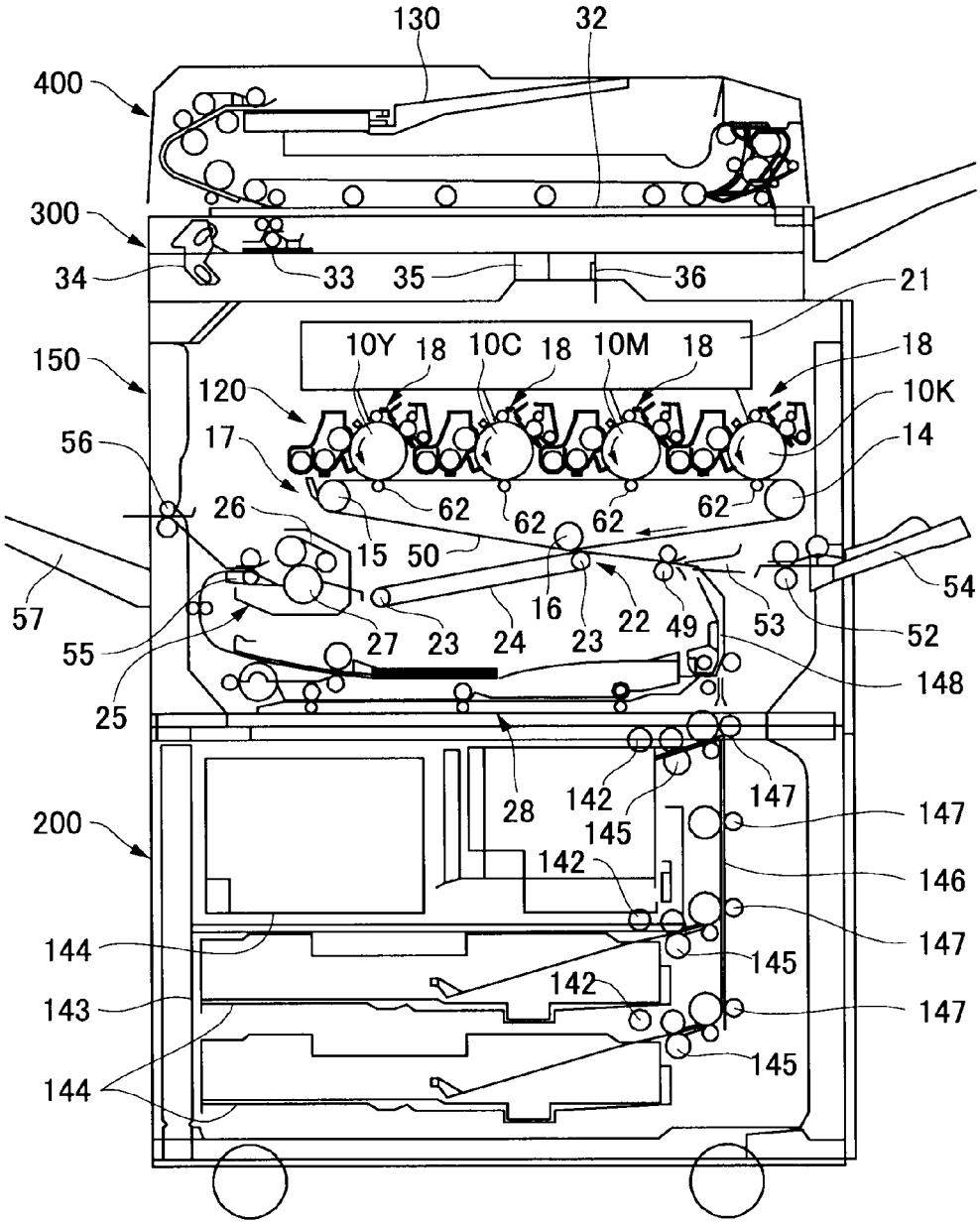
FIG. 17 is a schematic view showing one example of a tandem type image forming apparatus according to the present invention.

Still another embodiment of the image forming method of the present invention by means of the image forming apparatus will be described with reference to FIG. 17. An image forming apparatus 100 shown in FIG. 17 is a tandem color image-forming apparatus. The tandem image forming apparatus 100 is equipped with a copier main body 150, a sheet-feeder table 200, a scanner 300, and an automatic document feeder (ADF) 400.

The copier main body 150 has an endless-belt intermediate transfer member 50 in the center. The intermediate transfer member 50 is spanned over support rollers 14, 15 and 16 so as to be rotatable in a clockwise direction in FIG. 17. An intermediate transfer member cleaning unit 17 for removing a residual toner remaining on the intermediate transfer member is provided in the vicinity of the support roller 15. On the surface of the intermediate transfer member 50 spanned over the support rollers 14 and 15, four color-image forming units 18 of yellow, cyan, magenta, and black are arranged, constituting a tandem developing unit 120. An exposing device 21 is arranged adjacent to the tandem developing unit 120. A secondary transfer unit 22 is arranged across the intermediate transfer member 50 from the tandem developing unit 120. The secondary transfer unit 22 is provided with a secondary transferring belt 24, an endless belt, which is spanned over a pair of rollers 23. A recording medium conveyed on the secondary transferring belt 24 is allowed to contact with the intermediate transfer member 50. An image fixing device 25 is placed in the vicinity of the secondary transfer unit 22.

In the vicinity of the secondary transfer unit 22 and the image fixing device 25, a sheet reverser 28 is placed. The sheet reverser 28 turns over a transferred sheet to form images on the both sides of the sheet of recording medium.

Next, full-color image formation (color copying) using the tandem developing unit 120 will be described. At first, a source document is placed on a document platen 130 of the automatic document feeder 400. Alternatively, the automatic document feeder 400 is opened, the source document is placed on a contact glass 32 of the scanner 300, and the automatic document feeder 400 is closed.

When a start switch (not shown) is pushed, the source document placed on the automatic document feeder 400 is moved to the contact glass 32, and the scanner is then driven to operate first and second carriages 33 and 34. In the case where the source document is placed on the contact glass 32 from the beginning, the scanner 300 is immediately driven after pushing of the start switch. Light is applied from a light source to the document by means of the first carriage 33, and light reflected from the document is further reflected by the mirror of the second carriage 34. The reflected light passes through an image-forming lens 35, and a read sensor 36 receives it. In this way the color document (color image) is scanned, producing 4 types of color information of black, yellow, magenta, and cyan.

Figure 18:
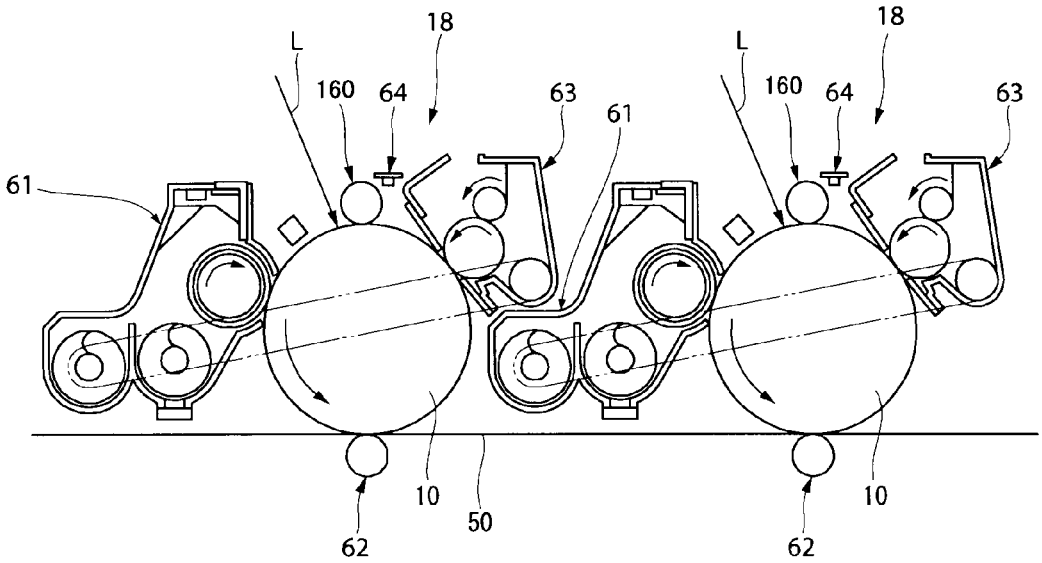
FIG. 18 is an enlarged view of each of image forming elements shown in FIG. 17.

Each piece of the color information of black, yellow, magenta, and cyan is transmitted to the image forming unit 18 (black image forming unit, yellow image forming unit, magenta image forming unit, or cyan image forming unit) of the tandem developing unit 120, and toner images of each color are formed in the image-forming units 18. As shown in FIG. 18, each of the image-forming units 18 (black image-forming unit, yellow image forming unit, magenta image forming unit, and cyan image forming unit) of the tandem developing unit 120 is equipped with a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charger 160 for uniformly charging the surface of each of the latent electrostatic image bearing members 10; an exposure device for exposing imagewise the surface of each of the latent electrostatic image bearing members 10 to light (denoted by "L" in FIG. 18) based on the corresponding each color image information to form a latent electrostatic image corresponding to the color image on each of the latent electrostatic image bearing members 10; a developing device 61 for developing the latent electrostatic image using the corresponding color toner (black toner, yellow toner, magenta toner, or cyan toner) to form each color toner image; a transfer charger 62 for transferring the each color toner image to an intermediate transfer member 50; a cleaning device 63; and a charge eliminating device 64. Thus, images of different colors (a black image, a yellow image, a magenta image, and a cyan image) can be formed based on the each color image information. The thus formed each color images, i.e. the black toner image formed on the latent electrostatic image bearing member for black 10K, yellow toner image formed on the latent electrostatic image bearing member for yellow 10Y, magenta toner image formed on the latent electrostatic image bearing member for magenta 10M, and cyan toner image formed on the latent electrostatic image bearing member for cyan 10C are sequentially transferred onto the intermediate transfer member 50 which rotates by the rotation of support rollers 14, 15 and 16 (primary transferring). These toner images of black, yellow, magenta and cyan are superimposed on the intermediate transfer member 50, thereby forming a composite color image (color transferred image).

In the meanwhile, one of feed rollers 142 of the paper feed table 200 is selectively rotated, whereby sheets of recording medium are ejected from one of multiple paper feed cassettes 144 in a paper bank 143 and are separated one by one by a separation roller 145. Subsequently, the sheet is fed to a feed path 146, conveyed by a conveying roller 147 into a feed path 148 inside the copier main body 150 and is bumped against a resist roller 49 to stop. Alternatively, one of the feed rollers 142 is rotated to eject the recording medium placed on a manual feed tray 54. The sheets are then separated one by one by means of the separation roller 145, and the sheet is fed into a manual feed path 53, and similarly, is bumped against the resist roller 49 to stop. The resist roller 49 is generally earthed, but it may be used under application of a bias for removing paper dusts on the recording medium. The resist roller 49 is rotated synchronously with the movement of the composite color image on the intermediate transfer member 50 to send the sheet of recording medium into between the intermediate transfer member 50 and the secondary transfer unit 22, and the composite color image is transferred onto the sheet by means of the secondary transfer unit 22 (secondary transferring). Thereby a color image is formed on the sheet. After image transferring, a residual toner remaining on the intermediate transfer member 50 is removed by means of an intermediate transfer member cleaning device 17.

The sheet of recording medium with the transferred color image formed thereon is sent by the secondary transfer unit 22 into an image fixing device 25, where the composite color image (color transferred image) is fixed on the sheet (recording medium) by heat and pressure. Subsequently, the sheet changes its direction by action of a switch blade 55, ejected by an ejecting roller 56, and stacked on an output tray 57. Alternatively, the sheet changes its direction by action of the switch blade 55, is flipped over by means of a sheet reverser 28, and transferred back to the image transfer section for recording of another image on the other side thereof. The sheet that bears images on both sides is then ejected by means of an ejecting roller 56, and is stacked on an output tray 57.

<Toner Container>

The toner container to be used in the present invention houses the toner or the developer of the present invention in its container.

The container is not particularly limited and may be suitably selected from among conventional container. Preferred examples thereof are those having a toner container body and a cap.

The toner container body is not particularly limited as to the size, shape, structure, material and the like and may be suitably selected in accordance with the intended use. For example, the shape is preferably a cylinder. It is particularly preferable that a spiral ridge is formed on the inner surface, thereby the content or the toner moves toward the discharge vent when rotated, and the spiral part partly or entirely serves as a bellows.

The material of the toner container body is not particularly limited and preferably offers dimensional accuracy. For example, resins are preferably exemplified. Among them, polyester resin, polyethylene resin, polypropylene resin, polystyrene resin, polyvinyl chloride resin, polyacrylic acid, polycarbonate resin, ABS resin, polyacetal resin are preferable.

The toner container is easy to store and ship, is handy, and is used with the process cartridge and image forming apparatus of the present invention by detachably mounting thereto for supplying toner.

(Process Cartridge)

The process cartridge of the present invention has at least a latent electrostatic image bearing member that bears a latent electrostatic image on the surface thereof and a developing unit configured to develop the latent electrostatic image borne on the surface of the latent electrostatic image bearing member using a toner to form a visible image and further has suitably selected other units in accordance with the necessity such as a charging unit, an exposing unit, a transfer unit, a cleaning unit and a charge eliminating unit.

For the toner, the toner of the present invention is used.

The developing unit has at least a developer container to house the toner or the developer and a developer bearing member to bear and convey the toner or the developer housed in the developer container and may further have a layer thickness controlling member for controlling the thickness of a toner layer to be borne by the developer bearing member. Specifically, any of the one-component developing unit and the two-component developer unit, which have been described hereinbefore in the sections of the image forming apparatus and image forming method, can be preferably used.

The charging unit, exposing unit, transfer unit, cleaning unit, and charge eliminating unit may be suitably selected from among those similar to ones mentioned above for the image forming apparatus.

The process cartridge is detachably provided in various types of electrophotographic image forming apparatuses, facsimiles, and printers, and particularly preferably be detachably mounted to the image forming apparatus of the present invention.

Figure 19:
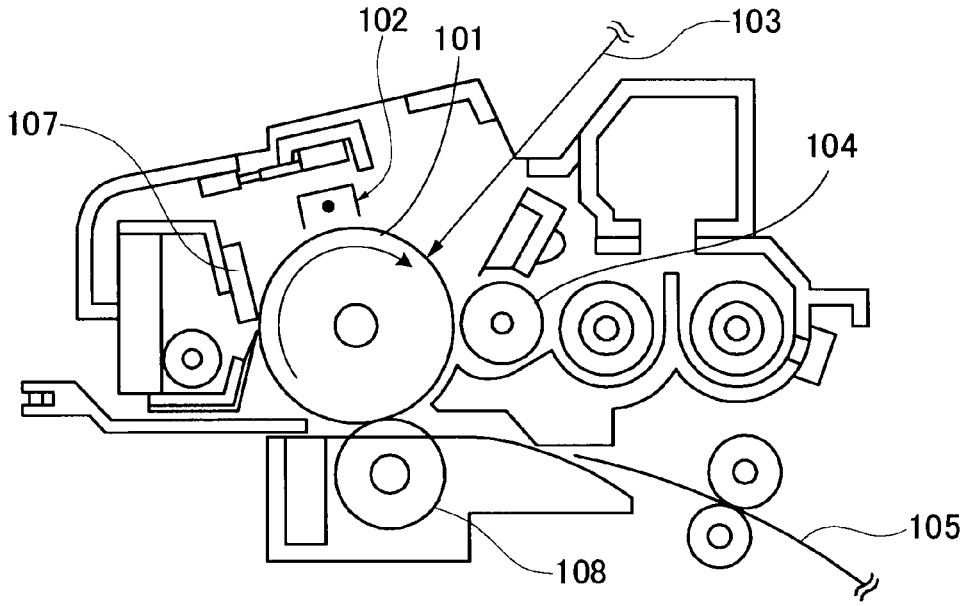
FIG. 19 is a schematic view showing one example of a process cartridge according to the present invention.

The process cartridge incorporates, as shown in FIG. 19 for example, a latent electrostatic image bearing member 101, a charging unit 102, a developing unit 104, a transfer unit 108, and a cleaning unit 107 and further has other units in accordance with the necessity. In FIG. 19, reference numeral 103 denotes light irradiation from an exposing unit, and reference numeral 105 denotes a recording medium.

The image forming process by means of the process cartridge as shown in FIG. 19 will be explained. A latent electrostatic image corresponding to an exposed image is formed on the surface of the latent electrostatic image bearing member 101 which is being rotated in the direction indicated by an arrow by charging using the charging unit 102 and exposing using exposure 103 from the exposing unit (not shown). The latent electrostatic image is developed by means of the developing unit 104, the obtained toner image is then transferred onto the recording medium 105 by means of the transfer unit 108 and then printed out. The surface of the photoconductor after image transfer is cleaned by means of the cleaning unit 107 and further discharged by means of a discharging unit (not shown), and the above operations are repeated again.

Since the image forming apparatus, the image forming method and the process cartridge of the present invention respectively use the toner of the present invention, they respectively allow for forming extremely high-quality images with no change in color tone being recognized and with no abnormal images such as a reduction in image density and background smear being observed for a long period of time.

The present invention can solve the conventional problems and can provide a toner that is excellent in all of the low-temperature fixing property, anti-offset property, storage stability, mechanical strength, contamination resistance to developing devices, toner filming resistance to latent electrostatic image bearing members and carrier, and pulverizability and is capable of forming high-quality images for a long period of time. The present invention can also provide an image forming apparatus, an image forming method, and a process cartridge each of which uses the toner of the present invention and allows for forming extremely high-quality images with no change in color tone being recognized and with no abnormal images such as a reduction in image density and background smear being observed for a long period of time.

EXAMPLES

Hereinafter, the present invention will be further described in detail with reference to several Examples below, however, the present invention is not limited to the disclosed Examples.

In the following Examples and Comparative Examples, "softening point of resin", "softening point of rosin", "glass transition temperature (Tg) of resin and rosin", "acid value of resin and rosin", and "weight average particle diameter of toner" were measured as follows.

<Measurement of Softening Point of Resin>

Using FLOWTESTER (CFT-500D, manufactured by Shimazu Corporation), 1 g of a sample resin was heated at a temperature increase rate of 6° C./min under application of a load of 1.96 MPa by means of a plunger to push it out of a nozzle having a diameter of 1 mm and a length of 1 mm, and the amount of descent of the plunger of the FLOWTESTER with respect to temperature was plotted. The temperature at which one-half of the sample out-flowed was defined as the softening point of the resin sample.

<Measurement of Softening Point of Rosin>

(1) Preparation of Sample

Ten grams of rosin was fused on a hot plate at 170° C. for 2 hours. Subsequently, the rosin was naturally cooled in an opened state under the conditions of a temperature of 25° C. and a relative humidity of 50% for 1 hour and crushed by a coffee mill (NATIONAL MK-61M, manufactured by Matsushita Electric Industrial Co., Ltd.) for 10 seconds, thereby preparing a rosin sample.

(2) Measurement

Using FLOWTESTER (CFT-500D, manufactured by Shimazu Corporation), 1 g of a sample resin was heated at a temperature increase rate of 6° C./min under application of a load of 1.96 MPa by means of a plunger to push it out of a nozzle having a diameter of 1 mm and a length of 1 mm, and the amount of descent of the plunger of the FLOWTESTER with respect to temperature was plotted. The temperature at which one-half of the sample out-flowed was defined as the softening point of the rosin sample.

<Measurement of Glass Transition Temperature of Resin and Rosin>

Using a differential scanning calorimeter (DSC210, manufactured by Seiko Instruments Inc.), a weighed sample of 0.01 g to 0.02 g was put on an aluminum pan, the temperature of the sample was increased to 200° C., and then cooled at a temperature decreasing rate of 10° C./min from 200° C. to 0° C. When the temperature of the cooled sample was increased again at a temperature increasing rate of 10° C./min, a temperature at an intersection point between an extended line of the base line of temperatures lower than the maximum endothermic peak temperature and a tangent line showing the maximum inclination from the start-up point of the peak to the peak top was defined as the glass transition temperature of the sample.

<Measurement of Acid Value of Resin and Rosin>

The acid value of resins and rosins was measured according to the method described in JIS K0070. However, for only the solvent used in the measurement, a mixture solvent of acetone and toluene (acetone:toluene=1.1 (volume ratio)) was used instead of the mixture solvent of ethanol and ether defined in the JIS K0077.

<Weight Average Particle Diameter of Toner>

The weight average particle diameter ($D_4$) of toner was measured using a particle size measuring device ("MULTISIZER III", manufactured by Beckman Coulter Inc.) with an aperture diameter of 100 μm, and the measurement data was analyzed using analysis software (BECKMAN COULTER MULTISIZER 3 Ver. 3.51). Specifically, in a 100 mL of glass beaker, 0.5 mL of 10% by mass of a surfactant (benzene sulfonate, NEOGEN SC-A, manufactured by DAI-ICHI KOGYO SEIYAKU CO., LTD.) and 0.5 g of each toner were added and mixed using a micro spatula. Next, 80 mL of ion exchange water was added thereto. The obtained dispersion liquid was dispersed in an ultrasonic dispersion device (W-113MK-II, manufactured by HONDA ELECTRONICS) for 10 minutes. The dispersion liquid was subjected to a measurement of weight average particle diameter using the MULTISIZER III and using ISOTON III (manufactured by Beckman Coulter Inc.) as a diluent for measurement. In the measurement, the toner sample dispersion liquid was delivered by drops so that the concentration indicated by the device was 8% by mass±2% by mass. In this measurement method, it is important to control the concentration within the range of 8% by mass±2% by mass, from the perspective of measurement reproductivity of particle diameter. Within the concentration range, it is possible to avoid measurement errors.

For channels used in the measurement, the following 13 channels were used: 2.00 μm or more and less than 2.52 μm; 2.52 μm or more and less than 3.17 μm; 3.17 μm or more and less than 4.00 μm; 4.00 μm or more and less than 5.04 μm; 5.04 μm or more and less than 6.35 μm; 6.35 μm or more and less than 8.00 μm; 8.00 μm or more and less than 10.08 μm; 10.08 μm or more and less than 12.70 μm; 12.70 μm or more and less than 16.00 μm; 16.00 μm or more and less than 20.20 μm; 20.20 μm or more and less than 25.40 μm; 25.40 μm or more and less than 32.00 μm; and 32.00 μm or more and less than 40.30 μm. Thus, particles having a particle diameter of 2.00 μm or more and less than 40.30 μm were intended for the measurement.

After measuring the weight of each toner, a weight distribution was calculated. The weight average particle diameter ($D_4$) of each toner was determined based on the weight distribution.

Synthesis Example 1

—Purification of Rosin—

In a 2,000 mL of distillation flask equipped with a fractionation column, a reflux condenser and a receiver, 1,000 g of tall rosin was added and distilled under a reduced pressure of 1 kPa to extract distilled parts obtained at the temperature range of 195° C. to 250° C. as main distilled parts. Hereinafter, the tall rosin used in the purification was referred to as "unpurified rosin", and the extracted rosin as main distilled parts was referred to as "purified rosin".

In a coffee mill (NATIONAL MK-61M, manufactured by Matsushita Electric Industrial Co., Ltd.), 20 g of each rosin was crushed for 5 seconds, filtered through a screen with opening diameter of 1 mm, and 0.5 g of the filtered rosin was weighed and put in a head space vial (20 mL). The head space gas was sampled, and impurities in the purified rosin were analyzed by the head space GC-MS method as follows. Table 1 shows the results.

<Measurement Conditions used in Head Space GC-MS Method>

A. Head Space Sampler (HP7694, Supplied from Agilent Inc.)

Sample temperature: 200° C.
Loop temperature: 200° C.
Transfer line temperature: 200° C.
Thermal equilibrium time of sample: 30 min
Pressurized gas into vial: helium (He)
Pressurizing time of vial: 0.3 min
Loop fill time: 0.03 min
Loop equilibrium time: 0.3 min
Injection time: 1 min B. GC (Gas Chromatography) (HP6890, Supplied from Agilent Inc.)

Analysis column: DB-1 (60 m-320 μm-5 μm)
Carrier: helium (He)
Flow rate: 1 mL/min
Inlet temperature: 210° C.
Column head pressure: 34.2 kPa
Injection mode: split
Spirit ratio: 10:1
Temperature conditions of oven: 45° C. (3 min)-10° C./min-280° C. (15 min)

C. MS (Mass Analysis Method (HP5973, Supplied from Agilent Inc.)

Ionization method: EI (electron ionization) method
Interface temperature: 280° C.
Ion source temperature: 230° C.
Quadrupole temperature: 150° C.
Detection mode: Scan 29 m/s to 350 m/s

TABLE 1

| | hexanoic acid | pentanoic acid | benzaldehyde | n-hexanol | 2-pentylfuran | Softening point (° C.) | Acid value (mgKOH/g) |
|---|---|---|---|---|---|---|---|
| Purified rosin | $0.6 \times 10^7$ | $0.4 \times 10^7$ | $0.4 \times 10^7$ | $1.6 \times 10^7$ | $1.9 \times 10^7$ | 75.0 | 167 |

Synthesis Example 2

—Synthesis 1 of Polyester Resin—

An alcohol component, terephthalic acid and an esterified catalyst used for Resins H1 to H3, H5 and H8 shown in Tables 2 and 3 were poured into a 5 L four-necked flask equipped with a nitrogen inlet tube, a dewatering tube, a rectifying column, a stirrer, and a thermocouple, and the components were subjected to a condensation polymerization reaction under a nitrogen atmosphere at 230° C. for 15 hours and then further reacted at 230° C. under a pressure of 8.0 kPa for 1 hour. After the reactant was cooled to 180° C., trimellitic anhydride was added thereto, and the temperature of the reaction mixture was increased to 210° C. in 3 hours. The reaction mixture was reacted under normal pressure (101.3 kPa) for 10 hours and then further reacted at 210° C. under a pressure of 20 kPa until the desired softening point was reached, thereby synthesizing each polyester resin (Resins H1 to H3, H5, and H8).

Synthesis Example 3

—Synthesis 2 of Polyester Resin—

An alcohol component, terephthalic acid and an esterified catalyst used for Resins H4, H6, H7 and L4 shown in Tables 2, 3 and 4 were poured into a 5 L four-necked flask equipped with a nitrogen inlet tube, a dewatering tube, a stirrer, and a thermocouple, and the components were subjected to a condensation polymerization reaction under a nitrogen atmosphere at 230° C. for 15 hours and then further reacted at 230° C. under a pressure of 8.0 kPa for 1 hour. After the reactant was cooled to 180° C., the purified rosin was added thereto, and the reaction mixture was reacted at 200° C. for 15 hours. After the reactant was cooled to 180° C., itaconic anhydride was added thereto, and the reaction mixture was reacted at 200° C. for 8 hours. The reactant was cooled to 180° C., and then trimellitic anhydride was added thereto, and the temperature of the reaction mixture was increased to 210° C. in 2 hours. Subsequently, the reaction mixture was further reacted at 210° C. under a pressure of 10 kPa until the desired softening point was reached, thereby synthesizing each polyester resin (Resins H4, H6, H7, and L4).

Synthesis Example 4

—Synthesis 3 of Polyester Resin—

An alcohol component, terephthalic acid and an esterified catalyst used for Resins H9, H10, L1 and L6 to L8 shown in Tables 3 and 4 were poured into a 5 L four-necked flask equipped with a nitrogen inlet tube, a dewatering tube, a rectifying column, a stirrer, and a thermocouple, and the components were subjected to a condensation polymerization reaction under a nitrogen atmosphere at 230° C. for 15 hours and then further reacted at 230° C. under a pressure of 20 kPa until the desired softening point was reached, thereby synthesizing each polyester resin (Resins H9, H10, L1, and L6 to L8).

Synthesis Example 5

—Synthesis 4 of Polyester Resin—

An alcohol component, terephthalic acid and an esterified catalyst used for Resin L2 shown in Tables 4 were poured into a 5 L four-necked flask equipped with a nitrogen inlet tube, a dewatering tube, a rectifying column, a stirrer, and a thermocouple, and the components were subjected to a condensation polymerization reaction under a nitrogen atmosphere at 230° C. for 15 hours and then further reacted at 230° C. under a pressure of 8.0 kPa for 1 hour. After the reactant was cooled to 180° C., itaconic acid was added thereto, and the reaction mixture was reacted at 200° C. for 8 hours. The reactant was cooled to 180° C., and then trimellitic anhydride was added thereto. The temperature of the reaction mixture was increased to 210° C. in 2 hours, and then the reaction mixture was reacted at 210° C. under a pressure of 10 kPa until the desired softening point was reached, thereby synthesizing a polyester resin (Resin L2).

Synthesis Example 6

—Synthesis 5 of Polyester Resin—

An alcohol component, terephthalic acid and an esterified catalyst used for Resin L3 shown in Tables 4 were poured into a 5 L four-necked flask equipped with a nitrogen inlet tube, a dewatering tube, a stirrer, and a thermocouple, and the components were subjected to a condensation polymerization reaction under a nitrogen atmosphere at 230° C. for 15 hours and then further reacted at 230° C. under a pressure of 8.0 kPa for 1 hour. After the reactant was cooled to 180° C., the purified rosin was added thereto, and the reaction mixture was reacted at 200° C. for 15 hours. The reaction mixture was cooled to 180° C., and then itaconic anhydride was added thereto. The temperature of the reaction mixture was increased to 210° C. in 2 hours, and then the reaction mixture was reacted at 210° C. under a pressure of 10 kPa until the desired softening point was reached, thereby synthesizing a polyester resin (Resin L3).

Synthesis Example 7

—Synthesis 6 of Polyester Resin—

An alcohol component, terephthalic acid and an esterified catalyst used for Resin L5 shown in Tables 4 were poured into a 5 L four-necked flask equipped with a nitrogen inlet tube, a dewatering tube, a stirrer, and a thermocouple, and the components were subjected to a condensation polymerization reaction under a nitrogen atmosphere at 230° C. for 15 hours and then further reacted at 230° C. under a pressure of 8.0 kPa for 1 hour. After the reactant was cooled to 180° C., the purified rosin was added thereto, and the temperature of the reaction mixture was increased to 210° C. in 3 hours. Subsequently, the reaction mixture was reacted at 210° C. under a pressure of 10 kPa until the desired softening point was reached, thereby synthesizing a polyester resin (Resin L5).

TABLE 2

| | | Resin H1 | Resin H2 | Resin H3 | Resin H4 | Resin H5 |
|---|---|---|---|---|---|---|
| Alcohol component | 1,3-propanediol | | | 228 g (20) | 228 g (20) | 228 g (20) |
| | 1,2-propanediol | 1,141 g (100) | 913 g (80) | 913 g (80) | 913 g (80) | 913 g (80) |
| | 2,3-butanediol | | | | | |
| | glycerin | | 276 g (20) | 276 g (20) | 276 g (20) | |
| Carboxylic acid component | terephthalic acid | 1,744 g (70) | 1,246 g (50) | 2,118 g (85) | 2,118 g (85) | 1,869 g (75) |
| | itaconic acid | | | | 195 g (10) | |
| | trimellitic anhydride | 288 g (10) | 576 g (20) | 144 g (5) | 144 g (5) | 144 g (5) |
| | purified rosin | | | | 454 g (10) | |
| Esterified catalyst | dibutyltin oxide | | | | | |
| | tin (II) dioctanoate | 16 g | 15 g | 18 g | 22 g | 16 g |
| Properties of Polyester | Softening point (A) (° C.) | 150.8 | 144.2 | 145.3 | 144.5 | 122.1 |
| | Grass transition temperature (° C.) | 65.3 | 60.8 | 63.2 | 62.5 | 60.2 |
| | Acid value (mgKOH/g) | 41.7 | 49.4 | 32.3 | 35.0 | 42.9 |
| Ratio of 1,2-propanediol in alcohol component (mole %) | | 100.0 | 80.0 | 66.7 | 66.7 | 80.0 |

TABLE 3

| | | Resin H6 | Resin H7 | Resin H8 | Resin H9 | Resin H10 |
|---|---|---|---|---|---|---|
| Alcohol component | 1,3-propanediol | 228 g (20) | | 571 g (50) | 1,141 g (100) | |
| | 1,2-propanediol | 913 g (80) | 1,141 g (100) | 571 g (50) | | |
| | 2,3-butanediol | | | | | 1,352 g (100) |
| | glycerin | 276 g (20) | | | | |
| Carboxylic acid component | terephthalic acid | 1,495 g (60) | 1,495 g (60) | 1,744 g (70) | 1,994 g (80) | 1,994 g (80) |
| | itaconic acid | 195 g (10) | 195 g (10) | | | |
| | trimellitic anhydride | 865 g (30) | 865 g (30) | 288 g (10) | | |
| | purified rosin | 454 g (10) | 454 g (10) | | | |

TABLE 3-continued

| | | Resin H6 | Resin H7 | Resin H8 | Resin H9 | Resin H10 |
|---|---|---|---|---|---|---|
| Esterified catalyst | dibutyltin oxide | | | | 16 g | 17 g |
| | tin (II) dioctanoate | 22 g | 21 g | 16 g | | |
| Properties of Polyester | Softening point (A) (° C.) | 159.0 | 167.1 | 123.7 | 73.3 | 121.5 |
| | Grass transition temperature (° C.) | 63.7 | 66.0 | 59.7 | 31.1 | 49.9 |
| | Acid value (mgKOH/g) | 33.4 | 42.6 | 40.6 | 45.2 | 43.6 |
| Ratio of 1,2-propanediol in alcohol component (mole %) | | 66.7 | 100.0 | 50.0 | 0.0 | 0.0 |

* The numerical value in the parentheses shown in use amount of "alcohol component" and "carboxylic acid component" is the unit of molar ratio.
* The use amount of the esterified catalyst is 0.5 parts by mass to 100 parts by mass of the total amount of alcohol components and carboxylic acid components.

TABLE 4

| | | Resin L1 | Resin L2 | Resin L3 | Resin L4 | Resin L5 | Resin L6 | Resin L7 | Resin L8 |
|---|---|---|---|---|---|---|---|---|---|
| Alcohol component | 1,3-propanediol | | | | | 342 g (30) | 1,141 g (100) | | 399 g (35) |
| | 1,2-propanediol | 1,141 g (100) | 1,141 g (100) | 913 g (80) | 1,141 g (100) | 571 g (50) | | | 742 g (65) |
| | 2,3-butanediol | | | | | | | 1,352 g (100) | |
| | glycerin | | | 276 g (20) | | 276 g (20) | | | |
| Carboxylic acid component | terephthalic acid | 1,994 g (80) | 1,869 g (75) | 1,744 g (70) | 1,869 g (75) | 1,744 g (70) | 1,744 g (70) | 1,744 g (70) | 1,744 g (70) |
| | itaconic acid | | 293 g (15) | 293 g (15) | 293 g (15) | | | | |
| | trimellitic anhydride | | 144 g (5) | | 144 g (5) | | | | |
| | purified rosin | | | 1,316 g (29) | 907 g (20) | 907 g (20) | | | |
| Esterified catalyst | dibutyltin oxide | | | | | | 14 g | 15 g | |
| | tin (II) dioctanoate | 16 g | 17 g | 23 g | 22 g | 19 g | | | 14 g |
| Properties of Polyester | Softening point (A) (° C.) | 105.0 | 118.2 | 107.0 | 126.1 | 102.3 | 86.2 | 80.5 | 78.8 |
| | Grass transition temperature (° C.) | 58.5 | 60.1 | 58.8 | 61.8 | 56.1 | 40.8 | 38.9 | 50.2 |
| | Acid value (mgKOH/g) | 30.9 | 35.6 | 38.8 | 40.2 | 34.0 | 35.2 | 32.8 | 39.5 |
| Ratio of 1,2-propanediol in alcohol component (mole %) | | 100.0 | 100.0 | 80.0 | 100.0 | 50.0 | 0.0 | 0.0 | 65.0 |

Synthesis Example 8

—Synthesis 7 of Polyester Resin—

Into a 5 L four-necked flask equipped with a nitrogen inlet tube, a dewatering tube, a stirrer, and a thermocouple, 9 mol of terephthalic acid, 7 mol of bisphenol A (2,2) propylene oxide, 3 mol of bisphenol A (2,2) ethylene oxide, and 48 mol of dibutyltin oxide as an esterified catalyst were poured, and the components were subjected to a condensation polymerization reaction under a nitrogen atmosphere at 230° C. for 15 hours. Subsequently, the reactant was further reacted at 230° C. under a pressure of 20 kPa for 1 hour, thereby synthesizing a polyester resin (Resin L9).

The obtained Resin L9 had a softening point of 100.3° C., a glass transition temperature of 60.5° C. and an acid value of 11.2 mgKOH/g.

Synthesis Example 9

—Synthesis 8 of Polyester Resin—

Into a 5 L four-necked flask equipped with a nitrogen inlet tube, a dewatering tube, a stirrer, and a thermocouple, 9 mol of terephthalic acid, 6 mol of bisphenol A (2,2) propylene oxide, 4 mol of bisphenol A (2,2) ethylene oxide, and 63 mol of dibutyltin oxide as an esterified catalyst were poured, and the components were subjected to a condensation polymerization reaction under a nitrogen atmosphere at 230° C. for 15 hours. Subsequently, the reactant was further reacted at 230° C. under a pressure of 8.0 kPa for 1 hour. After the reactant was cooled to 180° C., 6 mol of trimellitic anhydride was added thereto, and the temperature of the reaction mixture was increased to 210° C. in 3 hours. The reaction mixture was reacted under normal pressure (101.3 kPa) for 10 hours and then further reacted at 210° C. under a pressure of 20 kPa until the desired softening point was reached, thereby synthesizing a polyester resin (Resin H11).

The obtained Resin H11 had a softening point of 146.0° C., a glass transition temperature of 62.1° C. and an acid value of 28.0 mgKOH/g.

Synthesis Example 10

—Synthesis 1 of Composite Resin—

Into a 5 L four-necked flask equipped with a nitrogen inlet tube, a dewatering tube, a stirrer, a drip funnel and a thermocouple, 0.8 mol of terephthalic acid, 0.6 mol of fumaric acid, 0.8 mol of trimellitic anhydride, 1.1 mol of bisphenol A (2,2) propylene oxide and 0.5 mol of bisphenol A (2,2) ethylene oxide each as a condensation polymerization monomer, and 9.5 mol of a dibutyltin oxide as an esterified catalyst were poured. Then, 10.5 mol of styrene, 3 mol of acrylic acid and 1.5 mol of 2-ethylhexyl acrylate each as an addition polymerization monomer, and 0.24 mol of t-butylhydro-peroxide as a polymerization initiator were poured into the drip funnel. The mixture of the addition polymerization monomers was delivered by drops in 5 hours while stirring the components in the flask under a nitrogen atmosphere at 135° C., and the mixture was reacted at 135° C. for 6 hours. The temperature of the reaction mixture was increased to 210° C. in 3 hours, and the reaction mixture was further reacted at 210° C. under a pressure of 10 kPa until the desired softening point was reached, thereby synthesizing a composite resin (Resin HB1).

The obtained Resin HB1 had a softening point of 115.4° C., a glass transition temperature of 57.6° C. and an acid value of 25.3 mgKOH/g.

Synthesis Example 11

—Synthesis 2 of Composite Resin—

Into a 5 L four-necked flask equipped with a nitrogen inlet tube, a dewatering tube, a stirrer, a drip funnel and a thermocouple, 2.3 mol of terephthalic acid, 1.8 mol of fumaric acid, 2.3 mol of trimellitic anhydride, 1.8 mol of bisphenol A (2,2) propylene oxide, 1.4 mol of bisphenol A (2,2) ethylene oxide and 1.4 mol of 1,2-propanediol each as a condensation polymerization monomer, and 27.5 mol of a dibutyltin oxide as an esterified catalyst were poured. Then, 10.5 mol of styrene, 3 mol of acrylic acid and 1.5 mol of 2-ethylhexyl acrylate each as an addition polymerization monomer, and 0.24 mol of t-butylhydro-peroxide as a polymerization initiator were poured into the drip funnel. The mixture of the addition polymerization monomers was delivered by drops in 5 hours while stirring the components in the flask under a nitrogen atmosphere at 135° C., and the mixture was reacted at 135° C. for 6 hours. The temperature of the reaction mixture was increased to 210° C. in 3 hours, and the reaction mixture was further reacted at 210° C. under a pressure of 10 kPa until the desired softening point was reached, thereby synthesizing a composite resin (Resin HB2).

The obtained Resin HB2 had a softening point of 117.3° C., a glass transition temperature of 57.9° C. and an acid value of 30.6 mgKOH/g.

Synthesis Example 12

—Synthesis 3 of Composite Resin—

Into a 5 L four-necked flask equipped with a nitrogen inlet tube, a dewatering tube, a stirrer, a drip funnel and a thermocouple, 0.6 mol of terephthalic acid, 0.6 mol of fumaric acid, and 0.8 mol of 1,2-propanediol each as a condensation polymerization monomer, and 5 mol of a dibutyltin oxide as an esterified catalyst were poured. Then, 10.5 mol of styrene, 3 mol of acrylic acid and 1.5 mol of 2-ethylhexyl acrylate each as an addition polymerization monomer, and 0.24 mol of t-butylhydro-peroxide as a polymerization initiator were poured into the drip funnel. The mixture of the addition polymerization monomers was delivered by drops in 5 hours while stirring the components in the flask under a nitrogen atmosphere at 135° C., and the mixture was reacted at 135° C. for 6 hours. The temperature of the reaction mixture was increased to 210° C. in 3 hours, and the reaction mixture was further reacted at 210° C. under a pressure of 10 kPa until the desired softening point was reached, thereby synthesizing a composite resin (Resin HB3).

The obtained Resin HB3 had a softening point of 89.4° C., a glass transition temperature of 54.3° C. and an acid value of 42.1 mgKOH/g.

Production Example 1

—Production of Masterbatch 1—

A pigment with the following composition, Resin L1 and pure water were mixed at a ratio of 1:1:0.5 (mass ratio), and then kneaded using a two-roll at 70° C. Subsequently, the roll temperature was increased to 120° C. to evaporate water, thereby preparing Masterbatch 1 (MB1) composed of cyan toner masterbatch 1, magenta toner masterbatch 1, yellow toner masterbatch, and a black toner masterbatch 1.

| [Formulation of Cyan Toner Masterbatch 1] | |
|---|---|
| Resin L1 | 100 parts by mass |
| cyan pigment (C.I. Pigment blue 15:3) | 100 parts by mass |
| pure water | 50 parts by mass |
| [Formulation of Magenta Toner Masterbatch 1] | |
| Resin L1 | 100 parts by mass |
| magenta pigment (C.I. Pigment red 122) | 100 parts by mass |
| pure water | 50 parts by mass |
| [Formulation of Yellow Toner Masterbatch 1] | |
| Resin L1 | 100 parts by mass |
| yellow pigment (C.I. Pigment yellow 180) | 100 parts by mass |
| pure water | 50 parts by mass |
| [Formulation of Black Toner Masterbatch 1] | |
| Resin L1 | 100 parts by mass |
| black pigment (carbon black) | 100 parts by mass |
| pure water | 50 parts by mass |

Further, Masterbatches 2 to 9 (MB2 to MB9) composed of cyan toner masterbatches 2 to 9, magenta toner masterbatches 2 to 9, yellow toner masterbatches 2 to 9 and black toner masterbatches 2 to 9 were respectively produced in the same manner as in the Production Example 1 except that Resins L2 to L9 were individually used instead of Resin L1.

Production Example 2

—Production of Carrier—

A carrier used in a two-component developer was produced as follows.

A coating material with the following composition was dispersed using a stirrer for 10 minutes to prepare a coating solution, and the coating solution and 5,000 parts by mass of a core material (Mn ferrite particle, mass average particle diameter=35 μm) were put into a coating device equipped with a rotatable bottom plate disc and a stirring blades in a fluidized bed to perform coating while forming swirling flow, whereby the coating solution was applied over the surface of the core material. Thus obtained coated material was calcined in an electric furnace at 250° C. for 2 hours, thereby producing a carrier.

| [Composition of Coating Material] | |
|---|---|
| toluene | 450 parts by mass |
| silicone resin (SR2400, manufactured by Toray Daw | 450 parts by mass |

-continued

| [Composition of Coating Material] | |
|---|---|
| Corning Silicone K.K.; non-volatile matter: 50% by mass) | |
| aminosilane (SH6020, manufactured by Toray Daw Corning Silicone K.K.) | 10 parts by mass |
| carbon black | 10 parts by mass |

Example 1

—Production of Toner 1—

As described below, Toner 1 composed of cyan toner 1, magenta toner 1, yellow toner 1 and black toner 1 was produced.

—Production of Cyan Toner 1—

Forty parts by mass of polyester resin (A), 40 parts by mass of polyester resin (B), 10 parts by mass of composite resin (C), 5 parts by mass of a releasing agent and 20 parts by mass of the cyan masterbatch from the prepared four-color masterbatches of initial materials used for Toner 1 shown in Table 5-A, were premixed using a HENSCHEL MIXER (FM10B, manufactured by Mitsui Miike Chemical Machine Co., Ltd.), and then the premix was fused and kneaded at a temperature ranging from 100° C. to 130° C. using a biaxial kneader (PCM-30, manufactured by IKEGAI Co., Ltd.). The thus obtained kneaded product was cooled to room temperature and then coarsely crushed into granules of 200 μm to 300 μm in size using a hammer mill. Subsequently, the granules were pulverized so as to have a weight average particle diameter of 6.2 μm±0.3 μm while appropriately controlling the pulverization air pressure using an ultrasonic jet pulverizer, LABO-JET (manufactured by Nippon Pneumatic Mfg. Co., Ltd.) and then classified using an airflow classifier (MDS-I, manufactured by Nippon Pneumatic Mfg. Co., Ltd.) while appropriately controlling the louver opening such that toner particles had a weight average particle diameter of 6.8 μm±0.3 μm and the amount of fine particles having a weight average particle diameter of 4 μm or less was 10% by number or less, thereby obtaining a toner base particle. Next, 1.0 part by mass of an additive (HDK-2000, manufactured by Clariant Japan K.K.) was stirred and mixed with 100 parts by mass of the toner base particle in a HENSCHEL MIXER, thereby producing Cyan Toner 1.

The mass ratio [(A)/(B)] of polyester resin (A) to polyester resin (B), the mass ratio [(C)/((A)+(B))] of composite resin (C) to sum of the polyester resins (A) and (B) used in the obtained toner, and the difference [Tm (A)−Tm (B)] of the softening point Tm (A) of the polyester resin (A) minus the softening point Tm (B) of the polyester resin (B) are shown in Table 5-A.

Note that in FIG. 5, "W1" represents a releasing agent of a paraffin wax (HNP-9PD, manufactured by Nippon Seiro Co., Ltd.; melting point: 76.1° C.), and "W2" represents a free fatty acid-removed type carnauba wax (WA-03, manufactured by TOA KASEI CO., LTD.; melting point: 82.8° C.).

—Production of Magenta Toner 1—

Magenta Toner 1 was produced in the same manner as in the production method of Cyan Toner 1 except that the magenta masterbatch was used instead of the cyan masterbatch from the prepared four-color masterbatches of initial materials used for Toner 1 shown in Table 5-A.

—Production of Yellow Toner 1—

Yellow Toner 1 was produced in the same manner as in the production method of Cyan Toner 1 except that the yellow masterbatch was used instead of the cyan masterbatch from the prepared four-color masterbatches of initial materials used for Toner 1 shown in Table 5-A.

—Production of Black Toner—

Black Toner 1 was produced in the same manner as in the production method of Cyan Toner 1 except that the black masterbatch was used instead of the cyan masterbatch from the prepared four-color masterbatches of initial materials used for Toner 1 shown in Table 5-A.

Examples 2 to 13 and Comparative Examples 1 to 10

—Production of Toners 2 to 23—

Toners 2 to 23 composed of each of cyan toners 2 to 23, magenta toners 2 to 23, yellow toners 2 to 23 and black toners 2 to 23 were respectively produced with a combination of initial materials shown in Tables 5-A and 5-B.

The mass ratio [(A)/(B)] of polyester resin (A) to polyester resin (B), the mass ratio [(C)/((A)+(B))] of composite resin (C) to sum of the polyester resins (A) and (B) used for the obtained each toner, and the difference [Tm (A)−Tm (B)] of the softening point Tm (A) of the polyester resin (A) minus the softening point Tm (B) of the polyester resin (B) are shown in Tables 5-A and 5-B.

Example 15

—Production of Toner 24—

Toner 24 composed of cyan toner 24, magenta toner 24, yellow toner 24 and black toner 24 was produced with a combination of initial materials shown in Table 5-B in the same manner as in Production of Toner 1 in Example 1 except that the amounts of the polyester resin (A), polyester resin (B) and composite resin (C) of initial materials used for Toner 24 shown in Table 5-B were changed to 43.6 parts by mass, 44.4 parts by mass and 2 parts by mass, respectively.

The mass ratio [(A)/(B)] of polyester resin (A) to polyester resin (B), the mass ratio [(C)/((A)+(B))] of composite resin (C) to sum of the polyester resins (A) and (B) used for the obtained toner, and the difference [Tm (A)−Tm (B)] of the softening point Tm (A) of the polyester resin (A) minus the softening point Tm (B) of the polyester resin (B) are shown in Table 5-B.

Example 16

—Production of Toner 25—

Toner 25 composed of cyan toner 25, magenta toner 25, yellow toner 25 and black toner 25 was produced with a combination of initial materials shown in Table 5-B in the same manner as in Production of Toner 1 in Example 1 except that the amounts of the polyester resin (A), polyester resin (B) and composite resin (C) of initial materials used for Toner 25 shown in Table 5-B were changed to 33.3 parts by mass, 31.7 parts by mass and 25 parts by mass, respectively.

The mass ratio [(A)/(B)] of polyester resin (A) to polyester resin (B), the mass ratio [(C)/((A)+(B))] of composite resin (C) to sum of the polyester resins (A) and (B) used for the obtained toner, and the difference [Tm (A)−Tm (B)] of the softening point Tm (A) of the polyester resin (A) minus the softening point Tm (B) of the polyester resin (B) are shown in Table 5-B.

—Production of Toner 26—

Toner 26 composed of cyan toner 26, magenta toner 26, yellow toner 26 and black toner 26 was produced with a combination of initial materials shown in Table 5-B in the same manner as in Production of Toner 1 in Example 1 except that the amount of the releasing agent of an initial material used for Toner 26 shown in Table 5-B was changed to 1 part by mass.

The mass ratio [(A)/(B)] of polyester resin (A) to polyester resin (B), the mass ratio [(C)/((A)+(B))] of composite resin (C) to sum of the polyester resins (A) and (B) used for the obtained toner, and the difference [Tm (A)−Tm (B)] of the softening point Tm (A) of the polyester resin (A) minus the softening point Tm (B) of the polyester resin (B) are shown in Table 5-B.

—Production of Toner 27—

Toner 27 composed of cyan toner 27, magenta toner 27, yellow toner 27 and black toner 27 was produced with a combination of initial materials shown in Table 5-B in the same manner as in Production of Toner 1 in Example 1 except that the amount of the releasing agent of an initial material used for Toner 27 shown in Table 5-B was changed to 20 part by mass.

The mass ratio [(A)/(B)] of polyester resin (A) to polyester resin (B), the mass ratio [(C)/((A)+(B))] of composite resin (C) to sum of the polyester resins (A) and (B) used for the obtained toner, and the difference [Tm (A)−Tm (B)] of the softening point Tm (A) of the polyester resin (A) minus the softening point Tm (B) of the polyester resin (B) are shown in Table 5-B.

TABLE 5-A

| | Initial Material | | | | | Mass | | |
|---|---|---|---|---|---|---|---|---|
| | Polyester resin (A) | Polyester resin (B) | Composite resin (C) | Releasing agent | Masterbatch | ratio [(A)/(B)] | Mass ratio [(C)/(A + B)] | Tm (A) − Tm (B) (C°) |
| Toner 1 | H1 | L6 | HB1 | W1 | MB6 | 40/50 | 10/90 | 64.6 |
| Toner 2 | H5 | L6 | HB1 | W1 | MB6 | 40/50 | 10/90 | 35.9 |
| Toner 3 | H6 | L6 | HB1 | W1 | MB6 | 40/50 | 10/90 | 72.8 |
| Toner 4 | H8 | L1 | HB1 | W1 | MB1 | 40/50 | 10/90 | 18.7 |
| Toner 5 | H8 | L2 | HB1 | W1 | MB2 | 40/50 | 10/90 | 5.5 |
| Toner 6 | H1 | L1 | HB1 | W1 | MB1 | 40/50 | 10/90 | 45.8 |
| Toner 7 | H2 | L1 | HB1 | W1 | MB1 | 40/50 | 10/90 | 39.2 |
| Toner 8 | H3 | L1 | HB1 | W1 | MB1 | 40/50 | 10/90 | 40.3 |
| Toner 9 | H4 | L1 | HB1 | W1 | MB1 | 40/50 | 10/90 | 39.5 |
| Toner 10 | H4 | L3 | HB1 | W1 | MB3 | 40/50 | 10/90 | 37.5 |
| Toner 11 | H4 | L3 | HB2 | W1 | MB3 | 40/50 | 10/90 | 37.5 |
| Toner 12 | H4 | L3 | HB3 | W1 | MB3 | 40/50 | 10/90 | 37.5 |
| Toner 13 | H4 | L3 | HB1 | W2 | MB3 | 40/50 | 10/90 | 37.5 |

* "W1" represents a paraffin wax (HNP-9PD, manufactured by Nippon Seiro Co., Ltd.; melting point: 76.1° C.).
* "W2" represents a free fatty acid-removed type carnauba wax (WA-03, manufactured by TOA KASEI CO., LTD.; melting point: 82.8° C.).

TABLE 5-B

| | Initial Material | | | | | Mass | | |
|---|---|---|---|---|---|---|---|---|
| | Polyester resin (A) | Polyester resin (B) | Composite resin (C) | Releasing agent | Masterbatch | ratio [(A)/(B)] | Mass ratio [(C)/(A + B)] | Tm (A) − Tm (B) (° C.) |
| Toner 14 | H7 | L1 | HB1 | W1 | MB1 | 40/50 | 10/90 | 62.1 |
| Toner 15 | H8 | L5 | HB1 | W1 | MB5 | 40/50 | 10/90 | 21.4 |
| Toner 16 | H9 | L1 | HB1 | W1 | MB1 | 40/50 | 10/90 | −31.7 |
| Toner 17 | H1 | L4 | HB1 | W1 | MB4 | 40/50 | 10/90 | 24.7 |
| Toner 18 | H10 | L7 | HB1 | W1 | MB7 | 40/50 | 10/90 | 41.0 |
| Toner 19 | H4 | L3 | Not used | W1 | MB3 | 40/50 | — | 37.5 |
| Toner 20 | H4 | L3 | Not used | W2 | MB3 | 40/50 | — | 37.5 |
| Toner 21 | H11 | L9 | HB1 | W1 | MB9 | 40/50 | 10/90 | 45.7 |
| Toner 22 | H11 | L9 | Not used | W1 | MB9 | 40/50 | — | 45.7 |
| Toner 23 | H1 | L8 | HB1 | W1 | MB8 | 40/50 | 10/90 | 72.0 |
| Toner 24 | H4 | L3 | HB1 | W1 | MB3 | 40/50 | 2/98 | 37.5 |
| Toner 25 | H4 | L3 | HB1 | W1 | MB3 | 40/50 | 25/75 | 37.5 |
| Toner 26 | H4 | L3 | HB1 | W1 | MB3 | 40/50 | 10/90 | 37.5 |
| Toner 27 | H4 | L3 | HB1 | W1 | MB3 | 40/50 | 10/90 | 37.5 |

* "W1" represents a paraffin wax (HNP-9PD, manufactured by Nippon Seiro Co., Ltd.; melting point: 76.1° C.).
* "W2" represents a free fatty acid-removed type carnauba wax (WA-03, manufactured by TOA KASEI CO., LTD.; melting point: 82.8° C.).

<Production of Two-Component Developer>

As a carrier used for a two-component developer, the produced ferrite carrier (an Mn ferrite particle with a mass average particle diameter of 35 μm coated with a silicone resin with an average thickness of 0.5 μm) was used. In a tabular mixer of the type which stirs contents therein by the rolling of the container itself (Turbula mixer, manufactured by WAB AG), 7 parts by mass of toner were mixed with 100 parts by mass of the carrier uniformly for 3 minutes at 48 rpm to charge the toner.

<Evaluation of Toner Properties>

The thus obtained Toners 1 to 27 were evaluated as to pulverizability and heat resistance-storage stability. Tables 6-A and 6-B show the evaluation results.

—Measurement of Pulverizability—

Among each of the toners, a fused and kneaded product of the black toner formulation was coarsely crushed into granules by a hammer mill so as to have a particle diameter of 200 μm to 300 μm, 10.00 g of the coarse granules was precisely weighed and pulverized for 30 seconds using a mill-mixer, model MM-I (available from Hitachi Living Systems) and then sieved through a 30 mesh screen (opening: 500 μm). The mass (A) of the unpassed remainder (grams) was precisely weighed, and a residual rate was determined based on the following Equation (i). This process was repeated three times, and the average value of obtained residual rates was used as an indicator to thereby evaluate the pulverizability of each of the toners according to the following evaluation criteria. Smaller average value of residual rate is more preferable from the viewpoint of pulverizability.

$$\text{Residual rate}[(A)/\text{mass of unpulverized resin}(10.00\ g)]\times 100 \qquad \text{<<Equation (i)>>}$$

[Evaluation Criteria]

A: The residual rate was less than 5%.

B: The residual rate was 5% or more and less than 10%.

C: The residual rate was 10% or more and less than 15%.

D: The residual rate was 15% or more and less than 20%.

E: The residual rate was 20% or more.

—Heat Resistance-Storage Stability—

The heat resistance-storage stability of each of the toners was measured using a penetration tester (manufactured by Nikka Engineering Co., Ltd.). Specifically, 10 g of each of the toners was weighed and put into a 30 mL glass vial (screw vial) under the conditions of a temperature of 20° C. to 25° C. and a relative humidity (RH) of 40% to 60%, and the vial was closed with a lid.

The glass vial with the toner contained therein was tapped 100 times and then left intact in a thermostatic bath whose temperature was held at 50° C. for 24 hours, the penetration rate of the toner was measured using the penetration tester (manufactured by Nikka Engineering Co., Ltd.), and the heat resistance-storage stability of the toner was evaluated based on the following evaluation criteria. Higher penetration rate is more preferable from the viewpoint of heat resistance-storage stability. Note that among the measurement results of four-color toners, the worst result was used for the evaluation value.

[Evaluation Criteria]

A: The penetration rate was 30 mm or more.

B: The penetration rate was 20 mm to 29 mm.

C: The penetration rate was 15 mm to 19 mm.

D: The penetration rate was 8 mm to 14 mm.

E: The penetration rate was 7 mm or less.

<Image Formation and Evaluation>

Figure 20:
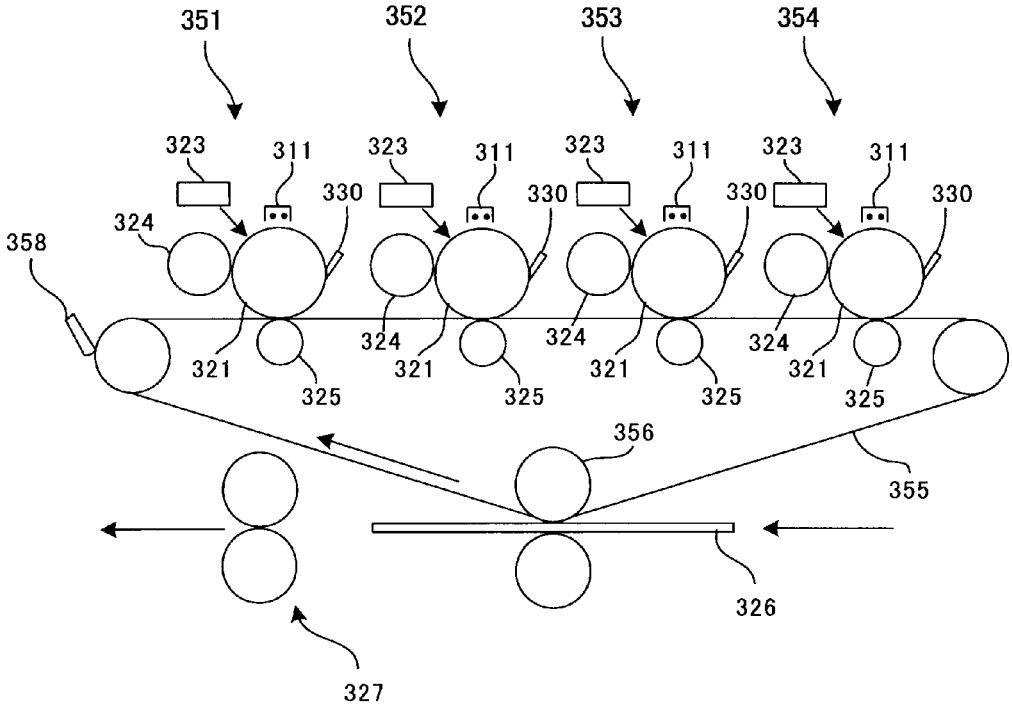
FIG. 20 is a schematic view showing the image forming apparatus (evaluation apparatus A) used in Examples of the present invention.

An image forming apparatus (evaluation apparatus A) as shown in FIG. 20 was filled with each of the produced two-component developers to perform image formation, and each of the developers was evaluated as to respective properties as described below. Tables 6-A, 6-B, 7-A and 7-B show the evaluation results.

[Evaluation Apparatus A]

The image forming apparatus (evaluation apparatus A) shown in FIG. 20 is an indirect transfer type tandem image forming apparatus adopting non-contact charging method, two-component developing method, secondary transfer method, blade cleaning method and roller fixing method based on external heating mode.

The image forming apparatus (evaluation apparatus A) shown in FIG. 20 employs a non-contact type corona charger as shown in FIG. 3 as a charging unit 311, a two-component developing device as shown in FIG. 6 as a developing unit 324, a cleaning blade as shown in FIG. 13 as a cleaning unit 330, and a roller fixing device based on electromagnetic induction heating mode as shown in FIG. 12 as a fixing device 327.

As an image forming element 351 of the image forming apparatus (evaluation apparatus A) shown in FIG. 20, around the periphery of a photoconductor drum 321, the charging unit 311, an exposing unit 323, the developing unit 324, a primary transfer unit 325, and the cleaning unit 330 are arranged. The photoconductor drum 321 in the image forming element 351 rotates to form a latent electrostatic image corresponding to an exposed image on its surface thereof by charging from the charging unit 310 and the exposure from the exposing unit 323. The latent electrostatic image is developed with a yellow toner by the developing unit 324, and a yellow toner visible image is formed on the surface of the photoconductor drum 321. The visible image is transferred onto an intermediate transfer belt 355 by the primary transfer unit 325, and a residual yellow toner remaining on the surface of the photoconductor drum 321 is removed by the cleaning unit 330. Similarly, visible images of magenta toner, cyan toner and black toner are superimposed on the surface of the intermediate transfer belt 355 by each of the image forming elements 352, 353, and 354 to form a color image. Then, a color image formed on the surface of the intermediate transfer belt 355 is transferred onto a recording medium 326 by a transfer device 356, and a residual toner remaining on the surface of the intermediate transfer belt 355 is removed by an intermediate transfer belt cleaning unit 358. The color image formed on the recording medium 326 is fixed by the fixing unit 327.

<Low-Temperature Fixing Property>

Using the evaluation apparatus A, a solid image with a toner adhesion amount of 0.85 $mg/cm^2 \pm 0.1\ mg/cm^2$ was formed on an image transfer sheet of heavy paper (copy print paper <135>, manufactured by NBS Ricoh Company Ltd.), and the image was fixed with varying the temperature of the fixing belt. The obtained fixed image surface was printed with a ruby needle printing head (tip radius: 260 μmR to 320 μmR, tip angle: 60 degrees) under application of a load of 50 g using an image tester (AD-401, manufactured by Ueshima Seisakusho Co., Ltd.). Then, the image surface was strongly abraded with a fabric (HANEYCOT #440, manufactured by Hanylon Co., Ltd.) 5 times, and the temperature of the fixing belt at which almost no image delamination was caused was regarded as the image fixing lower limit temperature. Each of the toners was evaluated as to low-temperature fixing property based on the following criteria. Note that the solid image was formed at a position of 3.0 cm from the end of the image transfer sheet in the paper passing direction.

[Evaluation Criteria]

A: The image fixing lower limit temperature was 120° C. or less.

B: The image fixing lower limit temperature was 121° C. to 130° C.

C: The image fixing lower limit temperature was 131° C. to 145° C.

D: The image fixing lower limit temperature was 146° C. to 155° C.

E: The image fixing lower limit temperature was 156° C. or more.

<Anti-Hot Offset Property>

Using the evaluation apparatus A, a solid image with a toner adhesion amount of 0.85 $mg/cm^2 \pm 0.1$ $mg/cm^2$ was formed on an image transfer sheet of regular paper (Type 6200, manufactured by Ricoh Company Ltd.), and a fixing test was conducted with varying the temperature of the fixing belt. The presence or absence of hot offset was visually checked and evaluated, and the highest temperature at which no hot-offset was caused was regarded as the image fixing upper limit temperature, and each of the toners was evaluated based on the following criteria. Note that the solid image was formed at a position of 3.0 cm from the end of the image transfer sheet in the paper passing direction.

[Evaluation Criteria]

A: The image fixing upper limit temperature was 230° C. or more.

B: The image fixing upper limit temperature was 210° C. to 230° C.

C: The image fixing upper limit temperature was 190° C. to 210° C.

D: The image fixing upper limit temperature was 180° C. to 190° C.

E: The image fixing upper limit temperature was less than 180° C.

<Fixing-Releasing Property>

Using the evaluation apparatus A, a solid image with a toner adhesion amount of 0.85 $mg/cm^2 + 0.1$ $mg/cm^2$ was formed on an image transfer sheet of regular paper (Type 6200, manufactured by Ricoh Company Ltd. (wales direction)), and a fixing test was conducted with varying the temperature of the fixing belt. The level of scratches caused by the contact of the fixed image on the sheet ejected in the horizontal direction "A4" with a separation blade placed for separating fixed paper from the fixing belt near the outlet of the fixing nip was visually checked and evaluated. The level of scratches was ranked into 5 levels based on rank samples, and the upper limit temperature at which no scratch occurred was used as an indicator. Note that the solid image was formed at a position of 0.5 cm from the end of the image transfer sheet in the paper passing direction.

[Evaluation Criteria]

A: The upper limit temperature was 210° C. or higher.

B: The upper limit temperature was 201° C. or higher and lower than 210° C.

C: The upper limit temperature was 181° C. or higher and lower than 200° C.

D: The upper limit temperature was 161° C. or higher and lower than 180° C.

E: The upper limit temperature was lower than 160° C.

<Initial Image Quality>

The image chart was output in the full-color mode using the evaluation apparatus A, and the initial image quality was evaluated depending on presence or absence of a change in color tone (tint), fog of image, a change in image density, and streaking in the output print. The presence or absence of abnormal image, and the image quality were visually checked and ranked into the following 5 levels to thereby evaluate the initial image quality.

[Evaluation Criteria]

A: No abnormal image was observed, and the image quality was excellent.

B: A slight amount of change in color tone and image density, and background smear was observed as compared to the original image, nevertheless, the level caused no problem in practical use, and the image quality was excellent.

C: A somewhat amount of change in color tone (tint) and image density, and background smear was recognized.

D: Changes in color tone and image density, and background smear were clearly observed, which would cause a problem in practical use.

E: Change in color tone and image density, and background smear were conspicuous, making it impossible to obtain normal images.

<Stability with Time>

After running output of 50,000 sheets of an image chart with an 80% image area (20% image area for each color) in the full-color mode using the evaluation apparatus A, the image quality of the output sheets was evaluated in a similar manner to the evaluation of the initial image quality, and the output sheets were compared to the initial images and evaluated based on the following criteria.

[Evaluation Criteria]

A: No abnormal image was observed, and the image quality was excellent.

B: A slight amount of change in color tone and image density, and background smear was observed as compared to the initial image, nevertheless, the level caused no problem under normal temperature/humidity conditions.

C: A somewhat amount of change in color tone (tint) and image density, and background smear was recognized as compared to the initial image.

D: Changes in color tone and image density, and background smear were clearly observed as compared to the initial image, causing a problem.

E: Change in color tone and image density, and background smear were conspicuous as compared to the initial image, making it impossible to obtain normal images.

<Contamination of Developing Roller>

After running output of 100 sheets of an image chart with a 50% image area in the monochrome mode using the evaluation apparatus A, and after running output of 50,000 sheets of the image chart, the sticking state of the toner on the surface of the developing roller in the developing device was visually checked and evaluated. In view of presence or absence of abnormal output images, the results of the output images were ranked into the following 5 levels.

[Evaluation Criteria]

A: There was no abnormal image, and the toner sticking onto the roller was not caused to occur.

B: There was no abnormal image, but a slight fall of toner was stuck onto the roller surface.

C: Some abnormal images were observed, and the toner sticking onto the roller was clearly observed.

D: Abnormal images were clearly observed, and the toner sticking onto the roller was conspicuous and was on the level where it would be problematic in practical use.

E: Abnormal image were clearly observed, and the toner sticking onto the roller was conspicuous, making it impossible to obtain normal images.

<Carrier Contamination>

Carrier contamination is property that gives an indication of contamination in which toner particles or fine pieces thereof adhered onto the surface of carrier particles. The higher the mechanical strength of the toner is, the less can be the occurrence of carrier contamination.

Specifically, after running output of 100 sheets of an image chart with a 50% image area in the monochrome mode using the evaluation apparatus A, and after running output of 30,000 sheets of the image chart, the developer was removed from the developing device and appropriate amount of the developer was placed in a gage provided with a 30 mesh screen with an opening of 32 μm and was air blown to separate carrier particles from toner particles. In a 50 mL glass bottle vial, 1.0 g of the obtained carrier was placed and 10 mL of chloroform was added, and the contents were shaken up and down by hand 50 times and then left intact for 10 minutes. Subsequently, the supernatant chloroform fluid was poured into a glass cell, the transmittance of the chloroform fluid was measured using a turbidimeter, and the carrier contamination was evaluated based on the following criteria.

[Evaluation Criteria]

A: The transmittance was 95% or more.

B: The transmittance was 90% to 94%.

C: The transmittance was 80% to 89%.

D: The transmittance was 70% to 79%.

E: The transmittance was 69% or less.

<Toner-Filming to Photoconductor Surface>

After running output of 100 sheets of an image chart with a 50% image area in the monochrome mode using the evaluation apparatus A, and after running output of 50,000 sheets of the image chart, the state of toner-filming to the photoconductor surface was visually checked and evaluated. In view of presence or absence of abnormal images in the output images, the toner-filming level was ranked into the following 5 levels.

[Evaluation Criteria]

A: There was no abnormal image, and no toner-filming to the surface of the latent electrostatic image bearing member was observed.

B: There was no abnormal image, but a slight amount of toner-filming to the surface of the latent electrostatic image bearing member was observed.

C: A few abnormal images were present, and toner-filming to the surface of the latent electrostatic image bearing member was clearly observed.

D: Abnormal images were clearly observed, the toner-filming to the surface of the latent electrostatic image bearing member was conspicuous and was on the level where it would be problematic in practical use.

E: Abnormal images were clearly observed, the toner-filming to the surface of the latent electrostatic image bearing member was conspicuous, making it impossible to obtain normal images.

Example 14

The pulverizability, and heat resistance-storage stability were evaluated in the same manner as in Example 1 except that Toner 13 was used instead of Toner 1. Table 6-A shows the evaluation results.

Further, instead of the evaluation apparatus A, another image forming apparatus (evaluation apparatus B) was filled with the toner and used for forming images, and the low-temperature fixing property, anti-hot offset property, fixing-releasing property, initial image quality, stability with time, contamination of developing roller, and toner-filming to photoconductor surface were evaluated in the same manner as in use of the evaluation apparatus A. Tables 6-A and 7-A show the evaluation results.

[Evaluation Apparatus B]

Figure 21:
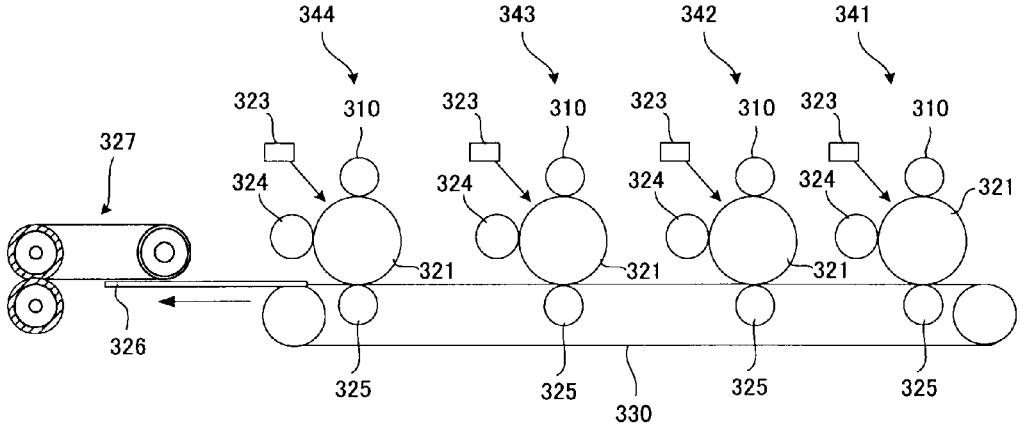
FIG. 21 is a schematic view showing the image forming apparatus (evaluation apparatus B) used in Examples of the present invention.

The image forming apparatus (evaluation apparatus B) shown in FIG. 21 is a direct transfer type tandem image forming apparatus adopting contact charging method, one-component developing method, direct transfer method, "cleaner-less" mode and belt fixing method based on internal heating mode.

The image forming apparatus shown in FIG. 21 is equipped with a contact type charging roller as a charging unit 310 as shown in FIG. 2, a one-component developing device as a developing unit 324 as shown in FIG. 5, and the developing device adopts a "cleaner-less" mode capable of collecting a residual toner. The image forming apparatus is also equipped with a belt fixing device as a fixing unit 327 as shown in FIG. 9, wherein a halogen lamp is used as a heat source for a heating roller. In FIG. 21, reference numeral 330 denotes a conveyer belt.

As an image forming element 341 in the image forming apparatus (evaluation apparatus B) shown in FIG. 21, around the periphery of a photoconductor drum 321, the charging unit 310, an exposing unit 323, the developing unit 324 and a transfer unit 325 are arranged. The photoconductor drum 321 in the image forming element 341 rotates to form a latent electrostatic image corresponding to an exposed image on its surface thereof by charging from the charging unit 310 and the exposure from the exposing unit 323. The latent electrostatic image is developed with a yellow toner by the developing unit 324, and a yellow toner visible image is formed on the surface of the photoconductor drum 321. The visible image is transferred onto a recording medium 326 by the transfer unit 325, and shortly thereafter, a residual toner remaining on the surface of the photoconductor drum 321 is removed by the developing unit 324. Similarly, visible images of magenta toner, cyan toner and black toner are superimposed on the recording medium 326 by each of the image forming elements 342, 343, and 344 to form a color image, and the color image formed on the recording medium 326 is fixed by the fixing unit 327.

Comparative Example 11

The pulverizability and heat resistance-storage stability were evaluated in the same manner as in Example 1 except that Toner 14 was used instead of Toner 1. Table 6-B shows the evaluation results. Further, instead of the evaluation apparatus A, an image forming apparatus (evaluation apparatus B) shown in FIG. 21 was filled with the toner and used for forming images, and the low-temperature fixing property, anti-hot offset property, fixing-releasing property, initial image quality, stability with time, contamination of developing roller, and toner-filming to photoconductor surface were evaluated in the same manner as in use of the evaluation apparatus A. Tables 6-B and 7-B show the evaluation results.

TABLE 6-A

| | Toner | Pulverizability | Heat resistance/ storage stability | Evaluation apparatus | Low-temperature fixing property | Anti-hot offset property | Fixing-releasing property |
|---|---|---|---|---|---|---|---|
| Ex. 1 | Toner 1 | A | B | A | B | B | B |
| Ex. 2 | Toner 2 | A | C | A | B | B | B |
| Ex. 3 | Toner 3 | A | B | A | B | A | B |
| Ex. 4 | Toner 4 | A | B | A | B | B | B |
| Ex. 5 | Toner 5 | A | B | A | B | B | B |
| Ex. 6 | Toner 6 | A | B | A | B | B | A |
| Ex. 7 | Toner 7 | A | B | A | A | B | A |
| Ex. 8 | Toner 8 | A | B | A | A | B | A |
| Ex. 9 | Toner 9 | A | A | A | A | A | A |
| Ex. 10 | Toner 10 | A | A | A | A | A | A |
| Ex. 11 | Toner 11 | A | A | A | A | A | B |
| Ex. 12 | Toner 12 | A | A | A | A | A | B |
| Ex. 13 | Toner 13 | A | A | A | A | A | A |
| Ex. 14 | Toner 13 | A | A | B | A | A | A |
| Ex. 15 | Toner 24 | A | B | A | A | C | C |
| Ex. 16 | Toner 25 | B | A | A | B | A | B |
| Ex. 17 | Toner 26 | A | A | A | A | A | C |
| Ex. 18 | Toner 27 | A | A | A | A | A | A |

TABLE 6-B

| | Toner | Pulverizability | Heat resistance/ storage stability | Evaluation apparatus | Low-temperature fixing property | Anti-hot offset property | Fixing-releasing property |
|---|---|---|---|---|---|---|---|
| Compara. Ex. 1 | Toner 14 | A | B | A | D | A | B |
| Compara. Ex. 2 | Toner 15 | C | D | A | D | C | C |
| Compara. Ex. 3 | Toner 16 | A | E | A | E | E | E |
| Compara. Ex. 4 | Toner 17 | A | B | A | E | A | B |
| Compara. Ex. 5 | Toner 18 | C | E | A | B | E | D |
| Compara. Ex. 6 | Toner 19 | A | C | A | A | C | E |
| Compara. Ex. 7 | Toner 20 | A | C | A | A | C | D |
| Compara. Ex. 8 | Toner 21 | D | B | A | C | C | D |
| Compara. Ex. 9 | Toner 22 | D | C | A | C | D | E |
| Compara. Ex. 10 | Toner 23 | A | E | A | B | E | D |
| Compara. Ex. 11 | Toner 14 | A | B | B | D | A | B |

TABLE 7-A

| | Toner | Evaluation apparatus | Initial image quality | Stability with time | Contamination of developing roller | Carrier contamination | Toner-filming to photoconductor surface |
|---|---|---|---|---|---|---|---|
| Ex. 1 | Toner 1 | A | A | B | B | B | A |
| Ex. 2 | Toner 2 | A | A | B | B | B | A |
| Ex. 3 | Toner 3 | A | A | B | A | B | A |
| Ex. 4 | Toner 4 | A | A | B | B | B | A |
| Ex. 5 | Toner 5 | A | A | B | B | B | A |
| Ex. 6 | Toner 6 | A | A | B | A | B | A |
| Ex. 7 | Toner 7 | A | A | B | A | B | A |
| Ex. 8 | Toner 8 | A | A | B | A | B | A |
| Ex. 9 | Toner 9 | A | A | B | A | B | A |
| Ex. 10 | Toner 10 | A | A | A | A | B | A |
| Ex. 11 | Toner 11 | A | A | A | B | A | A |

TABLE 7-A-continued

| | Toner | Evaluation apparatus | Initial image quality | Stability with time | Contamination of developing roller | Carrier contamination | Toner-filming to photoconductor surface |
|---|---|---|---|---|---|---|---|
| Ex. 12 | Toner 12 | A | A | B | A | B | A |
| Ex. 13 | Toner 13 | A | A | A | A | A | A |
| Ex. 14 | Toner 13 | B | A | A | A | — | A |
| Ex. 15 | Toner 24 | A | A | B | C | B | B |
| Ex. 16 | Toner 25 | A | A | A | A | B | A |
| Ex. 17 | Toner 26 | A | A | A | A | A | A |
| Ex. 18 | Toner 27 | A | A | B | B | C | B |

TABLE 7-B

| | Toner | Evaluation apparatus | Initial image quality | Stability with time | Contamination of developing roller | Carrier contamination | Toner-filming to photoconductor surface |
|---|---|---|---|---|---|---|---|
| Compara. Ex. 1 | Toner 14 | A | C | D | A | B | B |
| Compara. Ex. 2 | Toner 15 | A | C | E | C | C | C |
| Compara. Ex. 3 | Toner 16 | A | D | E | E | E | E |
| Compara. Ex. 4 | Toner 17 | A | C | D | B | C | D |
| Compara. Ex. 5 | Toner 18 | A | C | E | B | C | D |
| Compara. Ex. 6 | Toner 19 | A | A | C | D | D | E |
| Compara. Ex. 7 | Toner 20 | A | A | C | D | D | E |
| Compara. Ex. 8 | Toner 21 | A | A | B | D | A | E |
| Compara. Ex. 9 | Toner 22 | A | B | C | E | A | E |
| Compara. Ex. 10 | Toner 23 | A | C | E | C | D | D |
| Compara. Ex. 11 | Toner 14 | B | C | D | B | — | B |

The toner of the present invention is excellent in all of the low-temperature fixing property, anti-offset property, storage stability, mechanical strength, anti-fouling property to developing devices and carrier particles, toner filming resistance to latent electrostatic image bearing members and carrier particles, and is preferably used in electrophotographic image forming apparatuses, and image forming methods and process cartridges adopting electrophotography.

Since the image forming apparatus, the image forming method and the process cartridge of the present invention respectively use the toner of the present invention and are capable of forming extremely high-quality images with no change in color tone being recognized and with no abnormal images such as a reduction in image density and background smear being observed for a long period of time, they can be widely used, for example, in laser printers, direct digital platemakers, full-color copiers, full-color laser printers and full-color regular paper facsimiles each of which adopts a direct or an indirect electrophotographic multicolor image developing technique.

What is claimed is:

1. A toner comprising:

a binder resin, a releasing agent, and a colorant, wherein the binder resin comprises at least a polyester resin (A) having a softening point Tm (A) of 120° C. to 160° C., a polyester resin (B) having a softening point Tm (B) of 80° C. or more and less than 120° C. and a composite resin (C) containing a condensation polymerization monomer and an addition polymerization monomer, at least any one of the polyester resins (A) and (B) is a polyester resin prepared by condensation-polymerizing an alcohol component composed of aliphatic alcohol with a carboxylic acid component, and 65 mole % or more of the alcohol component is 1,2-propanediol, wherein 90 mole % or more of the alcohol component is the aliphatic alcohol, wherein the condensation polymerization monomer to be used in the composite resin (C) is at least one member selected from the group consisting of: polyester resin units formed from a polyhydric alcohol and a polyhydric carboxylic acid; polyamide resin units formed from a polyhydric carboxylic acid and an amine or an amino acid; and polyester-polyamide resin units, and wherein the addition polymerization monomer to be used in the composite resin (C) is at least one member selected from vinyl monomers.

2. The toner according to claim 1, wherein the alcohol component of at least any one of the polyester resins (A) and (B) further comprises glycerin.

3. The toner according to claim 1, wherein the alcohol component of the polyester resin (A) further comprises 1,3-propanediol.

4. The toner according to claim 1, wherein the carboxylic acid component of at least any one of the polyester resins (A) and (B) comprises an aliphatic dicarboxylic acid compound having 2 to 4 carbon atoms.

5. The toner according to claim 1, wherein the carboxylic acid component of at least any one of the polyester resins (A) and (B) comprises a purified rosin.

6. The toner according to claim 1, wherein the mass ratio [(A)/(B)] of the polyester resin (A) to the polyester resin (B) is 10/90 to 90/10.

7. The toner according to claim 1, wherein the difference [Tm (A)−Tm (B)] of the softening point Tm (A) minus the softening point Tm (B) is 10° C. or more.

8. The toner according to claim 1, wherein the softening point Tm (C) of the composite resin (C) is 90° C. to 130° C.

9. The toner according to claim 1, wherein the condensation polymerization monomer contained in the composite resin (C) comprises an alcohol component and a carboxylic acid component.

10. The toner according to claim 9, wherein the alcohol component contained in the condensation polymerization monomer in the composite resin (C) comprises an aromatic polyhydric alcohol compound.

11. The toner according to claim 9, wherein the carboxylic acid component contained in the condensation polymerization monomer in the composite resin (C) comprises an aromatic polyhydric carboxylic acid compound.

12. The toner according to claim 1, wherein the addition polymerization monomer contained in the composite resin (C) comprises a vinyl compound containing at least a styrene monomer and an acrylate monomer.

13. The toner according to claim 1, wherein the molar ratio of the condensation polymerization monomer in the composite resin (C) is 5 mole % to 40 mole %.

14. The toner according to claim 1, wherein the mass ratio [(C)/((A)+(B))] of the composite resin (C) to the polyester resins (A) and (B) is 3/97 to 20/80.

15. The toner according to claim 1, wherein the mass ratio [(releasing agent)/(binder resin)×100] of the releasing agent to the binder resin is 1% by mass to 20% by mass.

16. The toner according to claim 1, wherein the releasing agent comprises carnauba wax.

17. A developer comprising:

a toner, wherein the toner comprises at least a binder resin, a releasing agent, and a colorant, wherein the binder resin comprises at least a polyester resin (A) having a softening point Tm (A) of 120° C. to 160° C., a polyester resin (B) having a softening point Tm (B) of 80° C. or more and less than 120° C. and a composite resin (C) containing a condensation polymerization monomer and an addition polymerization monomer, at least any one of the polyester resins (A) and (B) is a polyester resin prepared by condensation-polymerizing an alcohol component composed of aliphatic alcohol with a carboxylic acid component, and 65 mole % or more of the alcohol component is 1,2-propanediol, wherein 90 mole % or more of the alcohol component is the aliphatic alcohol, wherein the condensation polymerization monomer to be used in the composite resin (C) is at least one member selected from the group consisting of: polyester resin units formed from a polyhydric alcohol and a polyhydric carboxylic acid; polyamide resin units formed from a polyhydric carboxylic acid and an amine or an amino acid; and polyester-polyamide resin units, and wherein the addition polymerization monomer to be used in the composite resin (C) is at least one member selected from vinyl monomers.

18. An image forming method comprising:

charging the surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner comprises at least a binder resin, a releasing agent, and a colorant, wherein the binder resin comprises at least a polyester resin (A) having a softening point Tm (A) of 120° C. to 160° C., a polyester resin (B) having a softening point Tm (B) of 80° C. or more and less than 120° C. and a composite resin (C) containing a condensation polymerization monomer and an addition polymerization monomer, at least any one of the polyester resins (A) and (B) is a polyester resin prepared by condensation-polymerizing an alcohol component composed of aliphatic alcohol with a carboxylic acid component, and 65 mole % or more of the alcohol component is 1,2-propanediol, wherein 90 mole % or more of the alcohol component is the aliphatic alcohol, wherein the condensation polymerization monomer to be used in the composite resin (C) is at least one member selected from the group consisting of: polyester resin units formed from a polyhydric alcohol and a polyhydric carboxylic acid; polyamide resin units formed from a polyhydric carboxylic acid and an amine or an amino acid; and polyester-polyamide resin units, and wherein the addition polymerization monomer to be used in the composite resin (C) is at least one member selected from vinyl monomers.

* * * * *